US011181336B2

(12) United States Patent
Thalberg

(10) Patent No.: US 11,181,336 B2
(45) **Date of Patent: *Nov. 23, 2021**

(54) ARCHERY BOW OPERABLE TO CHANGE TENSION

(71) Applicant: Krysse AS, Oslo (NO)

(72) Inventor: Anders P. Thalberg, Greaker (NO)

(73) Assignee: Krysse AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 16/821,475

(22) Filed: Mar. 17, 2020

(65) Prior Publication Data

US 2021/0088306 A1 Mar. 25, 2021

(30) Foreign Application Priority Data

Sep. 19, 2019 (NO) ..... 20191134

(51) Int. Cl.
*F41B 5/10* (2006.01)
*F41B 5/14* (2006.01)
*F41B 5/12* (2006.01)

(52) U.S. Cl.
CPC ..... *F41B 5/1469* (2013.01); *F41B 5/10* (2013.01); *F41B 5/123* (2013.01)

(58) Field of Classification Search
CPC .... F41B 5/10; F41B 5/12; F41B 5/123; F41B 5/1469; F41B 5/1449
USPC ..... 124/25, 25.6, 86
See application file for complete search history.

(56) References Cited

U.S. PATENT DOCUMENTS

| | | | |
|---|---|---|---|
| 3,028,851 | A | 4/1962 | Drake |
| 3,744,473 | A | 7/1973 | Nishioka |
| 3,812,835 | A | 5/1974 | Smith |
| 3,957,027 | A | 5/1976 | Drake |
| 4,054,118 | A | 10/1977 | McKee et al. |
| 4,103,667 | A | 8/1978 | Shepley |
| 4,169,456 | A | 10/1979 | Van House |
| 4,183,345 | A | 1/1980 | Caldwell |
| 4,187,826 | A | 2/1980 | Killian |
| 4,201,182 | A | 5/1980 | Butler |
| 4,227,509 | A | 10/1980 | Jones |
| 4,287,867 | A | 9/1981 | Islas |

(Continued)

FOREIGN PATENT DOCUMENTS

| | | |
|---|---|---|
| AT | A 50658/2016 | 11/2017 |
| CA | 1122865 A | 5/1982 |

(Continued)

OTHER PUBLICATIONS

Parker Bows; Parker Concorde; Dated Jul. 10, 2011; Retrieved from the Internet <https://www.youtube.com/watch?v=bNq6Dp3-CuY>; (5 pages).

(Continued)

*Primary Examiner* — Alexander R Niconovich
(74) *Attorney, Agent, or Firm* — Barclay Damon LLP

(57) ABSTRACT

An archery bow and method are disclosed herein. The archery bow, in an embodiment, includes a first limb, a second limb, and a draw cord coupled to the first and second limbs. The archery bow also includes a first cord coupled to the first limb, a second cord coupled to the second limb, and a driver operatively coupled to an energy source. The driver is configured to manipulate the first and second cords to change a tension in the draw cord.

23 Claims, 61 Drawing Sheets

(56) References Cited

U.S. PATENT DOCUMENTS 4,350,138 A 9/1982 Caldwell
4,478,202 A * 10/1984 Anderson ..... F41B 5/10 124/23.1
4,512,326 A 4/1985 Jarrett
4,603,676 A * 8/1986 Luoma ..... F41B 5/1469 124/25
4,644,928 A 2/1987 Studanski
4,646,708 A 3/1987 Imes
4,649,891 A * 3/1987 Bozek ..... F41B 5/123 124/25
4,671,249 A 6/1987 Troncoso
4,672,943 A 6/1987 Bozek
4,712,533 A 12/1987 Cruise
4,756,295 A 7/1988 Guzzetta
4,781,168 A 11/1988 Lester
4,858,588 A 8/1989 Bozek
4,955,354 A 9/1990 Bozek
4,989,577 A 2/1991 Bixby
5,125,389 A 6/1992 Paff
5,220,906 A * 6/1993 Choma ..... F41B 5/12 124/25
5,280,779 A 1/1994 Smith
5,388,564 A * 2/1995 Islas ..... F41B 5/0094 124/23.1
5,429,106 A 7/1995 Martin et al.
5,445,139 A * 8/1995 Bybee ..... F41B 5/12 124/23.1
5,657,739 A 8/1997 Smith
5,720,267 A 2/1998 Walk
5,749,348 A * 5/1998 Oviedo-Reyes ..... F41B 5/12 124/25
5,931,146 A * 8/1999 Schrader ..... F41B 5/0052 124/23.1
5,979,425 A 11/1999 Loomis
6,024,076 A 2/2000 Laborde
6,286,496 B1 * 9/2001 Bednar ..... F41B 5/123 124/25
6,470,870 B1 10/2002 Schaar
6,990,970 B1 1/2006 Darlington
7,017,568 B1 * 3/2006 Smith ..... F41B 5/12 124/25
7,201,161 B1 4/2007 York
7,204,242 B2 4/2007 Dziekan
7,568,372 B1 8/2009 Patton
7,699,045 B1 4/2010 Kronengold et al.
7,740,011 B1 6/2010 Bernardy
7,784,452 B1 8/2010 Kronengold et al.
7,823,572 B2 * 11/2010 Anderson ..... F41B 5/1469 124/25
8,191,541 B2 6/2012 Shaffer et al.
8,240,075 B1 8/2012 Mullin
8,240,299 B2 8/2012 Kronengold et al.
8,387,603 B2 * 3/2013 Darlington ..... F41B 5/12 124/25.6
8,439,025 B2 5/2013 Shaffer et al.
8,453,631 B1 6/2013 Kronengold et al.
8,469,012 B2 6/2013 Bednar et al.
8,607,773 B1 * 12/2013 Schultz ..... F41B 7/00 124/25
8,651,095 B2 * 2/2014 Islas ..... F41B 5/123 124/25
8,763,595 B1 7/2014 Bednar et al.
8,794,225 B2 8/2014 Bednar et al.
8,899,217 B2 12/2014 Islas
9,086,249 B2 7/2015 Peacemaker
9,140,281 B1 9/2015 Schaar
9,234,719 B1 * 1/2016 Kempf ..... F41B 5/123
9,243,861 B1 * 1/2016 Kempf ..... F41B 5/12
9,255,753 B2 2/2016 Pulkrabek et al.
9,255,757 B2 * 2/2016 McPherson ..... F41B 5/12
9,255,759 B1 * 2/2016 Archer ..... F41B 5/10
9,273,922 B2 * 3/2016 Hudkins ..... F41B 5/123
9,291,421 B1 * 3/2016 Kempf ..... F41B 5/123
9,341,432 B1 * 5/2016 Wohleb ..... F16H 25/20
9,354,015 B2 5/2016 Yehle
9,377,267 B1 * 6/2016 Kempf ..... F41B 5/123
9,383,159 B2 7/2016 Pulkrabek et al.
9,494,379 B2 11/2016 Yehle
9,494,380 B1 11/2016 Yehle
9,506,716 B2 11/2016 Bednar et al.
9,513,080 B1 * 12/2016 Kempf ..... F41B 5/1411
9,518,797 B2 * 12/2016 Carroll, Jr. ..... F41B 5/12
9,557,134 B1 1/2017 Yehle
9,689,638 B1 6/2017 Yehle
9,810,503 B2 * 11/2017 Serviss ..... F41B 5/10
9,851,171 B2 12/2017 Bednar et al.
9,863,735 B2 1/2018 Bednar et al.
9,879,936 B2 1/2018 Yehle
9,879,938 B1 1/2018 Isenhower et al.
9,933,225 B2 4/2018 Yehle et al.
10,018,443 B2 7/2018 Dziekan
10,077,965 B2 9/2018 Yehle
10,082,359 B2 9/2018 Yehle
10,126,088 B2 11/2018 Yehle
10,139,205 B2 11/2018 Yehle et al.
D836,743 S 12/2018 Yehle
D838,477 S 1/2019 Hedberg
D839,374 S 1/2019 Yehle
10,175,023 B2 1/2019 Yehle
10,203,186 B2 2/2019 Yehle et al.
10,209,026 B2 2/2019 Yehle
10,254,073 B2 4/2019 Yehle
10,254,075 B2 4/2019 Yehle
10,260,835 B2 4/2019 Pulkrabek et al.
10,267,592 B2 4/2019 Bartels
10,323,899 B2 * 6/2019 Missbach ..... F41B 5/1449
10,359,254 B1 7/2019 Kempf et al.
10,378,852 B1 * 8/2019 Rotramel ..... F41B 5/00
10,408,558 B2 * 9/2019 Thalberg ..... F41B 5/1449
10,458,743 B1 10/2019 Kempf et al.
10,712,118 B2 7/2020 Yehle
10,724,821 B2 * 7/2020 Thalberg ..... F41B 5/10
10,852,095 B2 * 12/2020 Haynes ..... F41B 5/1434
2004/0094139 A1 * 5/2004 Andrews ..... F41B 5/10 124/23.1
2004/0194771 A1 * 10/2004 Malucelli ..... F41B 5/12 124/25
2005/0139200 A1 6/2005 Gallops
2006/0011181 A1 1/2006 Andrews
2007/0089722 A1 * 4/2007 Flanagan ..... F41B 5/14 124/23.1
2007/0119438 A1 5/2007 Pittman
2008/0127961 A1 6/2008 McPherson
2009/0064978 A1 3/2009 Matasic et al.
2009/0101126 A1 4/2009 Anderson
2011/0120436 A1 * 5/2011 Eee ..... F41B 5/10 124/25.6
2011/0220085 A1 9/2011 Christensen et al.
2011/0308508 A1 12/2011 Islas
2012/0192843 A1 8/2012 Batdorf
2012/0222663 A1 9/2012 Nebergall
2013/0061839 A1 * 3/2013 Asherman ..... F41B 5/1469 124/25.6
2013/0312724 A1 * 11/2013 Hudkins ..... F41B 5/123 124/25
2014/0261355 A1 * 9/2014 Peacemaker ..... F41B 5/1403 124/23.1
2014/0261356 A1 * 9/2014 Peacemaker ..... F41B 5/1469 124/23.1
2014/0261360 A1 9/2014 Pulkrabek
2014/0352678 A1 12/2014 Howard
2016/0010943 A1 * 1/2016 DeBole ..... F41B 5/1403 124/25.6
2017/0108307 A1 4/2017 Yehle
2017/0261355 A1 9/2017 Bessonov et al.
2018/0051955 A1 2/2018 Yehle
2018/0094895 A1 4/2018 Yehle
2018/0321010 A1 11/2018 Yehle
2018/0321011 A1 11/2018 Yehle
2019/0025004 A1 1/2019 Thalberg
2019/0025005 A1 1/2019 Shaffer et al.
2019/0128637 A1 * 5/2019 Missbach ..... F41B 5/12

(56) References Cited

U.S. PATENT DOCUMENTS

| | | | |
|---|---|---|---|
| 2019/0137212 | A1 | 5/2019 | Yehle |
| 2019/0137245 | A1 | 5/2019 | Yehle et al. |
| 2019/0154392 | A1 | 5/2019 | Yehle |
| 2019/0186863 | A1 | 6/2019 | Yehle |
| 2019/0186865 | A1 | 6/2019 | Pulkrabek et al. |
| 2019/0226793 | A1 | 7/2019 | Thalberg |
| 2019/0242671 | A1 | 8/2019 | Bartels |
| 2019/0376761 | A1 | 12/2019 | Thalberg |
| 2020/0049446 | A1 | 2/2020 | Thalberg |

FOREIGN PATENT DOCUMENTS

| | | | |
|---|---|---|---|
| CA | 2481600 | | 6/2010 |
| CN | 202928451 | U | 5/2013 |
| DE | 3502617 | C2 | 1/1985 |
| EP | 0029866 | B1 | 6/1981 |
| KR | 20110058373 | A | 6/2011 |
| NO | 20161182 | A1 | 1/2018 |
| WO | 2018012982 | A1 | 1/2018 |
| WO | 2018014062 | A1 | 1/2018 |
| WO | 2019017798 | A1 | 1/2019 |

OTHER PUBLICATIONS

Parker Concorde; Crossbow Report; Jace Bauserman; Inside Archery; on or before May 30, 2011 (2 pages).
NO Application No. NO20191134; filed Sep. 19, 2019; NO Search Report; dated Mar. 30, 2020 (2 pages).
Oneida Eagle; On or before Dec. 31, 1993 ( 1 page).
Tenpoint and Ravin Crossbows; On or before Sep. 12, 2019 (2 pages).
"Oneida Eagle Bows"; Oneida Eagle Bows; Jul. 5, 2017; retrieved from the Internet <https://web.archive.org/web/20170705202203/http://oneidaeaglebows.com/#>; (1 page).
Rick Combs; "Bow Report on Oneida Kestrel"; Grand View Outdoors; Nov. 1, 2013; retrieved from the Internet: <https://www.grandviewoutdoors.com/bowhunting/bow-report-oneida-kestrel>; (5 pages).
EP17828029; filed Jul. 14, 2017; Supplementary European Search Report, dated Feb. 7, 2020; (2 pages).
PCT/NO2017/000019 filed Jul. 14, 2017; International Search Report/Written Opinion dated Nov. 1, 2017 (11 pages).
Krysse AS; Norway Application No. NO20191134; filed Sep. 19, 2019.
Krysse AS; Norway Application No. NO20161182; filed Jul. 15, 2016; Norwegian Search Report dated Dec. 23, 2016 (2 pages).
Krysse AS; Norway Application No. NO20200033; filed Jan. 10, 2020.
Krysse AS: Norway Application No. NO20200143; filed Feb. 4, 2020.
Krysse AS; Norway Application No. NO20200299; filed Mar. 11, 2020.
PCT/NO2018/050195;filed Jul. 18, 2018; International Search Report and Written Opinion dated Oct. 30, 2018; Bakke Invest AS (6 pages).
Hunt Hacks; How to Set the Draw Weight on a Compound Bow; Jul. 4, 2016; retrieved from <https://hunthacks.com/set-draw-weight-compound-bow/> (6 pages).

* cited by examiner

ARCHERY BOW OPERABLE TO CHANGE TENSION

CROSS-REFERENCE TO RELATED APPLICATION

Pursuant to 35 U.S.C. § 119, this application claims priority to, and the benefit of, Norwegian Patent Application No. 20191134 filed on Sep. 19, 2019, the entire contents of which are hereby incorporated herein by reference.

INCORPORATION BY REFERENCE

The entire contents of the following are hereby incorporated into this application by reference: (a) International PCT Patent Application No. PCT/N02018/050195 filed on Jul. 18, 2018, published as WIPO Patent Application No. WO 2019/017798; (b) U.S. Provisional Patent Application No. 62/533,739 filed on Jul. 18, 2017; and (c) U.S. Provisional Patent Application No. 62/578,640 filed on Oct. 30, 2017.

BACKGROUND

Crossbows enable archers to shoot arrows in a fashion that resembles shooting a rifle. However, crossbows have several disadvantages. Crossbows are relatively large, requiring substantial space for usage, storage and transportation. For example, the wing-like limbs of crossbows can give crossbows a relatively large wingspan. Also, crossbows are relatively long to accommodate the limbs and generate the appropriate draw weight on the bowstring. This form factor complicates the use and carrying of the crossbows during hunting and competition events. Also, crossbows can be difficult to cock, especially for archers lacking in body strength. The known cocking accessories can be cumbersome, time consuming and inconvenient to use, especially during hunting and competition shooting. Also, crossbows can be over-weighted at their forward ends, creating problems experienced by archers, such as arm fatigue, aiming difficulties and shooting inaccuracies. The foregoing background describes some, but not necessarily all, of the problems, disadvantages and shortcomings related to crossbows.

SUMMARY

In an embodiment, the crossbow includes: (a) a stock having a butt configured to face in a rearward direction along a longitudinal axis; (b) a body coupled to the stock, wherein the body has a trigger housing portion and a limb mount portion; and (c) a plurality of limbs moveably coupled to the body.

Each of the limbs includes: (a) a coupled limb end that is coupled to the limb mount portion; and (b) an uncoupled limb end that is positioned forward of the coupled limb end. The crossbow also has an energizer operatively coupled to the limbs, and the energizer includes an electrical power source.

In an embodiment, a method for manufacturing a crossbow includes the following steps: (a) providing a stock that has a butt configured to face in a rearward direction along a longitudinal axis; (b) structuring a body to have a trigger housing portion and a limb mount portion; (c) coupling a foregrip to the body so that the foregrip is positioned at least partially forward of the limb mount portion; (d) coupling the body to the stock; (e) structuring a plurality of limbs so that each of the limbs includes: (i) a coupled limb end that is moveably coupled to the limb mount portion; and (ii) an uncoupled limb end that is positioned forward of the coupled limb end; (f) providing an energizer having an electrical power source; and (g) operatively coupling the energizer to the limbs. The foregoing steps can be performed in any particular order, not necessarily in the sequence set forth above.

In another embodiment, the crossbow includes: (a) a stock having a butt configured to face in a rearward direction along a longitudinal axis; (b) a body coupled to the stock, wherein the body comprises a trigger housing portion and a limb mount portion; (c) a foregrip supported by the body, wherein the foregrip is positioned at least partially forward of the limb mount portion; (d) a track supported by the body; (e) a trigger supported by the body; (f) a cord holder operatively coupled to the trigger; and (g) a plurality of limbs moveably coupled to the body.

Each of the limbs includes: (a) a coupled limb end that is coupled to the limb mount portion, wherein a first lateral plane extends through the coupled limb end, and the first lateral plane intersects with the longitudinal axis; and (b) an uncoupled limb end, wherein a second lateral plane extends through the uncoupled limb end, and the second lateral plane intersects with the longitudinal axis, wherein the second lateral plane is positioned forward of the first lateral plane. Each of the limbs has an elastic characteristic.

The crossbow also includes a draw cord coupled to the uncoupled limb ends, wherein the draw cord is configured to be engaged with a projectile. Also, the crossbow includes an energizer operatively coupled to the limbs, wherein the energizer includes an electrical power source.

The crossbow is configured to be transitioned from an undrawn condition to a drawn condition in response to a manual force applied to the draw cord by the archer. The crossbow is also configured to be transitioned from the drawn condition to an energized condition in response to a driving force transmitted by the energizer, wherein the driving force bends each of the limbs into an at least partial arc shape associated with a spring force. In response to a manipulation of the trigger, the cord holder is configured to release the draw cord so that the draw cord launches the projectile toward the target based on the spring force. The spring force has a magnitude that is sufficient to propel the projectile to the target without depending upon an increase in the distance between the uncoupled limb ends during the transition from the drawn condition to the energized condition.

Additional features and advantages of the present disclosure are described in, and will be apparent from, the following Brief Description of the Drawings and Detailed Description.

DETAILED DESCRIPTION

Figure 1:
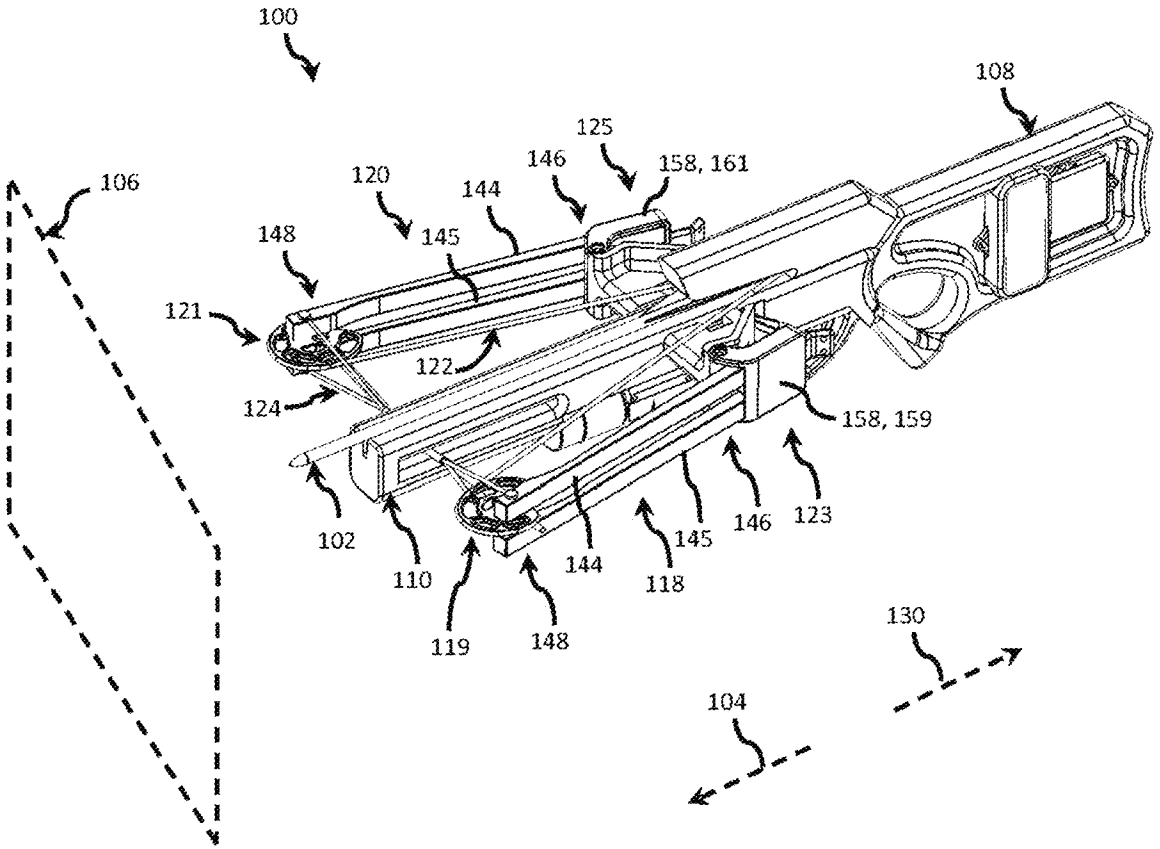
FIG. 1 is a front isometric view of an embodiment of the crossbow.

Referring to FIGS. 1-9, in an embodiment, the crossbow 100 is an archery weapon operable to launch an arrow, bolt or projectile 102 in a forward direction 104 toward a target 106. In this embodiment, the crossbow 100 includes: (a) a stock 108; (b) a body 110 extending from or otherwise coupled to the stock 108; (c) a track 112 (FIG. 8) supported by or defined by the body 110; (d) a trigger 114 (FIG. 5) supported by, and pivotally coupled to, the body 110; (e) a catch, retainer or cord holder 116 (FIG. 9) supported by, and moveably coupled to, the body 110; (f) a plurality of limbs 118, 120 supported by, and moveably coupled to, the body 110; (g) a plurality of rotors 119, 121 that are rotatably coupled to the limbs 118, 120, respectively; (h) a plurality of limb coupling assemblies 123, 125 that couple the limbs 118, 120, respectively, to the body 110; (i) a foregrip 127 (FIG. 5) supported by the body 110; (j) a cable, bowstring, draw string or draw cord 122 coupled to the limbs 118, 120; (k) a power cable, power cord or supplemental cord 124 coupled to the limbs 118, 120 and arranged in an X-shape; and (l) an energizer 126 (FIG. 6) operatively coupled to the limbs 118, 120.

Figure 4:
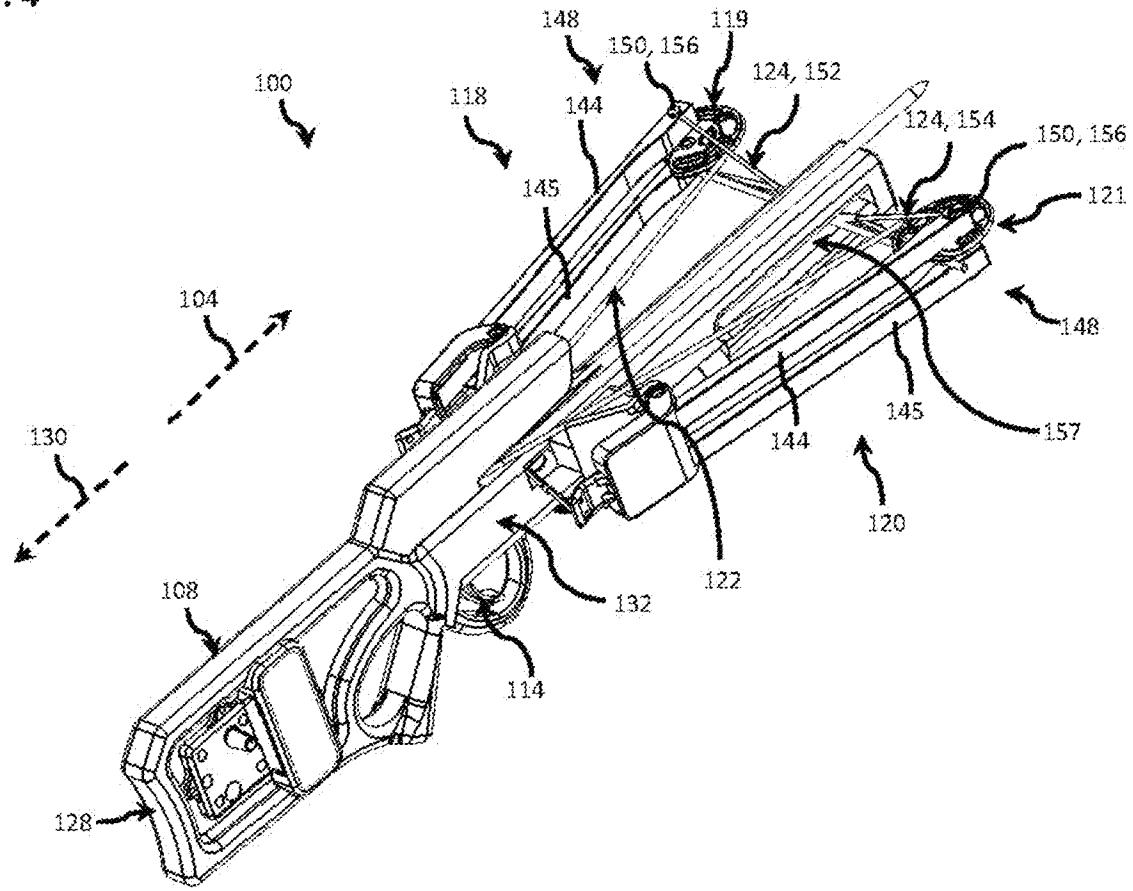
FIG. 4 is a rear isometric view of the crossbow of FIG. 1.

The stock 108 has a stock end or butt 128 configured face in a rearward direction 130. In an embodiment, the butt 128 has a concave shape, as shown in FIG. 4, and is configured to be pressed against the archer's chest-shoulder region. The body 110 includes a trigger housing portion 132 defining a cavity (not shown) configured to receive and house a trigger mechanism or trigger assembly (not shown), The trigger assembly is operatively coupled to the trigger 114 and cord holder 116. Depending upon the embodiment, the trigger assembly can include one or more links and springs as well as a safety device.

Figure 5:
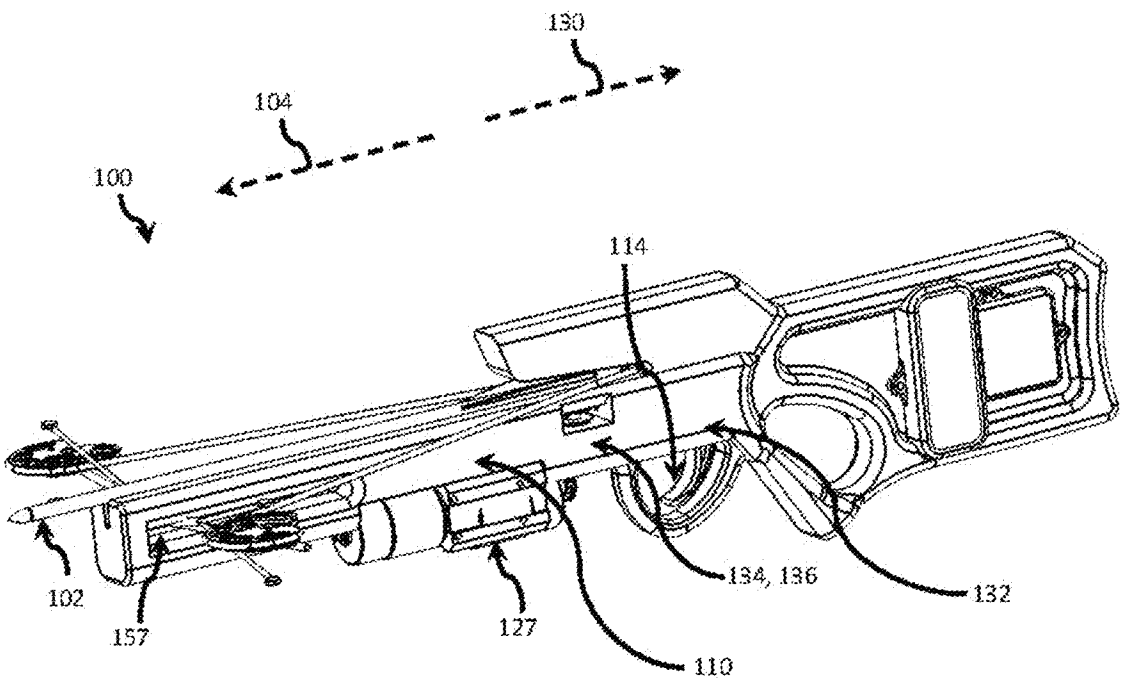
FIG. 5 is a right side isometric view of the crossbow of FIG. 1, illustrating the crossbow with the limbs removed.
Figure 6:
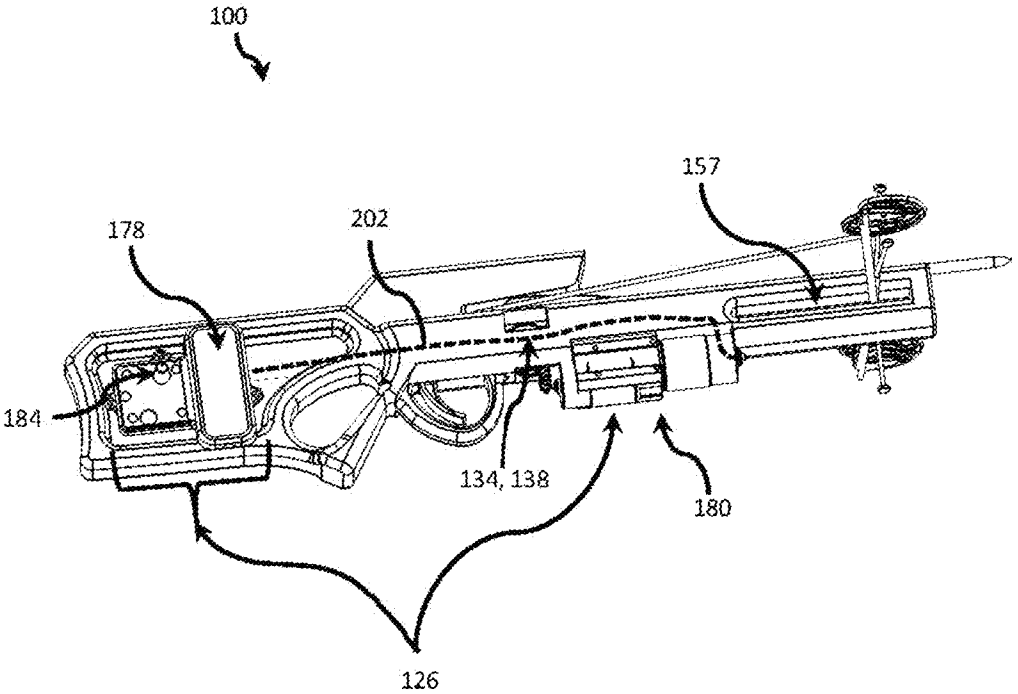
FIG. 6 is a left side isometric view of the crossbow of FIG. 1, illustrating the limbs removed.

As illustrated in FIGS. 5-6, the body 110 also includes a limb mount portion 134, which includes limb mounts 136, 138. The limb mounts 136, 138 engage with the limbs 118, 120, respectively, as described below.

The foregrip 127 includes a hand interface surface, as illustrated in FIG. 5. The foregrip 127 is configured to be engaged with the forward hand of the archer, while the archer's rear hand is engaged with the trigger 114. Depending upon the embodiment, the foregrip 127 can include a plurality of ridges or other suitable friction enhancers to facilitate gripping by the archer's hand. It should be appreciated that the foregrip 127 can be attached to the body 110, as shown, or integral with the body 110.

Figure 2:
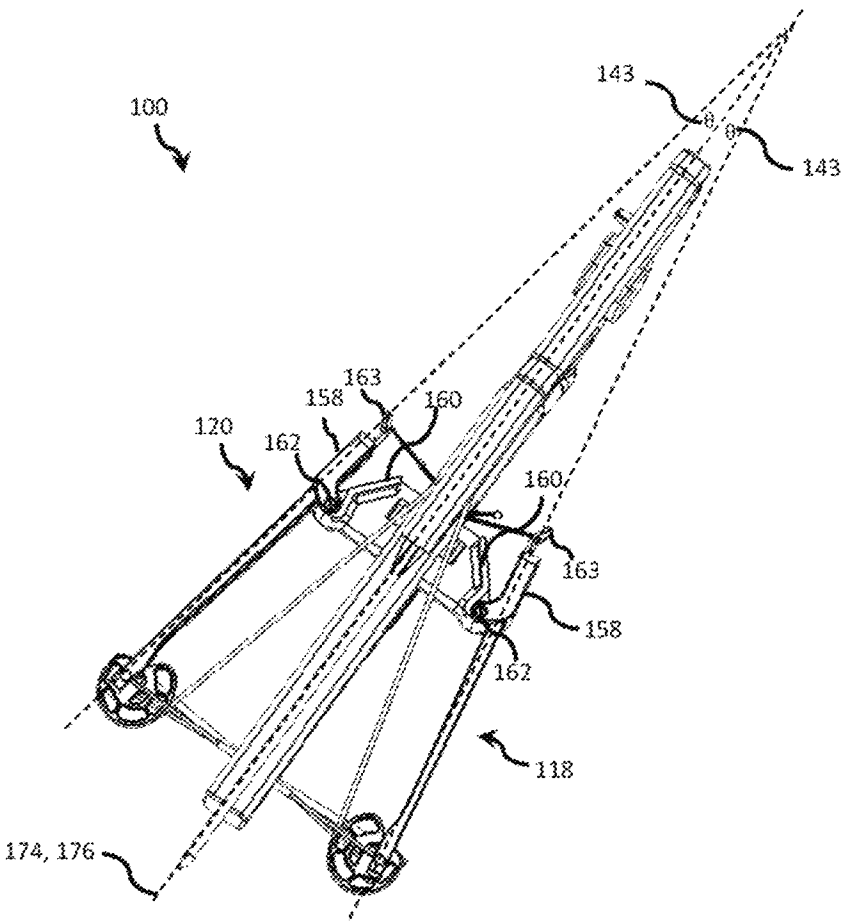
FIG. 2 is a top, plan view of the crossbow of FIG. 1.

As illustrated in FIGS. 2 and 5-6, the limb mount portion 134 is positioned at least partially rearward of the foregrip 127. Also, the limb mount portion 134 is positioned between the trigger 114 and the foregrip 127 in close proximity to the trigger 114. The limb mount portion 134 is located substantially at the middle of the body 110 along the body axis 176 (FIG. 2). In an embodiment, the limb mount portion 134 is located rearward of the middle of the body 110 along the body axis 176. As illustrated in FIG. 2, this configuration enables the crossbow 100 to have a relatively small angle 143 between each of the limbs 118, 120 and the vertical plane 174. Depending upon the embodiment, the angle 143 can be zero degrees (in which case the limbs 118, 120 are parallel to the body axis 176), less than five degrees, less than ten degrees, less than fifteen degrees, less than twenty degrees, less than twenty-five degrees, less than thirty degrees, less than forty degrees, less than fifty degrees or any other suitable angle. This configuration enables the crossbow 100 to have a relatively short and compact form, enhancing the ease of use and convenience with respect to carrying, shooting, storing and transporting the crossbow 100.

Figure 7:
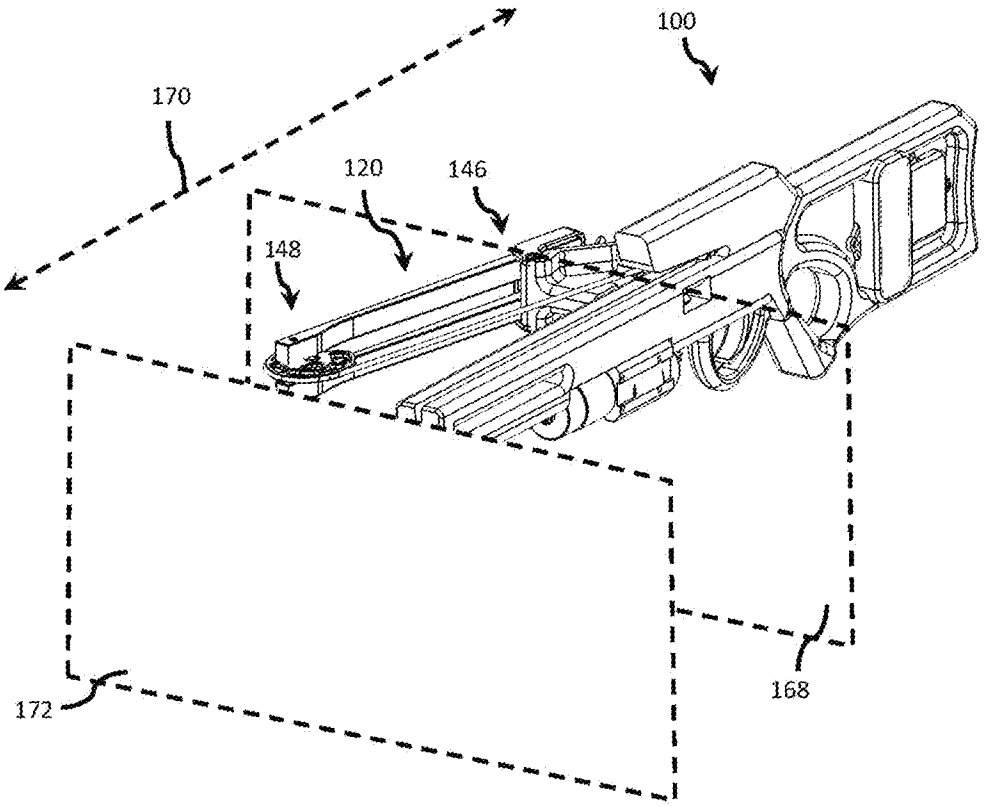
FIG. 7 is a front isometric view of the crossbow of FIG. 1, illustrating lateral planes intersecting with a longitudinal axis.
Figure 8:
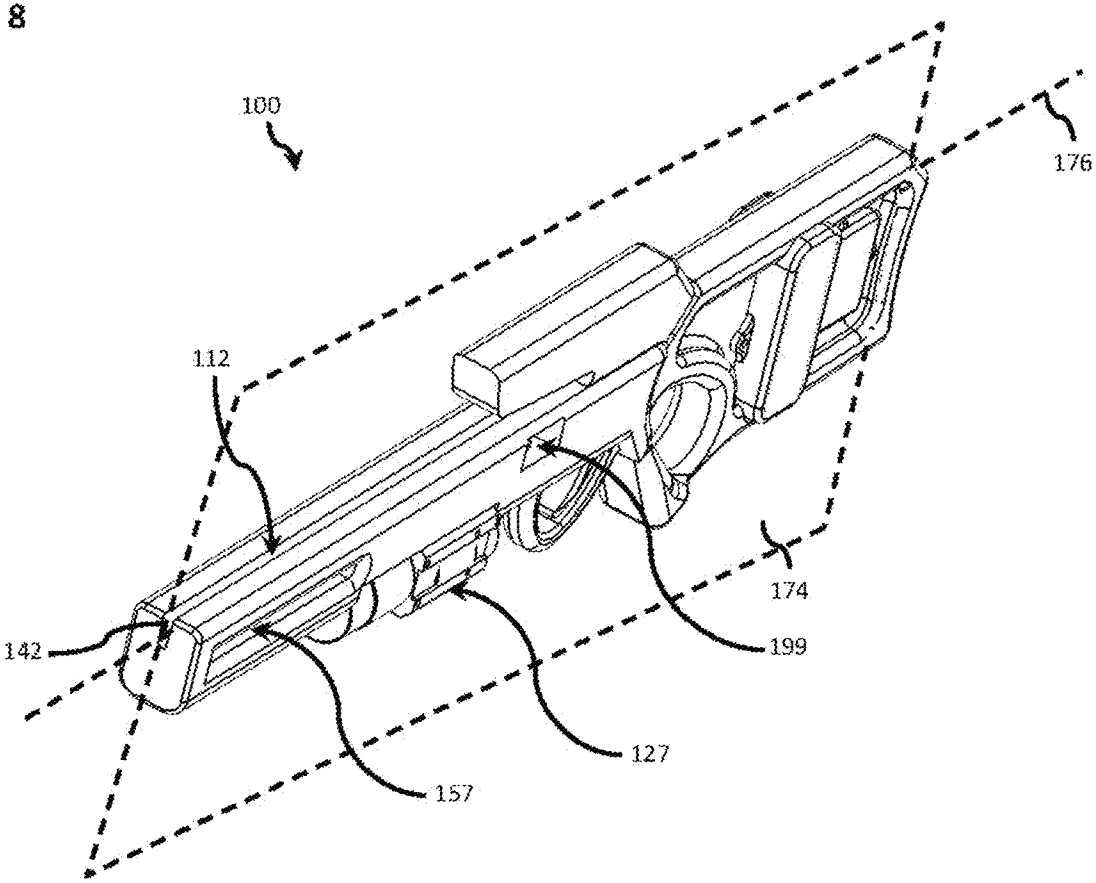
FIG. 8 is a front isometric view of the crossbow of FIG. 1, illustrating a vertical plane through which a body axis extends.

Referring to FIGS. 7-8, the track 112 defines a U-shaped channel or groove 142 configured to at least partially receive the projectile 102. Depending upon the embodiment, the track 112 can define a barrel. The track 112 can be integral and unitary with the body 110, or the track 112 can be a separate component that is coupled to the body 110.

Figure 9:
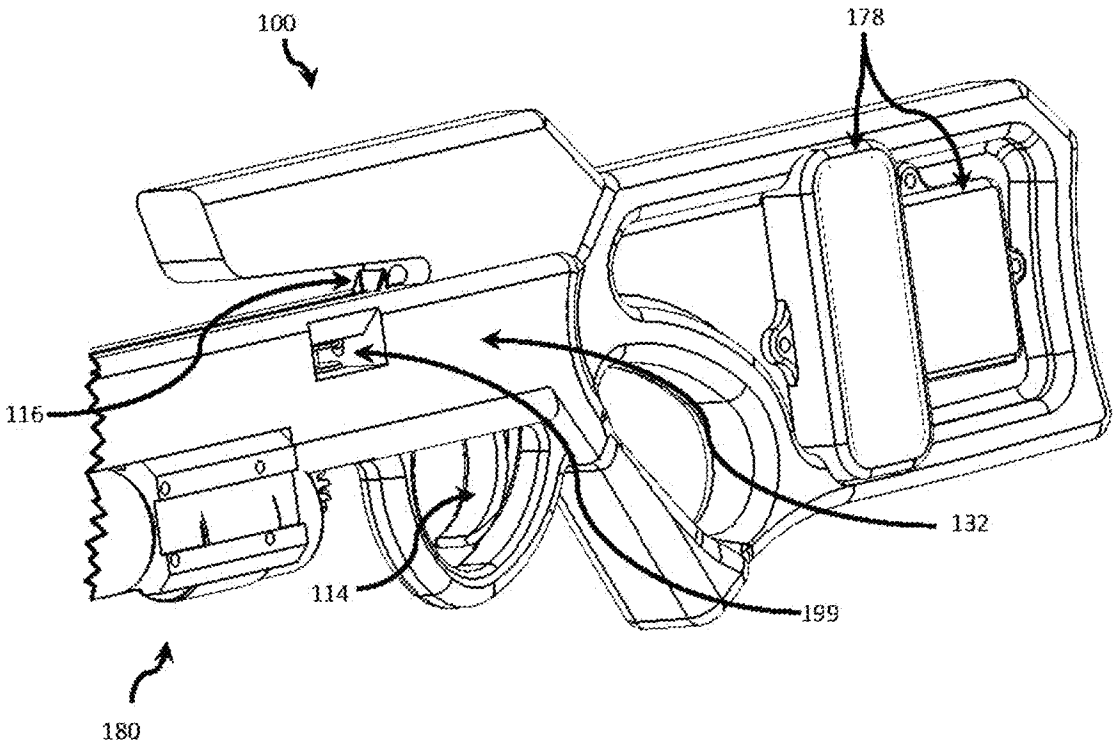
FIG. 9 is an enlarged, fragmentary, right side isometric view of the crossbow of FIG. 1, illustrating the cord holder.

As illustrated in FIG. 9, the cord holder 116, as coupled to the body 110, protrudes upward. Depending upon the embodiment, the cord holder 116 can have a hook-shaped engagement surface, or a flat engagement surface, in which case the cord holder 116 is oriented upright or rearwardly tilted at an angle. In operation, the archer uses the archer's hands to manually draw the draw cord 122 rearward until hooking the draw cord 122 onto the cord holder 116. When the archer pulls rearward on the trigger 114, the cord holder 116 moves downward to release the draw cord 122. Depending upon the embodiment, the movement of the cord holder 116 can include pivoting action, sliding action or a combination thereof.

In an embodiment, the limbs 118, 120 are mirror images of each other, having identical structure, characteristics, elements and functionality. Accordingly, each of the limbs 118, 120 includes: (a) a plurality of limb segments 144, 145 corresponding to a split-limb configuration; (b) a coupled limb end 146 configured to be coupled to the limb mount portion 134; and (c) a free or uncoupled limb end 148 that is not physically engaged with the body 110. In the embodiment shown, the limb segments 144, 145 are spaced apart from each other, and one of the rotors 119, 121 is sandwiched between the limb segments 144, 145. In an embodiment, the limb segments 144, 145 are constructed of a material having a suitable polymer, including, but not limited to, fiberglass, carbon fiber, graphite fiber and epoxy resin configured for thermosetting. The limb segments 144, 145 have an elastic characteristic so that, when deformed or flexed, the limb segments 144, 145 are predisposed to return to their original shape or original position, or substantially to their original shape or original position. Depending upon how much the limb segments 144, 145 are flexed, the limb segments 144, 145 generate variable magnitudes of spring force. In an embodiment, the limb segments 144, 145 have an elasticity or stiffness magnitude that varies along the lengths of the limb segments 144, 145. The magnitude variation can be linear or nonlinear. For example, the elasticity or stiffness between the limb center and the coupled limb end 146, can be a designated magnitude, and the elasticity or stiffness between the limb center and the uncoupled limb end 148, can be a different magnitude.

In an embedment, each of the rotors 119, 121 includes a disk or pulley defining a draw groove configured to at least partially receive the draw cord 122. A fastener, joint, pin, shaft or rotor pivot member 150 (FIG. 4) extends through the segments 144, 145 at the uncoupled limb end 148. The rotor pivot member 150 also extends through the applicable rotor 119 or 121.

In the embodiment shown, each of the rotors 119, 121 is an eccentric cam member, having one or more elliptical, asymmetric or non-circular lever portions configured to engage the draw cord 122 while engaging the supplemental cord 124. The draw cord 122 and supplemental cord 124 are spooled on the rotors 119, 121. The draw cord 122 can include a bowstring, drawstring, draw cord, string, cord, cable, or any other flexible line configured to be drawn backward by the archer. The supplemental cord 124 can include one or more supplemental cords, power cables, power cords, auxiliary cords, assistive cords, strings, cords, cables, or other flexible lines configured to pull the limbs 118, 120 together.

As shown in FIG. 4, the body 110 defines a slot or cord passageway 157 configured to receive the supplemental cord 124. In an embodiment, the supplemental cord 124 has a plurality of supplemental cord segments 152, 154 arranged to cross each other in an X-fashion. The draw cord 122 is coupled to at least one of the rotors 119, 121 at an anchor point (not shown), and the supplemental cord 124 is coupled to at least one of the rotors 119, 121 at an anchor point 156. When the draw cord 122 is drawn in the rearward direction 130, the movement of the draw cord 122 causes the rotors 119, 121 to rotate and move toward each other. Because the supplemental cord 124 is coupled to the anchor point 156 of at least one of the rotors 119, 121 (associated limbs 118, 120), the rotation of the rotors 119, 121 causes the supplemental cord 124 to be taken-up during retraction of the draw cord 122, effectively shortening the length of the supplemental cord 124 and pulling the limbs 118, 120 closer together. Pulling the limbs 118, 120 together places them in greater tension and generates more potential energy that will be used to launch the projectile 102 upon pulling of the trigger 114.

It should be appreciated that the crossbow 100 can include or exclude the supplemental cord 124. For example, in an embodiment, the crossbow 100 excludes the supplemental cord 124, and the rotors 119, 121 are circular, providing solely a rolling or wheel function for the draw cord 122.

Figure 3:
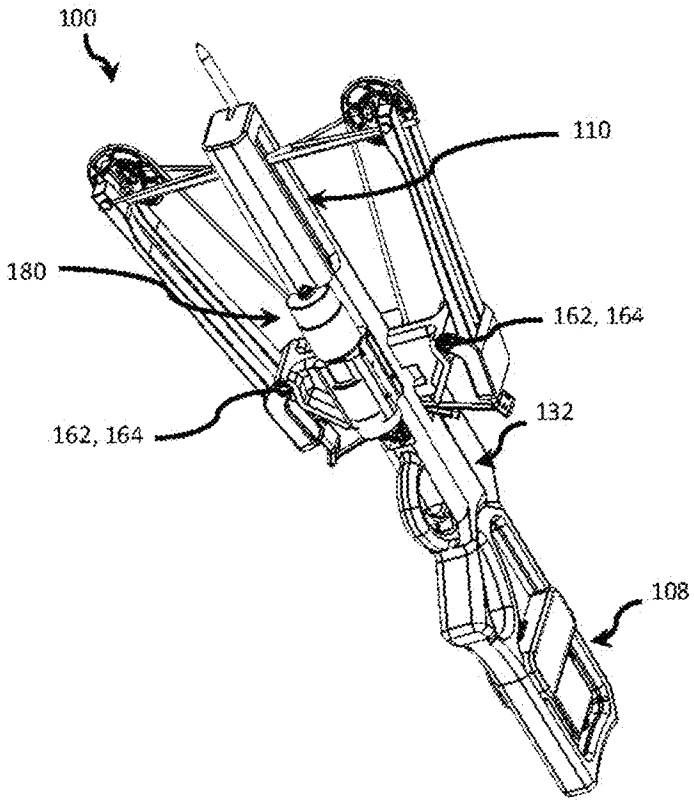
FIG. 3 is a bottom isometric view of the crossbow of FIG. 1
Figure 11:
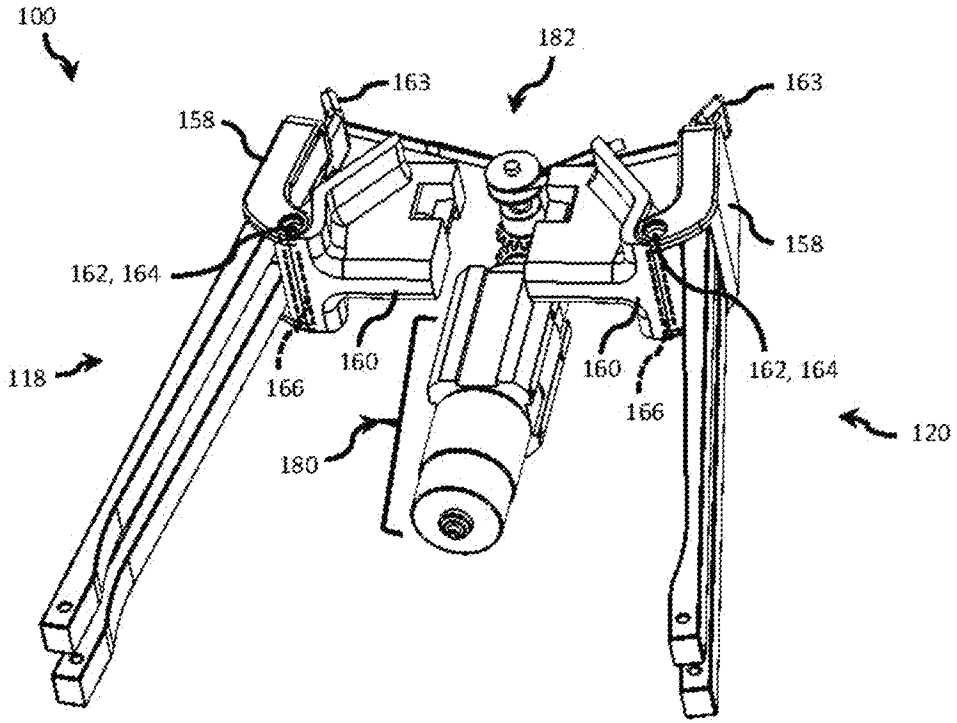
FIG. 11 is a top, front isometric view of an embodiment of the limbs and driver of the crossbow of FIG. 1.
Figure 12:
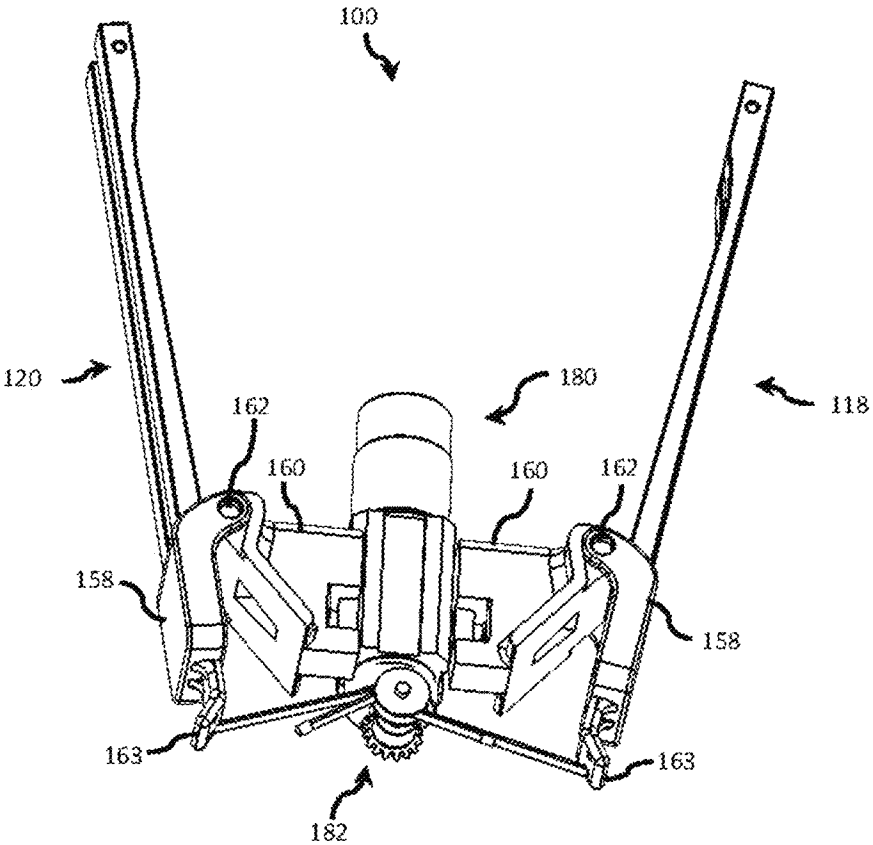
FIG. 12 is a top, rear isometric view of an embodiment of the limbs and driver of the crossbow of FIG. 1.
Figure 13:
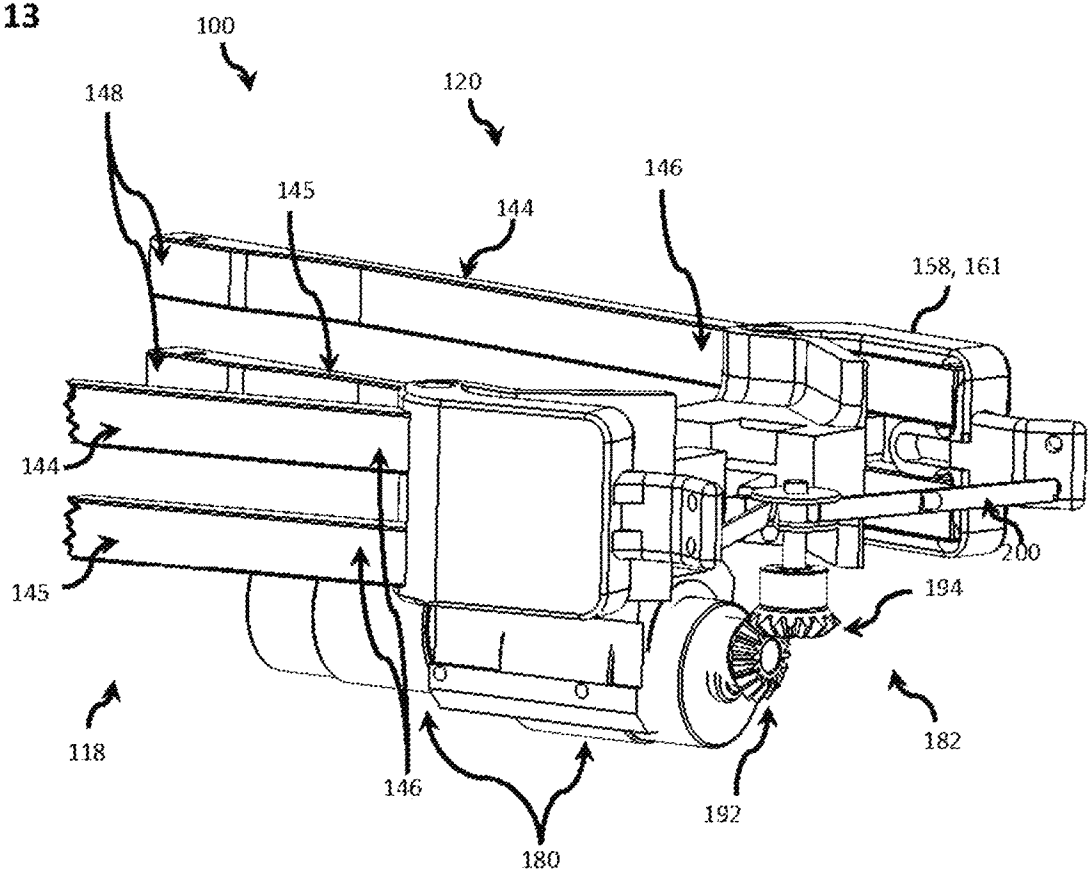
FIG. 13 is a right, side isometric view of an embodiment of the limbs and driver of the crossbow of FIG. 1.

As illustrated in FIGS. 2 and 11-12, in an embodiment, the limb coupling assemblies 123, 125 are mirror images of each other, having identical structure, characteristics, elements and functionality. Accordingly, each of the limb coupling assemblies 123, 125 includes: (a) a limb pocket, limb holder or limb retainer 158 configured to receive the coupled limb end 146, retain the coupled limb end 146 and maintain a designated distance between the limb segments 144, 145; (b) a riser, arm or limb support 160 coupled to the limb mount portion of the body 110; (c) a fastener, joint, pin, shaft or limb pivot member 162; and (d) an arm 163 extending from the limb retainer 158. As illustrated in FIGS. 3 and 11, the limb retainer 158 defines a plurality of retainer openings 164 aligned with a passageway 166 defined by the limb support 160. The limb pivot member 162 extends through the openings 164 and passageway 166 to rotatably or pivotally couple the applicable one of the limbs 118, 120 to the body 110.

In the embodiment shown, the crossbow 100 has as reverse limb configuration. In such configuration, the crossbow 100 has a fork shape. Referring to FIG. 7, a first lateral plane 168 extends through the coupled limb ends 146 of limbs 118, 120. The first lateral plane 168 intersects with the longitudinal axis 170. The second lateral plane 172 extends through the uncoupled limb ends 148 of the limbs 118, 120. The second lateral plane 172 intersects with the longitudinal axis 170. In this configuration, the second lateral plane 172 is positioned forward of the first lateral plane 168. As illustrated in FIGS. 7-8, the uncoupled limb ends 148 are relatively close to the vertical plane 174, which extends along the body axis 176. This configuration enables the crossbow 100 to have a relatively narrow and compact form.

Referring to FIGS. 10-16, in an embodiment, the energizer 126 includes: (a) an electrical power source 178 that is coupled to the stock 108 or is received and fully housed by the stock 108; (b) a motion generator 180 operatively coupled to, and powered by, the electrical power source 178; (c) a drive mechanism or driver 182 that is operatively coupled to the motion generator 180; and (d) an input device 184 (FIG. 6) operatively coupled to the motion generator 180. As described below, the energizer 126 is operable to generate a driving force that is applicable to the limbs 118, 120.

In an embodiment, the electrical power source 178 is a rechargeable battery unit having a charging port (not shown). The battery unit can include one or more batteries. The crossbow 100 includes a charging cord (not shown). The archer can connect one end of the charging cord to an electrical outlet and removeably connect the other end to the charging port to recharge the battery unit. Depending upon the embodiment, stock 108 can include one or more moveable access panels or doors that enable the archer to access the electrical power source 178 and remove the electrical power source 178 for periodic charging sessions. In another embodiment, not shown, the crossbow 100 includes a pneumatic or hydraulic energy source instead of the electrical power source 178.

Figure 15:
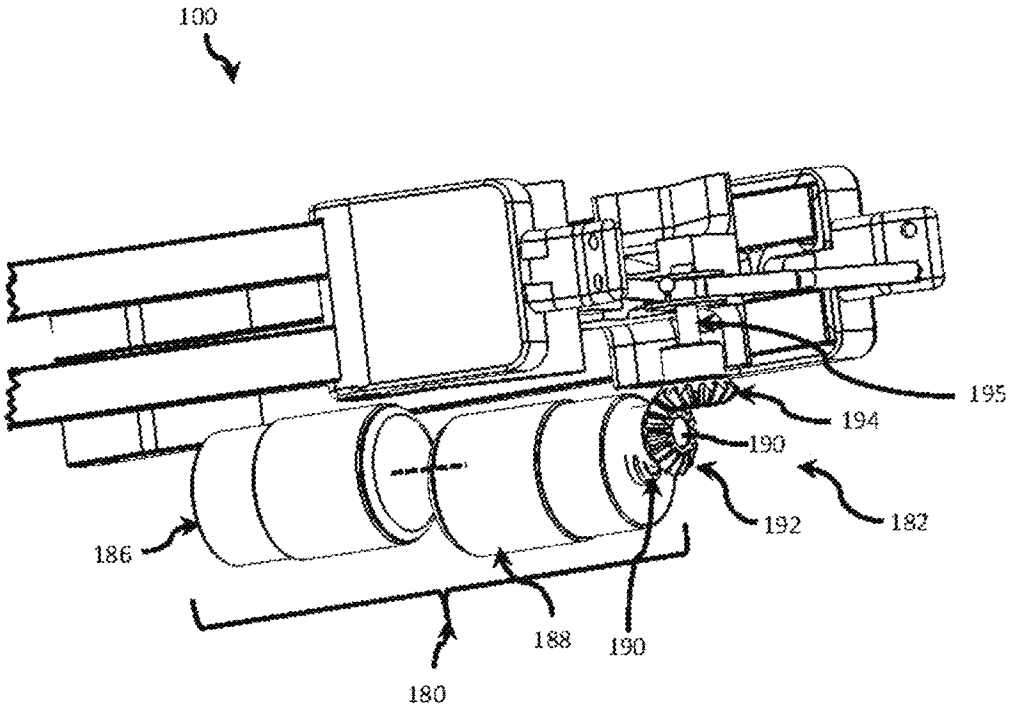
FIG. 15 is a right, rear isometric view of an embodiment of the limbs and driver of the crossbow of FIG. 1, illustrating the motors.
Figure 16:
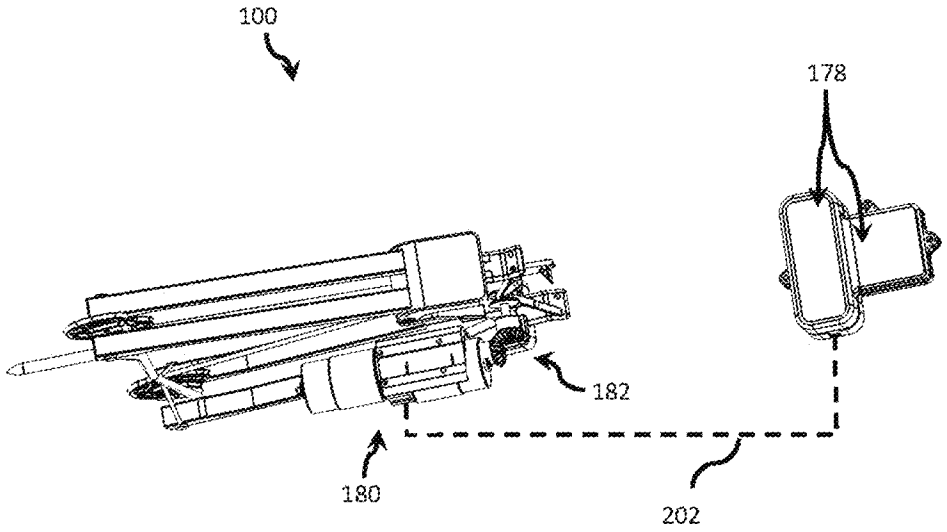
FIG. 16 is a right, side isometric view of an embodiment of the limbs and energizer of the crossbow of FIG. 1 with the body and stock removed.

The motion generator 180 includes one or more motors 186, 188, as illustrated in FIG. 15. In the embodiment shown, the motor 188 includes an output shaft 190 that rotates at a constant or variable rate. Depending upon the embodiment, the motion generator 180 can include a solenoid, electromagnetic device or any other apparatus or electromechanical device configured to generate motion based on electricity supplied by the electrical power source 178.

Figure 14:
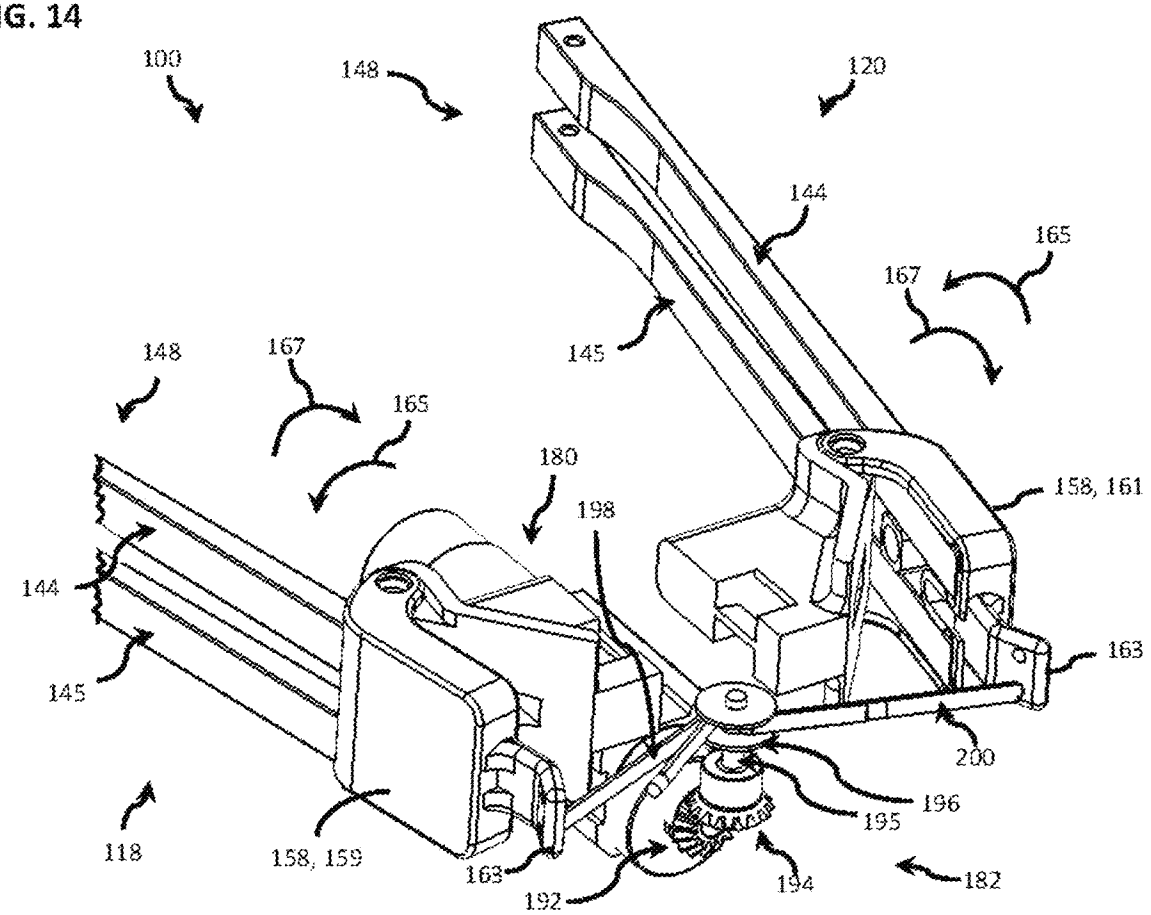
FIG. 14 is a right, rear isometric view of an embodiment of the limbs and driver of the crossbow of FIG. 1.

As illustrated in FIG. 14, in an embodiment, the driver 182 includes: (a) a vertical bevel gear 192 fixedly connected to the output shaft 190; (b) a horizontal bevel gear 194 mated and engaged with the vertical bevel gear 192; (c) a gear shaft 195 extending upward from the horizontal gear 194; (d) a rotor, pulley, spindle or spool 196 coupled to the gear shaft 195; (e) a first drive cord 198 spooled around the spool 196 and fixedly connected to the arm 163 associated with the limb 118; and (f) a second drive cord 200 spooled around the spool 196 and fixedly connected to the arm 163 associated with the limb 120.

Although bevel gears 192, 194 are included within the driver 182, it should be appreciated that the driver 182 can include any suitable gear or combination of gears, links, springs, fasteners and other components, including, but not limited to: (a) gears within the classes, involute gears, cycloidal gears, trochoidal gears, parallel shaft gears, intersecting shaft gears, and non-parallel and non-intersecting shaft gears; (b) spur gears, helical gears, bevel gears, worm gears, gear rack and other gears; (c) cams, followers, links, biasing members and springs; and (d) pulleys, idler wheels, spindles, guides, tracks, slots and grooves.

Figure 10:
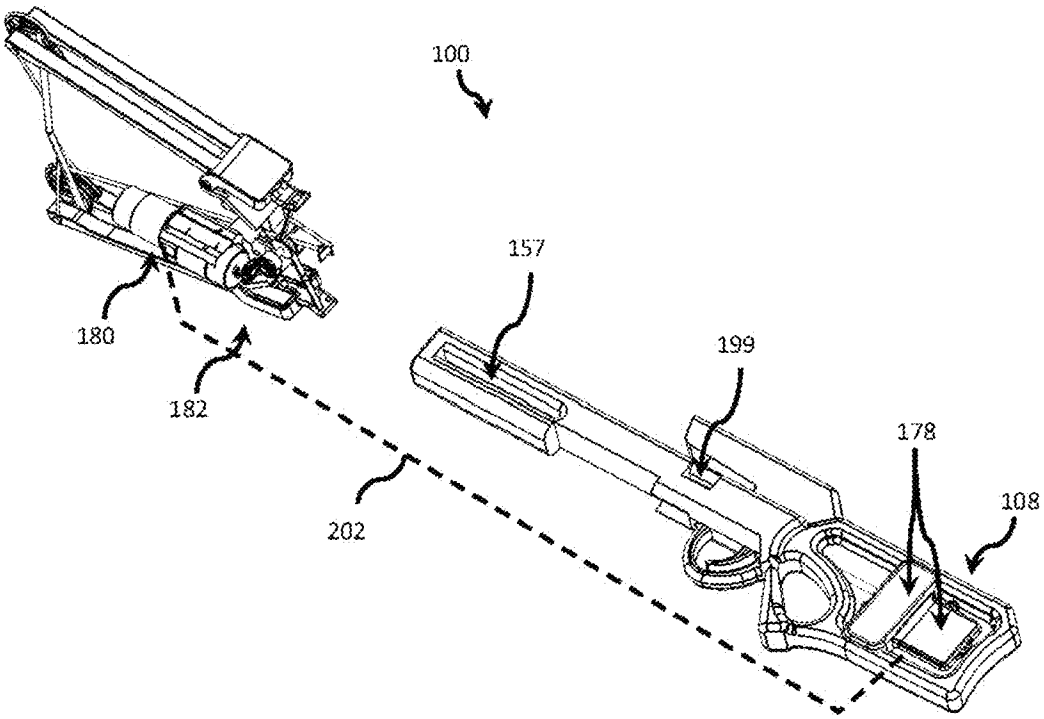
FIG. 10 is an exploded, right side isometric view of the crossbow of FIG. 1.

As shown in FIGS. 8-10, the body 110 defines a slot or cord passageway 199 configured to receive the first and second drive cords 198, 200. In the embodiment shown, each of the first and second drive cords 198, 200 includes a flexible band or belt constructed of KEVLAR®, a commercially-available material, or any other suitable material. In other embodiments, each of the first and second drive cords 198, 200 can include a wire, cable, string, band or other flexible line configured to pull the arms 163 associated with the limbs 118, 120, respectively.

Referring to FIG. 6, the input device 184, in an embodiment, includes a grasp, button, switch or knob or other actuator moveably coupled to the stock 108. One or more electrical wires or electrical cables 202 electronically couple the electrical power source 178 to: (a) the motion generator 180; and (b) the input device 184 to the motion generator 180, the electrical power source 178 or a combination thereof. By rotating, pressing or otherwise manipulating the input device 184, the archer can activate the energize mode of the motion generator 180 or activate the de-energize mode of the motion generator 180.

As illustrated in FIG. 14, in the energize mode, the motion generator 180 generates a driving force. Such driving force rotates the spool 196 so as to wrap the first and second drive cords 198, 200 around the spool 196. This causes the arms 163 associated with the limbs 118, 120 to move toward the body 110. In turn, this causes the limb retainers 158 associated with limbs 118, 120 to pivot relative to the body 110. For example, the limb retainer 159 pivots counterclockwise 165, and the limb retainer 161 pivots clockwise 167. As a result, the limbs 118, 120 pivot so that the uncoupled limb ends 148 of the limbs 118, 120 move away from each other and away from the vertical plane 174 (FIG. 8). As described below, eventually the limbs 118, 120 flex and bend, which generates and increases the spring forces in the limbs 118, 120.

In the de-energize mode, the motion generator 180 rotates the spool 196 in the opposite direction to unspool the first and second drive cords 198, 200 from the spool 196. This causes the arms 163 associated with the limbs 118, 120 to move away from the body 110. For example, the limb retainer 159 pivots clockwise 167, and the limb retainer 161 pivots counterclockwise 165, as shown in FIG. 14. As a result, the limbs 118, 120 pivot so that the uncoupled limb ends 148 of the limbs 118, 12 move toward each other and toward the vertical plane 174 (FIG. 8). As described below, eventually the limbs 118, 120 bend back to their original shapes or substantially to their original shapes.

Referring to FIG. 14, in an embodiment, the driver 182 of the energizer 126 is modified to include: (a) a first set of idler wheels to guide the first drive cord 198 to the limb retainer 159; and (b) a second set of idler wheels to guide the second drive cord 200 to the limb retainer 161. Each such set of idler wheels includes a lower idler wheel and a higher idler wheel. The lower idler wheel directs a first segment of the applicable cord at a relatively low position to avoid interference with the track 112 (FIG. 8) and the cord passageway 199 (FIG. 8). The upper idler wheel directs a second segment of the same applicable cord to a relatively high position where the end of the second segment is connected to a vertically-centered point on the applicable arm 163. In this embodiment, the applicable cord is twisted because each idler wheel rotates about an axis that is transverse to the axis about which the spool 196 rotates. In an embodiment, this vertically-centered point on the applicable arm 163 is located midway between the limb segments 144, 145. This centralized position reduces asymmetrical loads on the limbs 118, 120 and stress on the limbs 118, 120. The idler wheels accomplish this advantage while avoiding interference with the track 112 (FIG. 8) and the cord passageway 199 (FIG. 8).

In an embodiment, the energizer 126 includes circuitry or a circuit board, not shown. The circuit board includes: (a) a processor, such as a central processing unit; and (b) a memory device operatively coupled to the processor that stores machine-readable instructions to direct the operation of the motion generator 180, the electrical power source 178 or a combination thereof. In an embodiment, the crossbow 100 includes one or more output devices operatively coupled to the processor. Depending upon the embodiment, the output devices can include light sources, such as Light Emitting Diodes (LEDs), liquid crystal display (LCD) devices, touchscreens, audio output devices, speakers, sound generators, radio frequency (RF) antennas and RF transceivers. In an embodiment, the RF transceiver is configured to generate magnetic fields or RF signals according to the Bluetooth® protocol or any suitable short range communication protocol, which, for example, can include the generation of RF signals suitable to communicate with smartphones, cell phones, other handheld devices, and computers. The outputs from the output devices can provide archers with helpful information regarding the control, operation and status of the energizer 126.

In an embodiment, the processor is operable with a sensor to detect and receive verbal commands from the archer for controlling the energizer 126. In another embodiment, the processor is programmed to automatically reset the motion generator 180 after each firing of the crossbow 100. For example, the energizer 126 can includes a sensor operatively coupled to the processor and the trigger 114. Such sensor can detect when the trigger 114 has been pulled or otherwise when the projectile 102 has exited the crossbow 100. When this event occurs, the processor causes the motion generator 180 to rotate the output shaft 190 in a direction opposite of the direction of rotation during the energize mode. Consequently, the motion generator 180 automatically pivots the limbs 118, 120 toward the vertical plane 174 until the limbs 118, 120 are no longer bent or flexed, or are otherwise until the limbs 118, 120 generate little, if any, tension on the draw cord 122.

In another embodiment, the processor is programmed to receive a de-energize signal from the input device 184. For example, after energizing the crossbow 100, the archer may decide not to shoot, wishing to remove the projectile 102. In such case, the archer can manipulate the input device 184 to generate the de-energize signal. In response, the processor automatically causes the motion generator 180 to rotate the output shaft 190 in a direction opposite of the direction of rotation during the energize mode. Consequently, the motion generator 180 automatically pivots the limbs 118, 120 toward the vertical plane 174 until the limbs 118, 120 are no longer bent or flexed, or are otherwise until the limbs 118, 120 generate little, if any, tension on the draw cord 122. At this point, the archer may safely unload the projectile 102.

Figure 17:
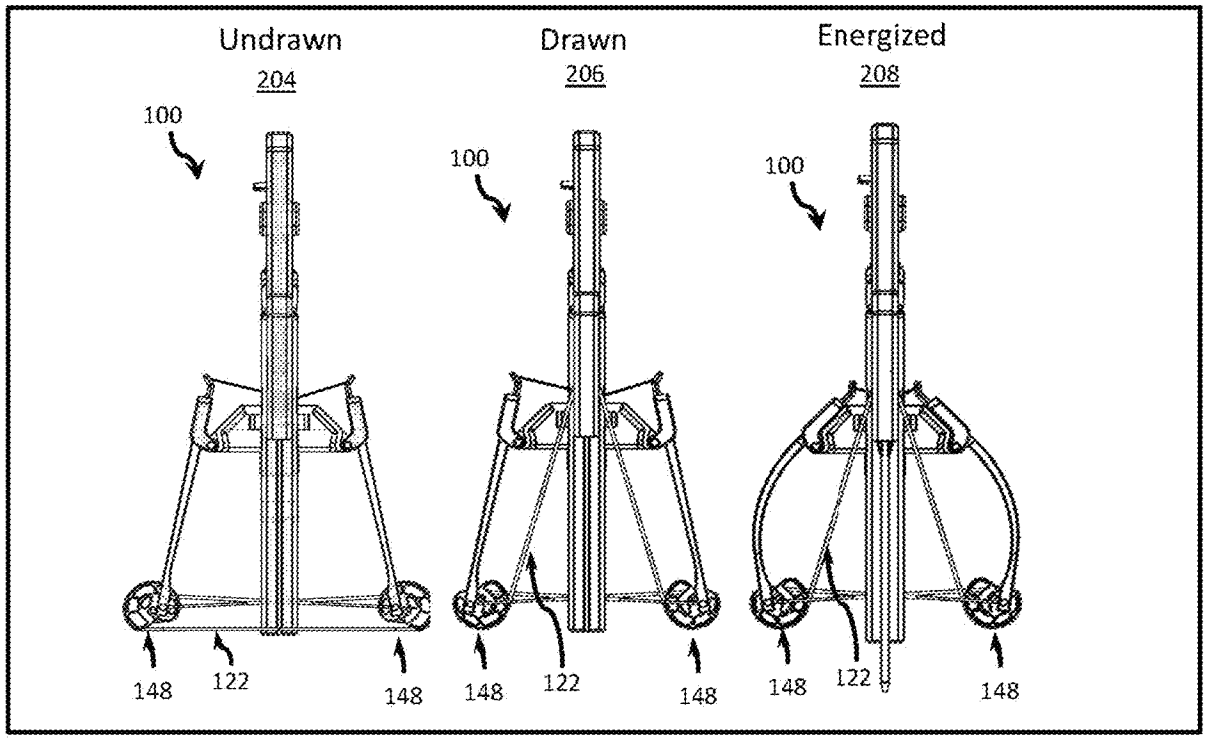
FIG. 17 is a diagram showing top plan views of the crossbow of FIG. 1, illustrating examples of the undrawn, the drawn and the energized conditions.

Referring to FIG. 17, in an embodiment, the crossbow 100 is changeable from an undrawn condition 204, then to a drawn condition 206 and then to an energized condition 208. Likewise, the crossbow 100 is changeable from the energized condition 208, then to the drawn condition 206, and then to the undrawn condition 204.

In the undrawn condition 204, the draw cord 122 extends in a substantially straight line between the uncoupled limb ends 148 of the limbs 118, 120. In the undrawn condition 204, the draw cord 122 is under relatively little, if any, tension. As a result, the limbs 118, 120 are subject to little, if any, bending or deformation.

To advance to the drawn condition 206, the archer can grasp the draw cord 122 with the archer's hand and, with relative ease, can pull the draw cord 122 rearward and hook the draw cord 122 onto the cord holder 116 (FIG. 9). At this point, the draw cord 122 has a V-shape, as shown. In the drawn condition 206, the draw cord 122 is under relatively little, if any, tension, similar to the undrawn condition 204. As a result, the limbs 118, 120 are subject to little, if any, bending or deformation. Depending upon the embodiment, the archer can accomplish the drawn condition 206 with ease by exerting a force corresponding to a draw weight of less than twenty pounds, less than ten pounds, less than five pounds, less than one pound, or less than one-half of a pound. Also, with little or no resistance from the limbs 118, 120, the archer can quickly accomplish the drawn condition 206, for example, in less than five seconds, in less than two seconds or in less than one second.

To advance to the energized condition 208, the archer manipulates the input device 184. In response, the motion generator 180 automatically transforms the crossbow 100 to the energized condition 208. At this point, the draw cord 122 maintains a V-shape, as shown. In the energized condition 208, the draw cord 122 is under substantial tension. For example, the draw cord 122 can be under a fire-ready draw weight of over one hundred fifty pounds, over two hundred pounds or over three hundred pounds. As a result, the limbs 118, 120 are bent and deformed. In the energized condition 208, each of the limbs 118, 120 can have an arc shape, a wavy shape, a plurality of arc-shaped sections having different radii, or any other suitable shape. Once the energized condition 208 is achieved, the archer can aim and pull the trigger 114. In response, the draw cord 122 will propel the projectile 102 to the target 106.

Figure 18:
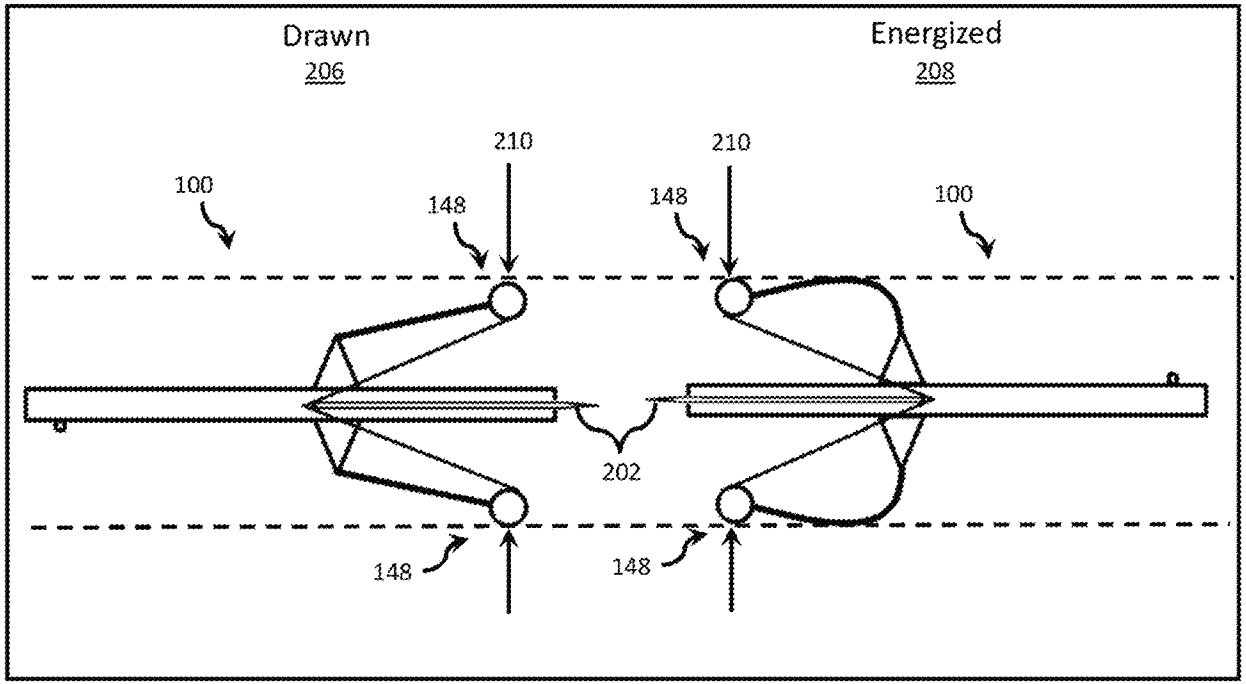
FIG. 18 is a diagram showing top plan views of the crossbow of FIG. 1, illustrating examples of the drawn and the energized conditions in which the limb end separation distance is the same in such conditions.

The limbs 118, 120 in the energized condition 208 have a total or cumulative spring force that is sufficient in magnitude to propel the projectile 102 to the target 106. In an embodiment shown in FIG. 18, projectile 102 travels to the target 106 at a high speed without depending upon an increase in the distance between the uncoupled limb ends 148 of the limbs 118, 120 during the transition from the drawn condition 206 to the energized condition 208. For example, in the drawn condition 206, there is a distance 210 between the uncoupled limb ends 148 of the limbs 118, 120. In the energized condition 206, there is the same (or substantially the same) distance 210 between the uncoupled limb ends 148 of the limbs 118, 120. This provides the advantage and improvement of achieving fire-ready draw weight without expanding the size and wingspan of the crossbow 100.

Figure 19:
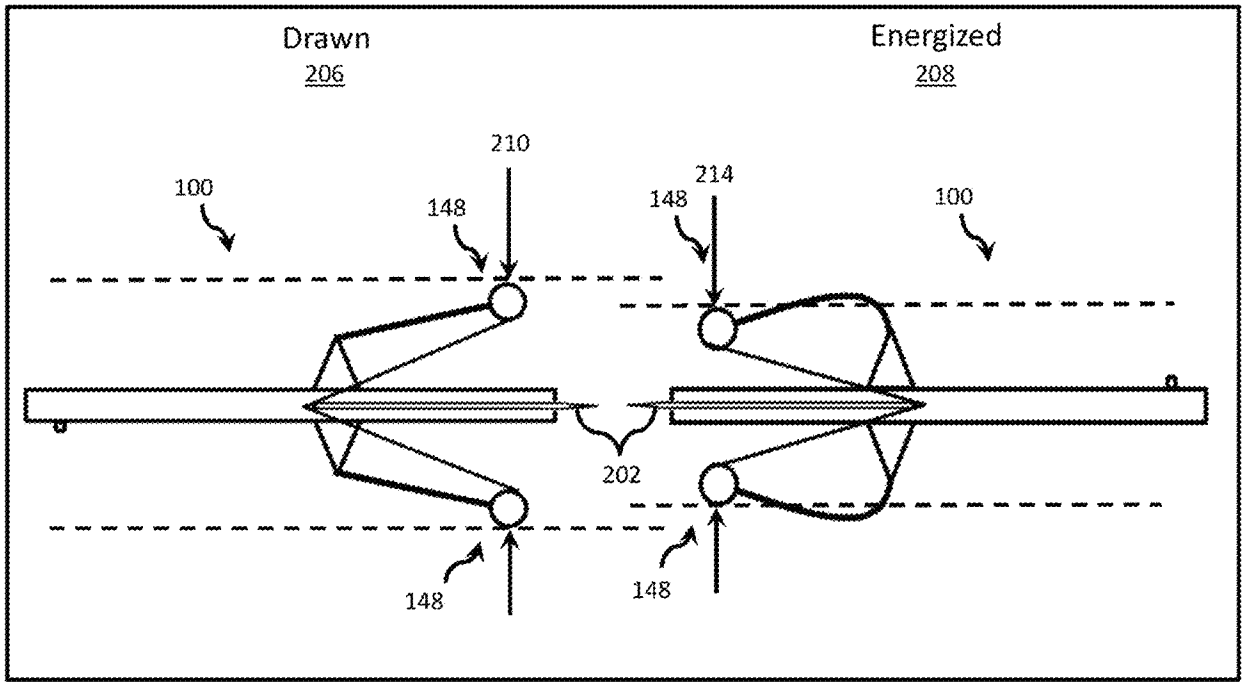
FIG. 19 is a diagram showing top plan views of the crossbow of FIG. 1, illustrating an example of the drawn and the energized conditions in which the limb end separation distance in the energized condition is less than the limb end separation distance in the drawn condition.

In an embodiment shown in FIG. 19, projectile 102 travels to the target 106 at a high speed without depending upon an increase in the distance between the uncoupled limb ends 148 of the limbs 118, 120 during the transition from the drawn condition 206 to the energized condition 208. For example, in the drawn condition 206, there is the distance 210 between the uncoupled limb ends 148 of the limbs 118, 120. In the energized condition 206, there is a smaller distance 214 between the uncoupled limb ends 148 of the limbs 118, 120. This provides the advantage and improvement of achieving fire-ready draw weight while, at the same time, decreasing the size and wingspan of the crossbow 100.

Figure 20:
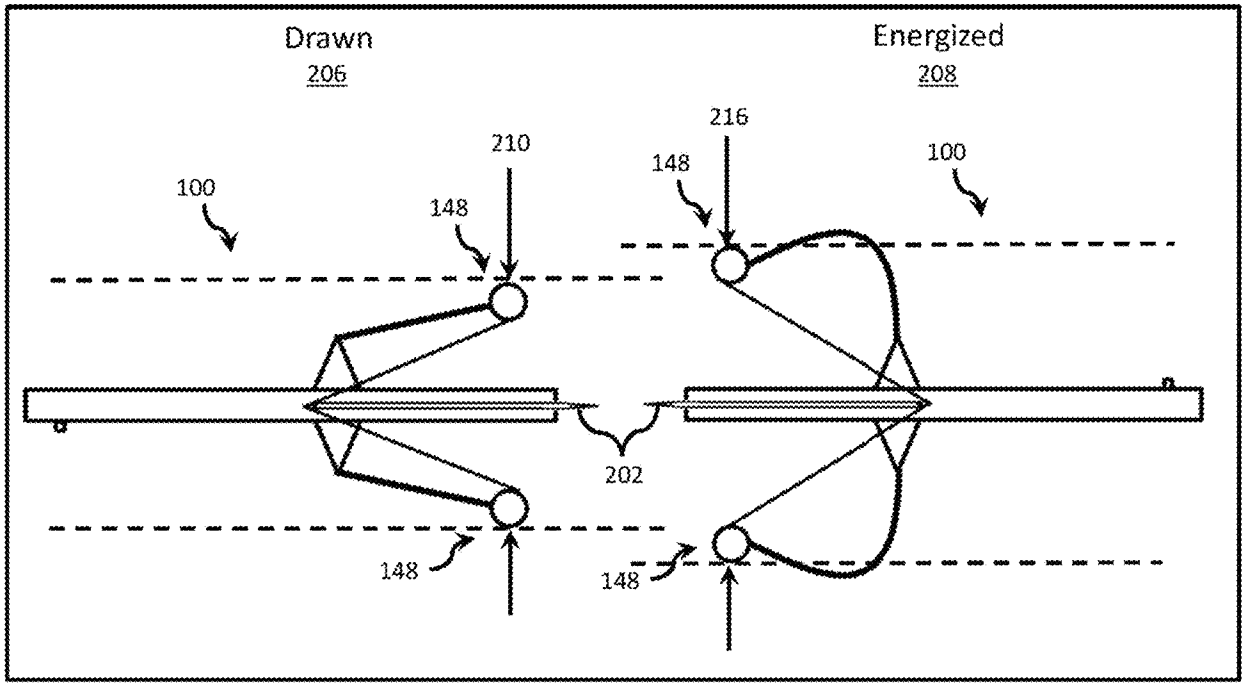
FIG. 20 is a diagram showing top plan views of the crossbow of FIG. 1, illustrating an example of the drawn and the energized conditions in which the limb end separation distance in the energized condition is greater than the limb end separation distance in the drawn condition.
Figure 21:
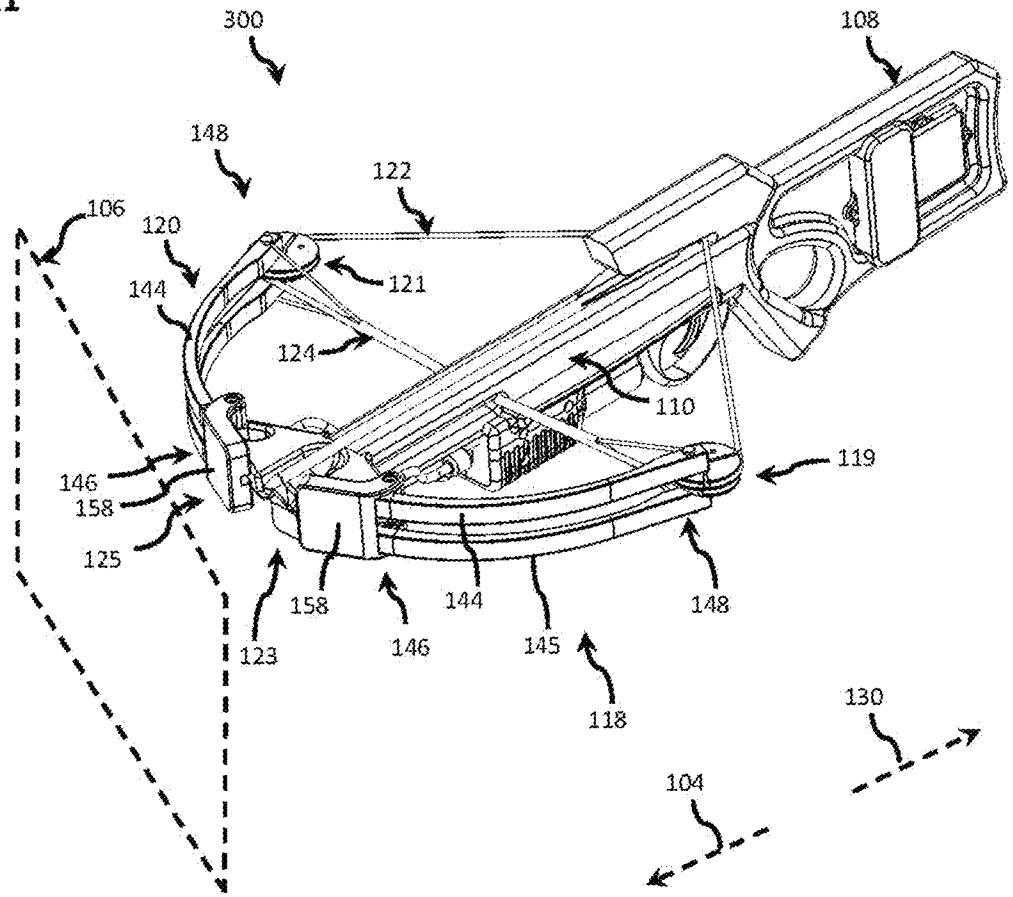
FIG. 21 is a front isometric view of another embodiment of the crossbow.

In an embodiment shown in FIG. 20, projectile 102 travels to the target 106 at a high speed depending, in part, upon a relatively small increase in the distance between the uncoupled limb ends 148 of the limbs 118, 120 during the transition from the drawn condition 206 to the energized condition 208. For example, in the drawn condition 206, there is the distance 210 between the uncoupled limb ends 148 of the limbs 118, 120. In the energized condition 206, there is a greater distance 216 between the uncoupled limb ends 148 of the limbs 118, 120. Depending upon the embodiment, distance 216 can be less than ten percent over the distance 210, less than five percent over the distance 210 or less than one percent over the distance 210. This relatively small increase provides the advantage and improvement of achieving fire-ready draw weight without significantly or substantially increasing the size and wingspan of the crossbow 100.

It should be appreciated that the distance between the uncoupled limb ends 148 of the limbs 118, 120, comparing the drawn condition 206 to the energized condition 208, can be the same or can vary depending upon the embodiment. The following provides examples:

TABLE I

| Distance Between Uncoupled Limb Ends in Drawn Condition | Distance Between Uncoupled Limb Ends in Energized Condition | Percentage Difference |
|---|---|---|
| A | A | 0% |
| B | C | Less than 1% |
| D | E | Less than 5% |
| F | G | Less than 10% |
| H | I | Less than 20% |

In an embodiment, the crossbow 100 includes a drawing device (not shown) moveably coupled to the body 110. The drawing device includes a carriage, catch or hook configured to slide or otherwise travel along the body 110 or track 112. The drawing device also includes a motion generator operatively coupled to, and powered by, the electrical power source 178. The motion generator is operatively coupled to the hook through a band, belt, cord or other suitable driver. The motion generator is operable to move the hook in the forward direction 104 and then in rearward direction 130. In operation, the archer prepares the crossbow 100 in the undrawn condition 204. Next, the archer presses, rotates or otherwise manipulates the input device 184 to generate a start signal. In response, the following steps occur automatically: (a) the hook of the drawing device moves forward, catches the draw cord 122, pulls the draw cord 122 rearward, and hooks the draw cord 122 onto the cord holder 116, transitioning the crossbow 100 from the undrawn condition 204 to the drawn condition 206; and (b) the motion generator 180 activates the energize mode and transitions the crossbow 100 to the energized condition 208. At this point, the archer can aim and pull the trigger 144 to launch the projectile 102.

Figure 22:
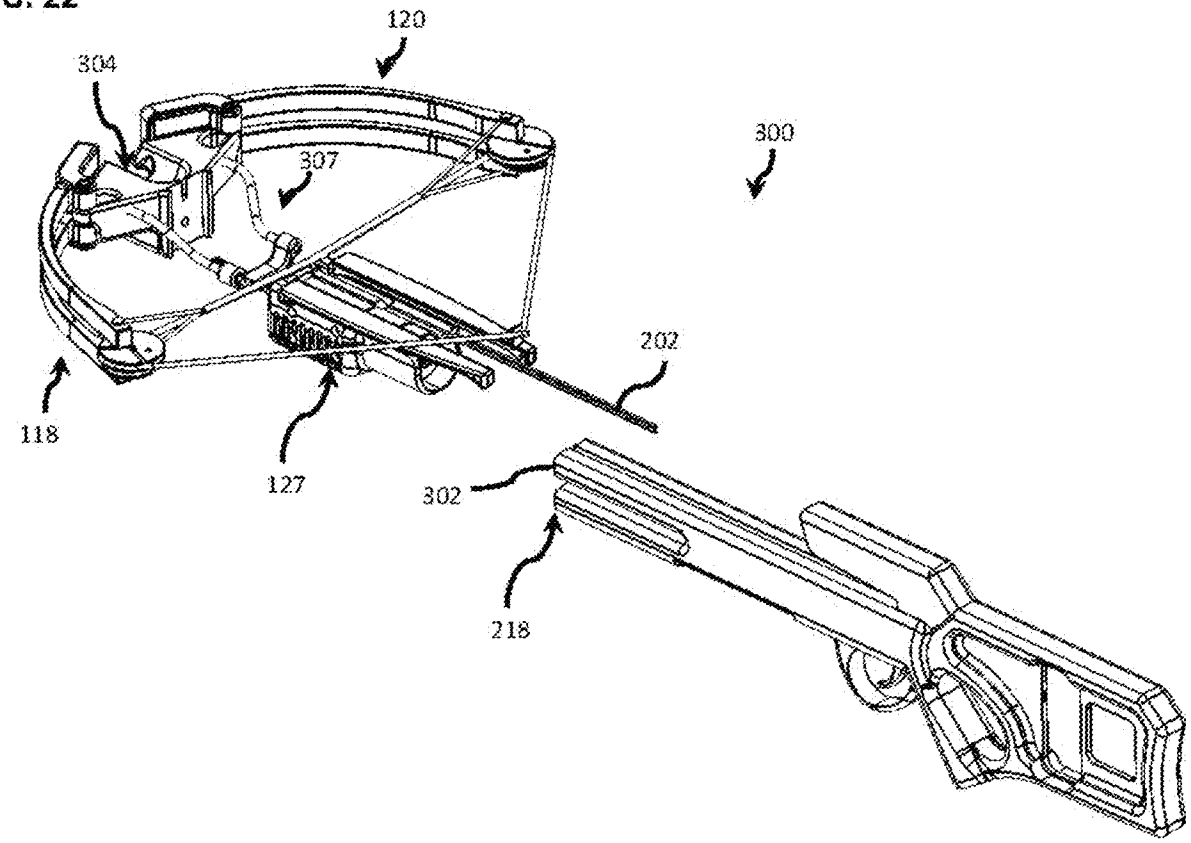
FIG. 22 is a rear, right side isometric view of the crossbow of FIG. 21.

In another embodiment illustrated in FIGS. 21-25, the crossbow 300 has all of the structure, components, elements, functionality and characteristics as the crossbow 100 except that: (a) the limbs 118, 120 are oriented so that the uncoupled limb ends 148 are positioned rearward of the coupled limb ends 146 as opposed to the fork configuration of crossbow 100; (b) the limb mount portion 134 is replaced with limb mount portion 302, as shown in FIG. 22; (c) the multiple limb supports 160 are replaced with a single limb support 304, as shown in FIG. 22; (d) the driver 182 is replaced with the driver 307; and (e) the crossbow 300 includes a multipart housing or case 331 configured to house the motion generator 180.

Figure 23:
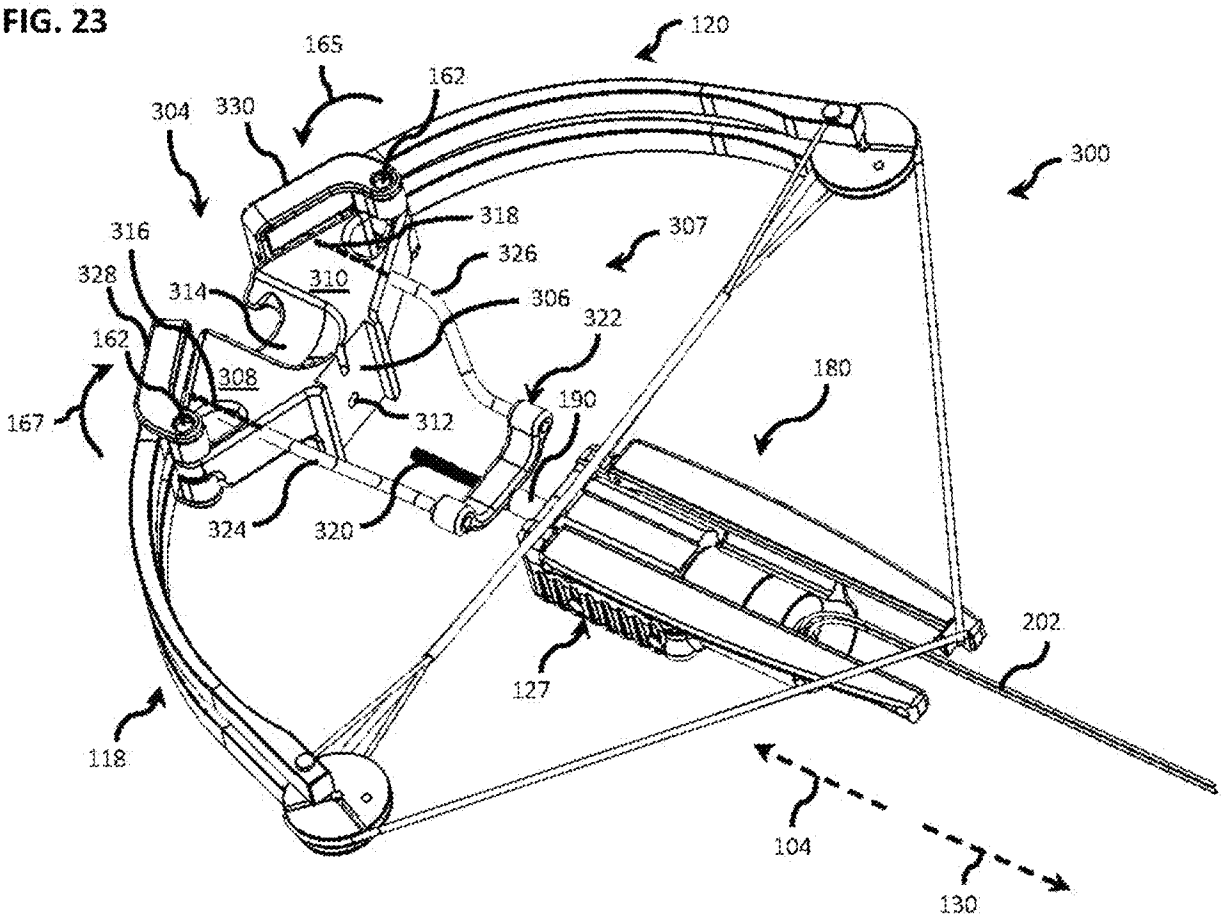
FIG. 23 is a top isometric view of the limbs and driver of the crossbow of FIG. 21.

As illustrated in FIG. 22, the limb mount portion 302 is positioned forward of the foregrip 127, and the limb mount portion 302 is located at or adjacent to the body forward end 218. Referring to FIG. 23, the limb support 304 includes: (a) a body interface 306 configured to engage the body forward end 218; and (b) a plurality of halves 308, 310, each of which defines a passageway configured to receive a limb pivot member 162. The body interface 306 defines a fastener passageway 312 configured to receive a screw, bolt or other fastener to secure the limb support 304 to the body forward end 218. Also, the limb support 304 defines a concave-shaped recess 314 configured to enable the fletching of the projectile to exit the crossbow 300 without interference. Furthermore, the limb support 304 defines a plurality of drive passageways 316, 318.

The driver 307 includes: (a) a threaded rod or ball screw 320 fixedly coupled to the output shaft 190; (b) a carriage or follower 322 defining a passageway having internal threads configured to receive, mate with, and engage, the ball screw 320; and (c) a plurality of rigid extensions or rigid arms 324, 326 extending from the follower 322 to the limb retainers 158 associated with limbs 118, 120, respectively. In the embodiment shown, the rigid arm 324 extends through the drive passageway 316, passes entirely through the halve 308, and is fixedly connected to the limb retainer 328. Likewise, the rigid arm 326 extends through the drive passageway 318, passes entirely through the halve 310, and is fixedly connected to the limb retainer 330.

In operation, as illustrated in FIG. 23, the archer manipulates the input device 184, which activates the motion generator 180 and initiates the energize mode. The activated motion generator 180 rotates the ball screw 320 in a direction that causes the follower 322 to travel in the rearward direction 130. The rearward travel of the follower 322 causes the arms 324, 326 to pull rearwardly on the limb retainers 328, 330, respectively. In this action, the limb retainer 328 pivots clockwise 167, and the limb retainer 330 pivots counterclockwise 165. As shown, this pivoting action causes the limbs 118, 120 to deform and bend, generating a collective spring force in the limbs 118, 120. After or before firing, the crossbow 300 can transition to the de-energize mode as described above.

Figure 24:
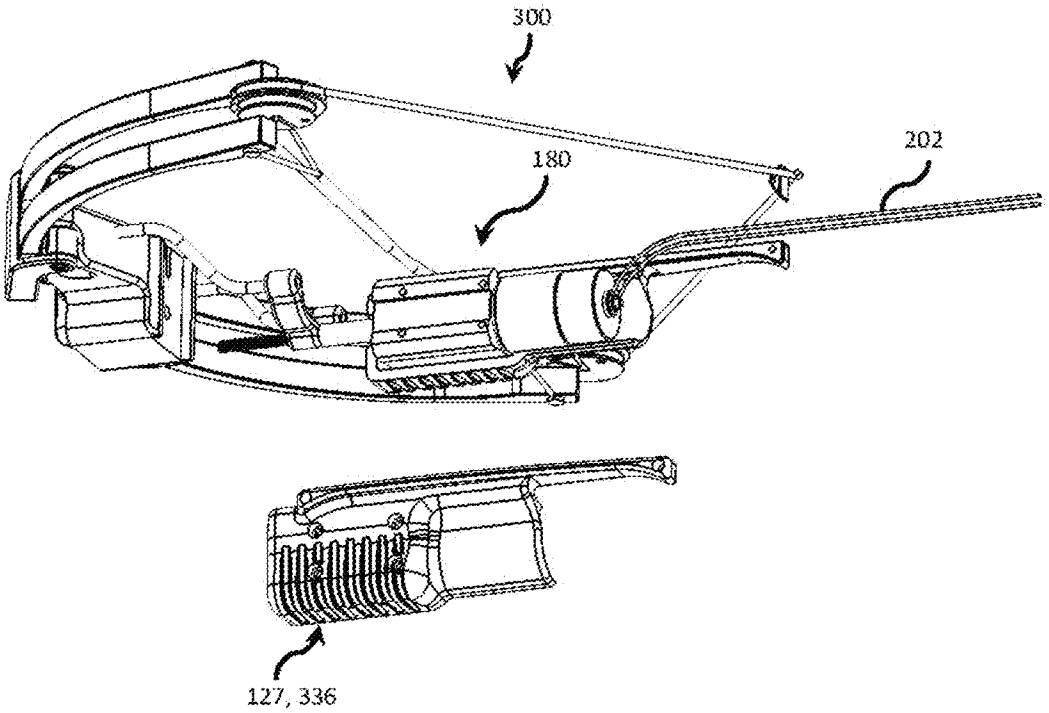
FIG. 24 is a bottom isometric view of the limbs and driver of the crossbow of FIG. 21, illustrating the decoupling of one of the case portions of the motion generator.
Figure 25:
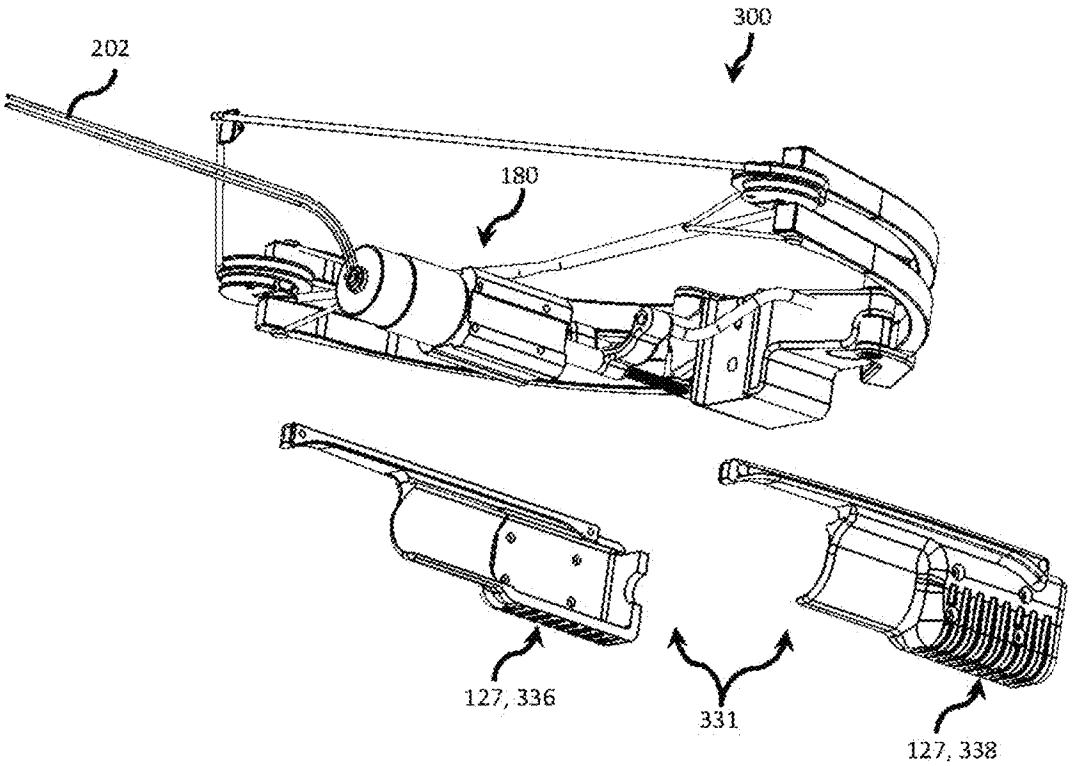
FIG. 25 is a bottom isometric view of the limbs and driver of the crossbow of FIG. 21, illustrating the decoupling of a plurality of the case portions of the motion generator.

In this embodiment, the exterior of the case 331 includes the foregrip 127, as illustrated in FIGS. 24-25. The case 331 includes a plurality of case portions 336, 338. Screws, bolts or other suitable fasteners are usable to reversibly connect the case portions 336, 338 together to encase the motion generator 180. The case 331 shields and seals the motion generator 180, safeguarding against liquid, rain and other environmental elements.

Figure 26:
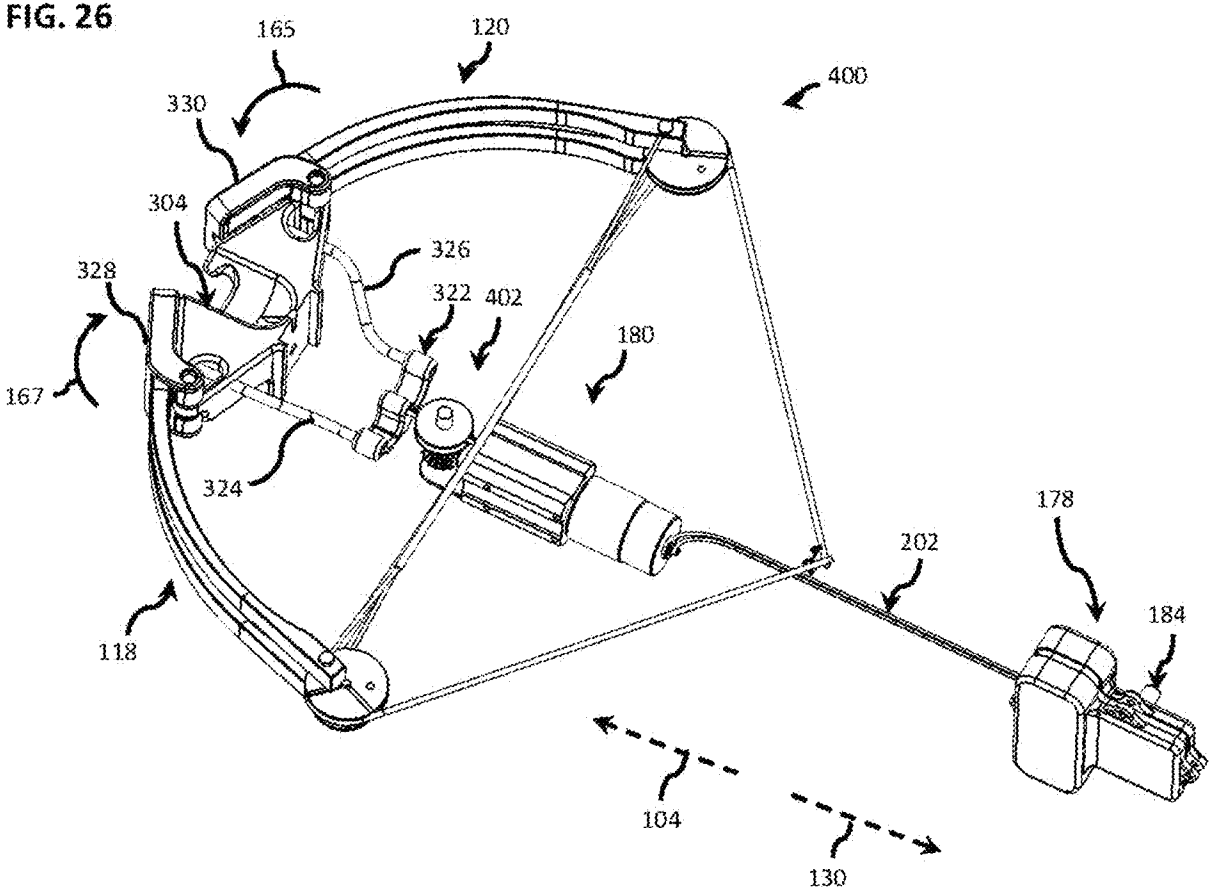
FIG. 26 is a top isometric view of yet another embodiment of the crossbow with the body and stock removed.
Figure 27:
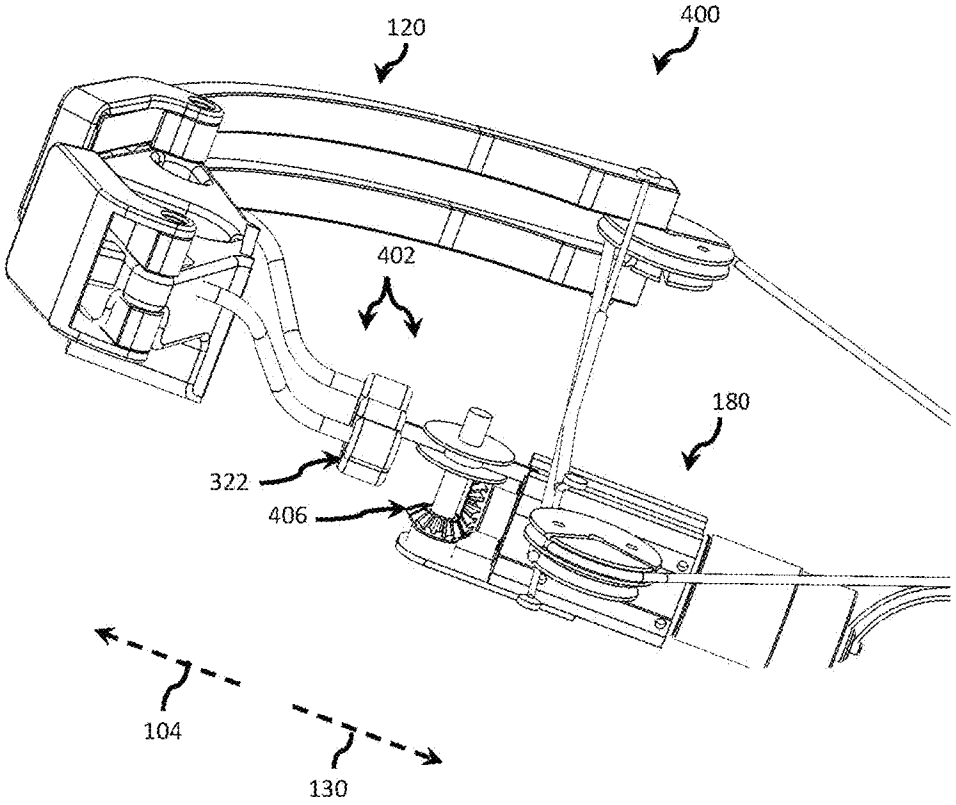
FIG. 27 is a right side isometric view of the limbs, driver and motion generator of the crossbow of FIG. 26.
Figure 28:
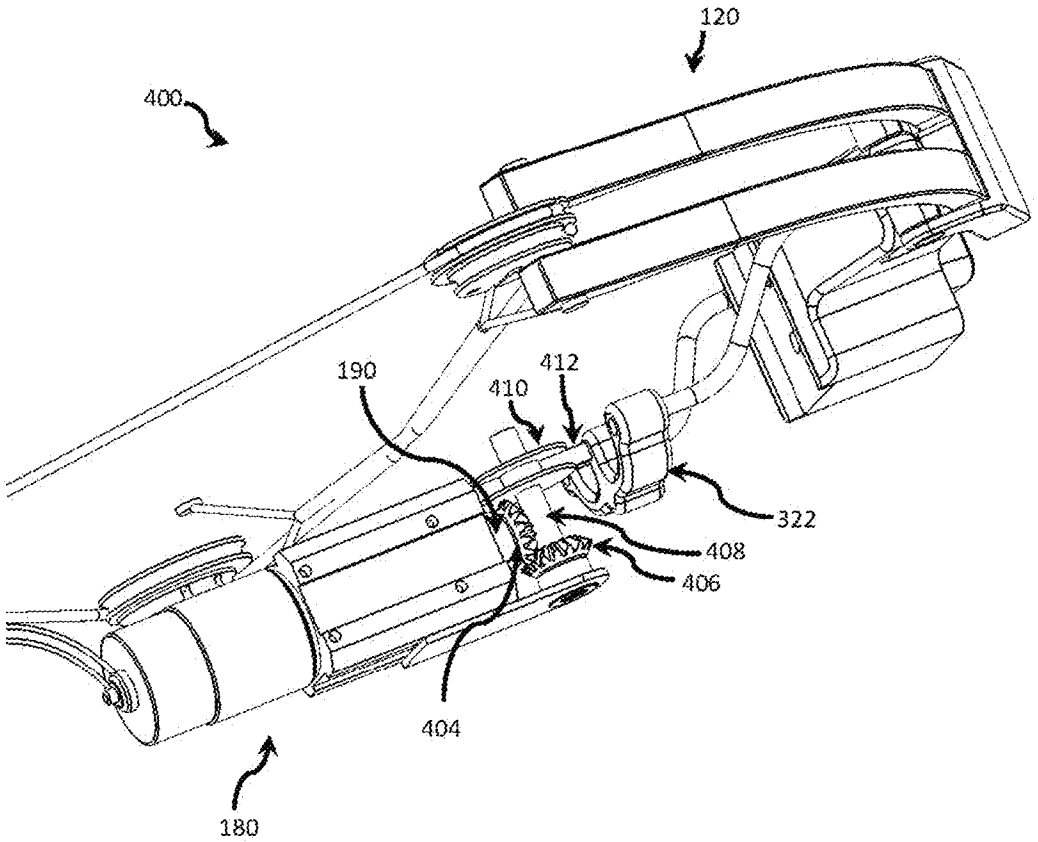
FIG. 28 is a left side isometric view of the limbs, driver and motion generator of the crossbow of FIG. 26.

In another embodiment illustrated in FIGS. 26-28, the crossbow 400 has all of the structure, components, elements, functionality and characteristics as the crossbow 300 except that the driver 307 is replaced with the driver 402. The driver 402 includes: (a) a vertical bevel gear 404 fixedly connected to the output shaft 190; (b) a horizontal bevel gear 406 mated and engaged with the vertical bevel gear 404; (c) a gear shaft 408 extending upward from the horizontal bevel gear 406; (d) a rotor, pulley, spindle or spool 410 coupled to the gear shaft 408; and (e) a drive cord 412 spooled around the spool 410 and fixedly connected to the follower 322.

In the embodiment shown, the second drive cord 412 includes a flexible band or belt constructed of KEVLAR®, a commercially-available material, or any other suitable material. In other embodiments, the drive cord 412 can include a wire, cable, string, or other flexible line configured to pull the follower 322 in the rearward direction 130. When the crossbow 400 enters the energize mode in response to a command signal from the input device 184, the motion generator 180 rotates the spool 410 so as to wrap the drive cord 412 around the spool 410. This pulls the follower 322 in the rearward direction 130. The rearward travel of the follower 322 causes the arms 324, 326 to pull rearwardly on the limb retainers 328, 330, respectively. In this action, the limb retainer 328 pivots clockwise 167, and the limb retainer 330 pivots counterclockwise 165, as shown in FIG. 26. As shown, this pivoting action causes the limbs 118, 120 to deform and bend, generating a collective spring force in the limbs 118, 120. After or before firing, the crossbow 400 can transition to the de-energize mode as described above.

Referring to FIG. 26, in an embodiment, each of the arms 324, 326 includes a hollow guide, such as a pipe or tube. In this embodiment, the drive cord 412 has a first drive cord segment that extends through one of the arms 324, 326. The drive cord 412 has a second drive cord segment that extends through another one of arms 324, 326. The end of the first drive cord segment is connected to the limb retainer 328, and the end of the second drive cord segment is connected to the limb retainer 330. When the crossbow 400 enters the energize mode in response to a command signal from the input device 184, the motion generator 180 rotates the spool 410 so as to wrap the drive cord 412 around the spool 410. This pulls the first and second drive cord segments in the rearward direction 130, and such cord segments rearwardly slide within, and relative to, the non-moving arms 324, 326. The rearward travel of such first and second drive cord segments pulls the limb retainers 328, 330, respectively. In this action, the limb retainer 328 pivots clockwise 167, and the limb retainer 330 pivots counterclockwise 165, as shown in FIG. 26.

Figure 29:
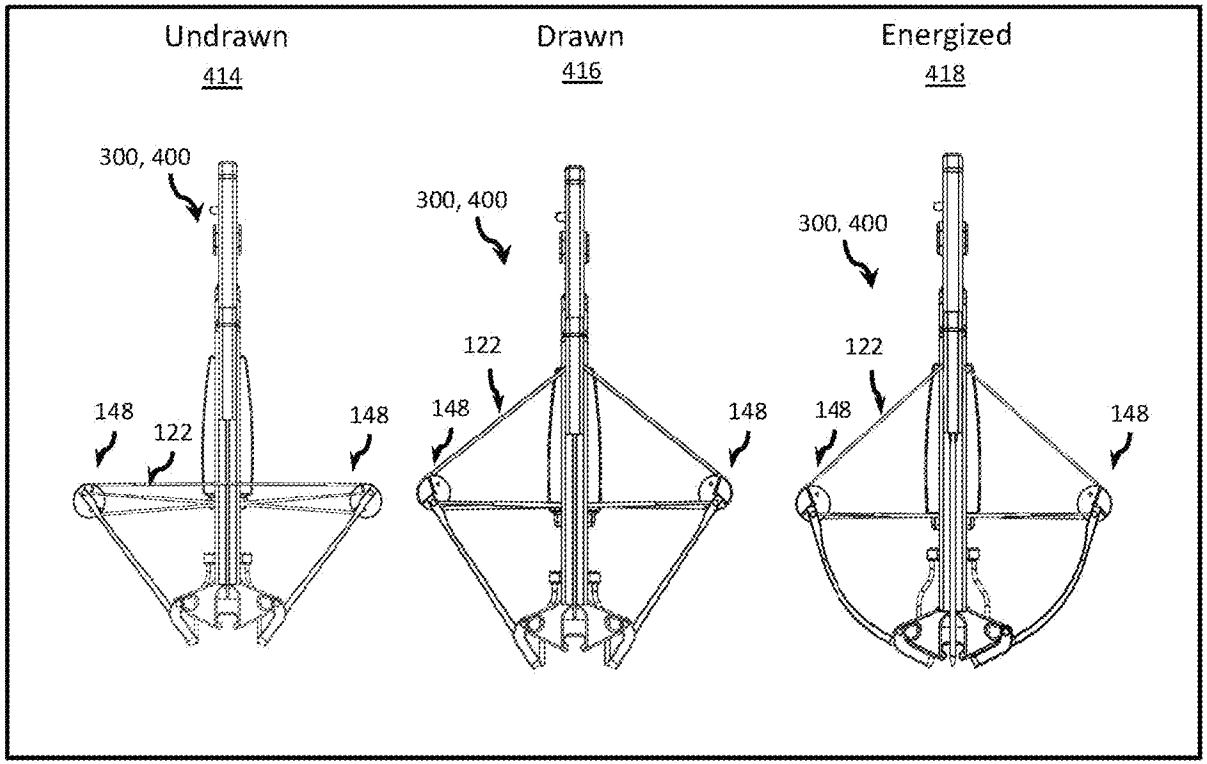
FIG. 29 is a diagram showing top plan views of the crossbows of FIGS. 21 and 26, illustrating examples of the undrawn, the drawn and the energized conditions.

Referring to FIG. 29, in an embodiment, each of the crossbows 300, 400 is changeable from an undrawn condition 414, then to a drawn condition 416 and then to an energized condition 418. Likewise, each of the crossbows 300, 400 is changeable from the energized condition 418, then to the drawn condition 416, and then to the undrawn condition 418.

In the undrawn condition 414, the draw cord 122 extends in a substantially straight line between the uncoupled limb ends 148 of the limbs 118, 120. In the undrawn condition 414, the draw cord 122 is under relatively little, if any, tension. As a result, the limbs 118, 120 are subject to little, if any, bending or deformation.

To advance to the drawn condition 416, the archer can grasp the draw cord 122 with the archer's hand and, with relative ease, can pull the draw cord 122 rearward and hook the draw cord 122 onto the cord holder 116 (FIG. 9). At this point, the draw cord 122 has a V-shape, as shown. In the drawn condition 416, the draw cord 122 is under relatively little, if any, tension, similar to the undrawn condition 414. As a result, the limbs 118, 120 are subject to little, if any, bending or deformation. Depending upon the embodiment, the archer can accomplish the drawn condition 416 with ease by exerting a force corresponding to a draw weight of less than twenty pounds, less than ten pounds, less than five pounds, less than one pound, or less than one-half of a pound. Also, with no resistance from the limbs 118, 120, the archer can quickly accomplish the drawn condition 416, for example, in less than five seconds, in less than two seconds or in less than one second.

To advance to the energized condition 418, the archer manipulates the input device 184. In response, the motion generator 180 automatically transforms the applicable crossbow 300 or 400 to the energized condition 418. At this point, the draw cord 122 maintains a V-shape, as shown. In the energized condition 418, the draw cord 122 is under substantial tension. For example, the draw cord 122 can be under a fire-ready draw weight of over one hundred fifty pounds, over two hundred pounds or over three hundred pounds. As a result, the limbs 118, 120 are bent and deformed. In the energized condition 418, each of the limbs 118, 120 can have an arc shape, a wavy shape, a plurality of arc-shaped sections having different radii, or any other suitable shape. Once the energized condition 418 is achieved, the archer can aim and pull the trigger 114. In response, the draw cord 122 will propel the projectile 102 to the target 106.

Figure 30:
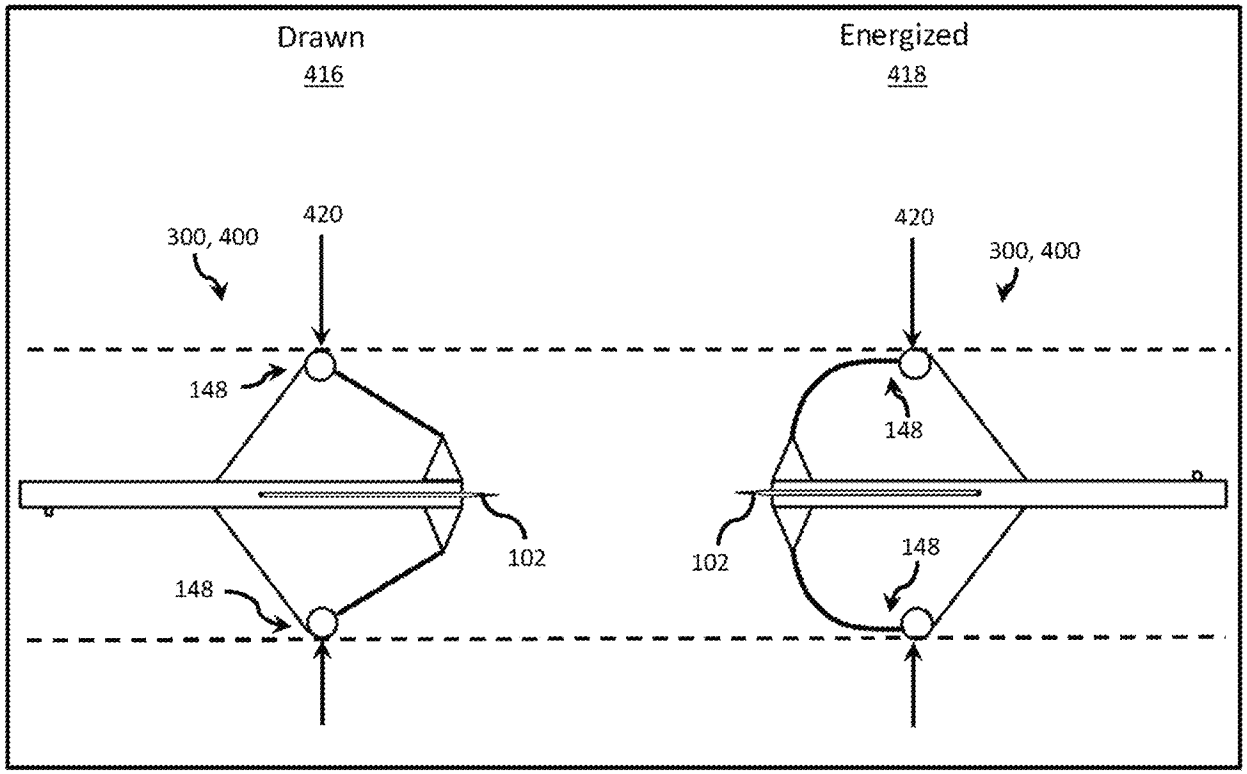
FIG. 30 is a diagram showing top plan views of the crossbows of FIGS. 21 and 26, illustrating an example of the drawn and the energized conditions in which the limb end separation distance is the same in such conditions.

The limbs 118, 120 in the energized condition 418 have a total or cumulative spring force that is sufficient in magnitude to propel the projectile 102 to the target 106. In an embodiment shown in FIG. 30, projectile 102 travels to the target 106 at a high speed without depending upon an increase in the distance between the uncoupled limb ends 148 of the limbs 118, 120 during the transition from the drawn condition 416 to the energized condition 418. For example, in the drawn condition 416, there is a distance 420 between the uncoupled limb ends 148 of the limbs 118, 120. In the energized condition 418, there is the same (or substantially the same) distance 420 between the uncoupled limb ends 148 of the limbs 118, 120. This provides the advantage and improvement of achieving fire-ready draw weight without expanding the size and wingspan of either crossbow 300 or 400.

Figure 31:
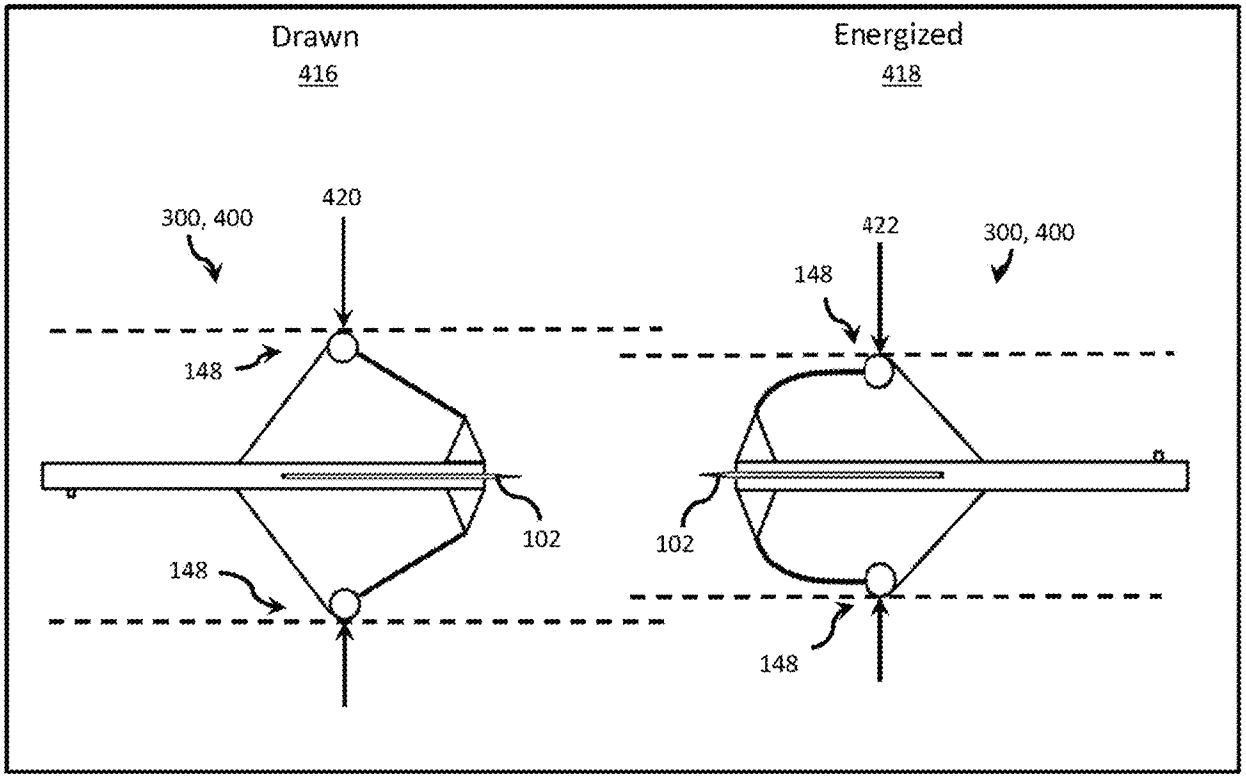
FIG. 31 is a diagram showing top plan views of the crossbows of FIGS. 21 and 26, illustrating an example of the drawn and the energized conditions in which the limb end separation distance in the energized condition is less than the limb end separation distance in the drawn condition.

In an embodiment shown in FIG. 31, the projectile 102 travels to the target 106 at a high speed without depending upon an increase in the distance between the uncoupled limb ends 148 of the limbs 118, 120 during the transition from the drawn condition 416 to the energized condition 418. For example, in the drawn condition 416, there is the distance 420 between the uncoupled limb ends 148 of the limbs 118, 120. In the energized condition 416, there is a smaller distance 422 between the uncoupled limb ends 148 of the limbs 118, 120. This provides the advantage and improvement of achieving fire-ready draw weight while, at the same time, decreasing the size and wingspan of the crossbow 100.

Figure 32:
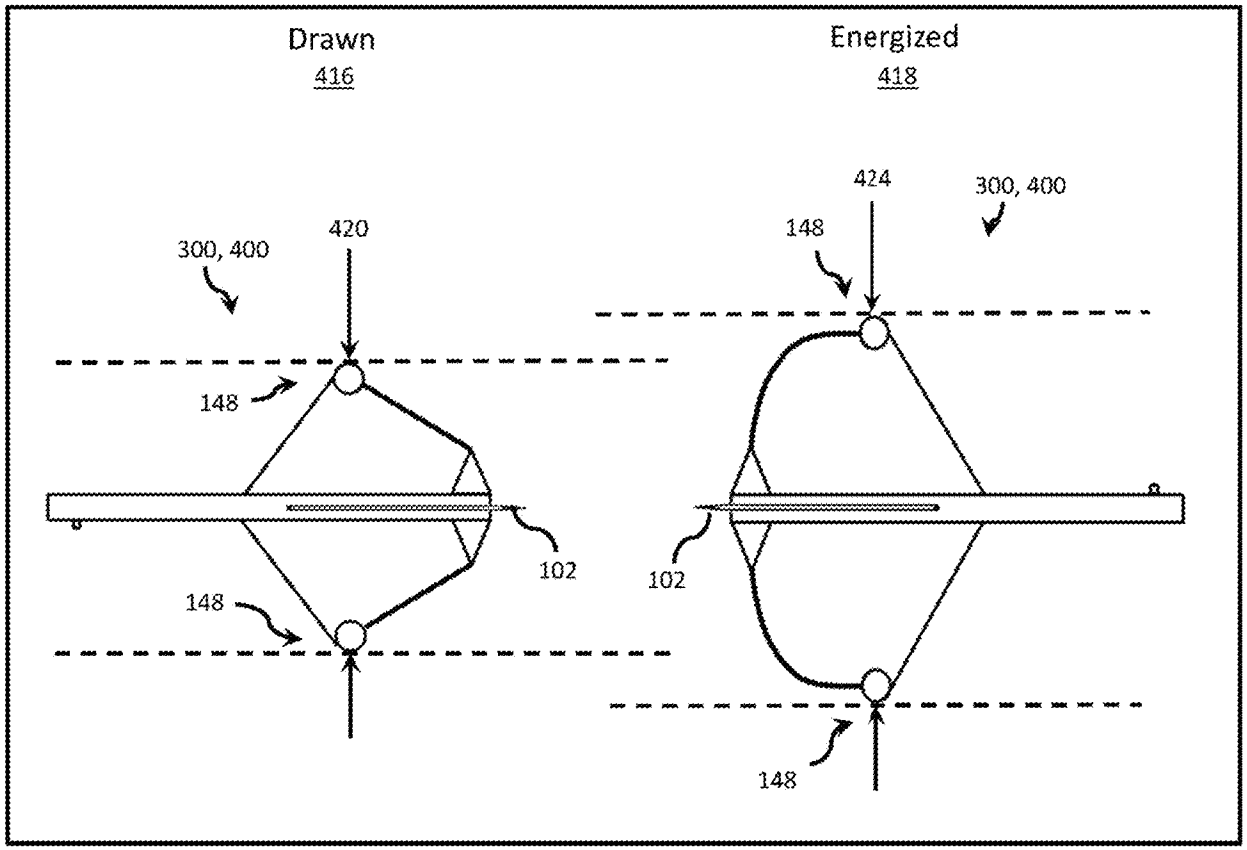
FIG. 32 is a diagram showing top plan views of the crossbows of FIGS. 21 and 26, illustrating an example of the drawn and the energized conditions in which the limb end separation distance in the energized condition is greater than the limb end separation distance in the drawn condition.
Figure 33:
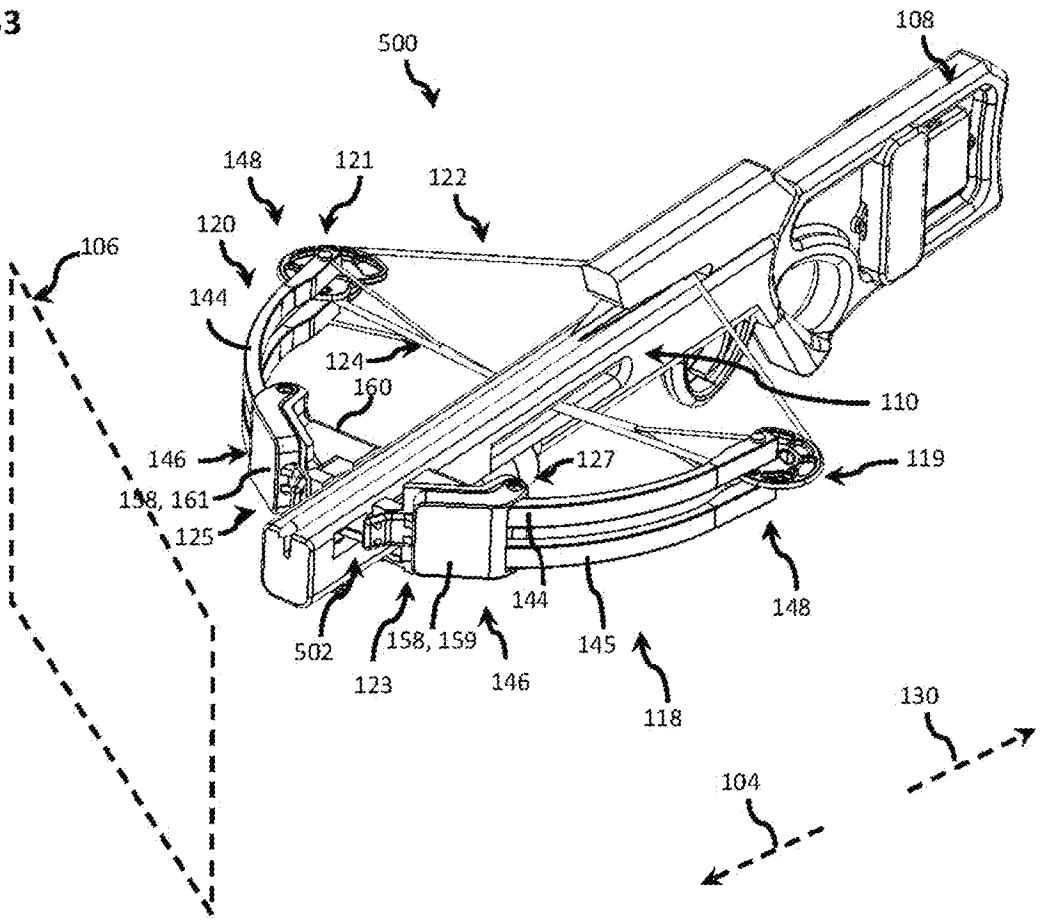
FIG. 33 is an isometric view of yet another embodiment of the crossbow.
Figure 34:
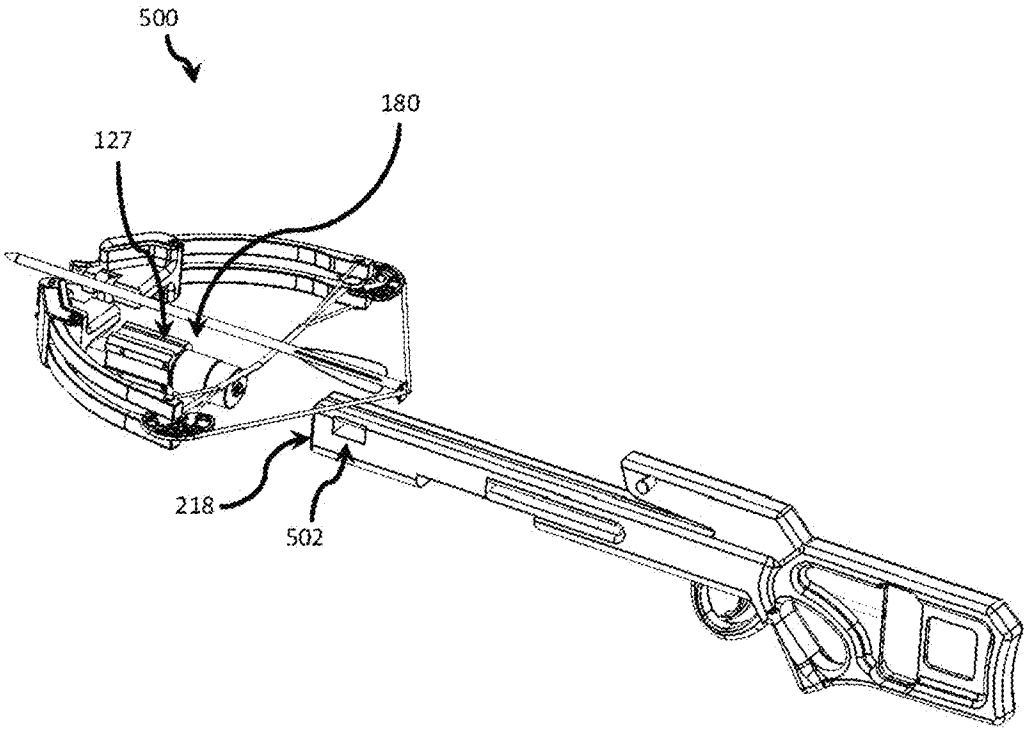
FIG. 34 is an exploded, right, side isometric view of the crossbow of FIG. 33.
Figure 35:
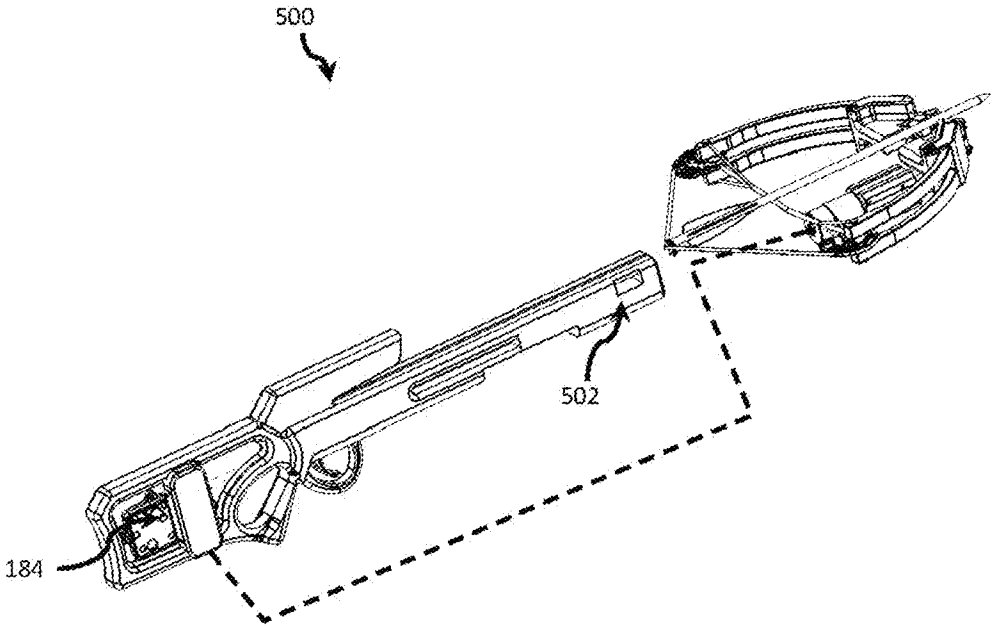
FIG. 35 is an exploded, left, side isometric view of the crossbow of FIG. 33.

In an embodiment shown in FIG. 32, the projectile 102 travels to the target 106 at a high speed depending, in part, upon a relatively small increase in the distance between the uncoupled limb ends 148 of the limbs 118, 120 during the transition from the drawn condition 416 to the energized condition 418. For example, in the drawn condition 416, there is the distance 420 between the uncoupled limb ends 148 of the limbs 118, 120. In the energized condition 416, there is a greater distance 424 between the uncoupled limb ends 148 of the limbs 118, 120. Depending upon the embodiment, the distance 424 can be less than ten percent over the distance 420, less than five percent over the distance 420 or less than one percent over the distance 420. This relatively small increase provides the advantage and improvement of achieving fire-ready draw weight without significantly or substantially increasing the size and wingspan of either crossbow 300 or 400.

In another embodiment illustrated in FIGS. 33-40, the crossbow 500 has all of the structure, components, elements, functionality and characteristics as the crossbow 100 except that: (a) the limbs 118, 120 are oriented so that the uncoupled limb ends 148 are positioned rearward of the coupled limb ends 146 as opposed to the fork configuration of crossbow 100; (b) the limb mount portion 134 is replaced with limb mount portion 502; and (c) the driver 182 is positioned forward of the limb retainers 158.

Figure 36:
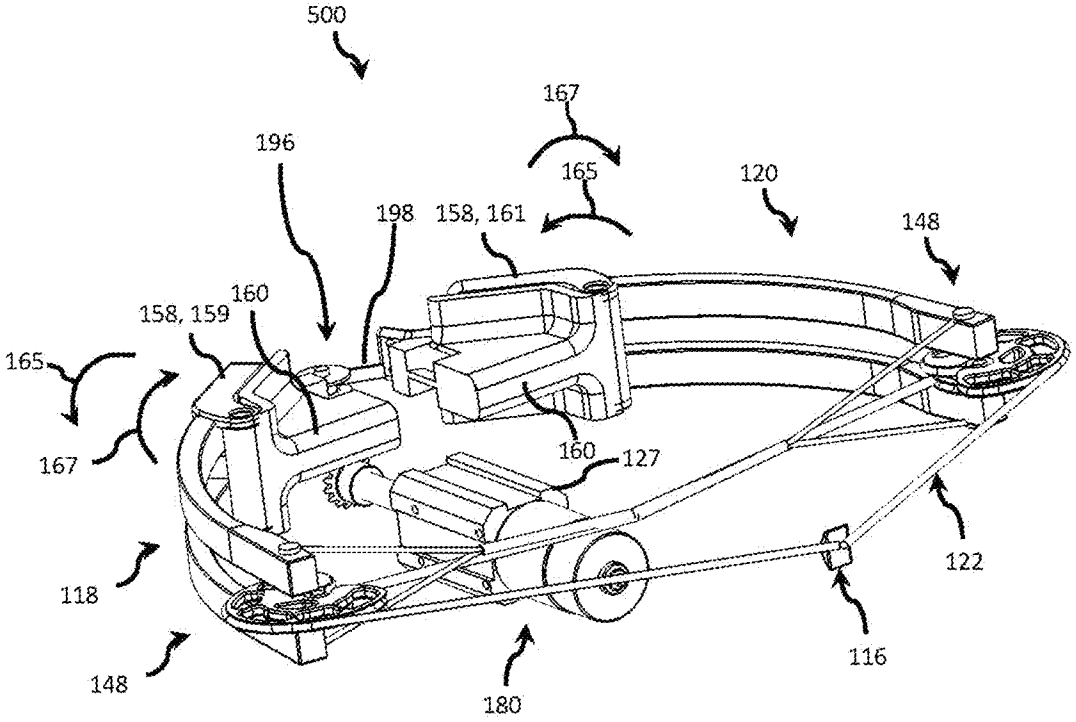
FIG. 36 is a rear isometric view of the limbs, motion generator and driver of the crossbow of FIG. 33.
Figure 37:
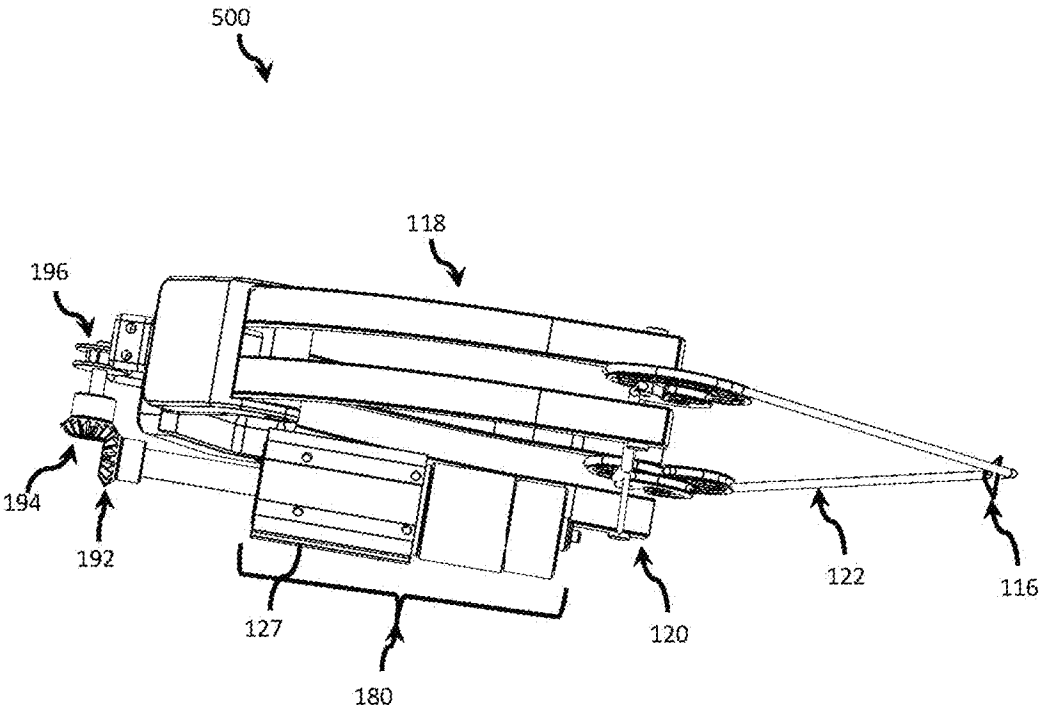
FIG. 37 is a right side isometric view of the limbs, motion generator and driver of the crossbow of FIG. 33.
Figure 38:
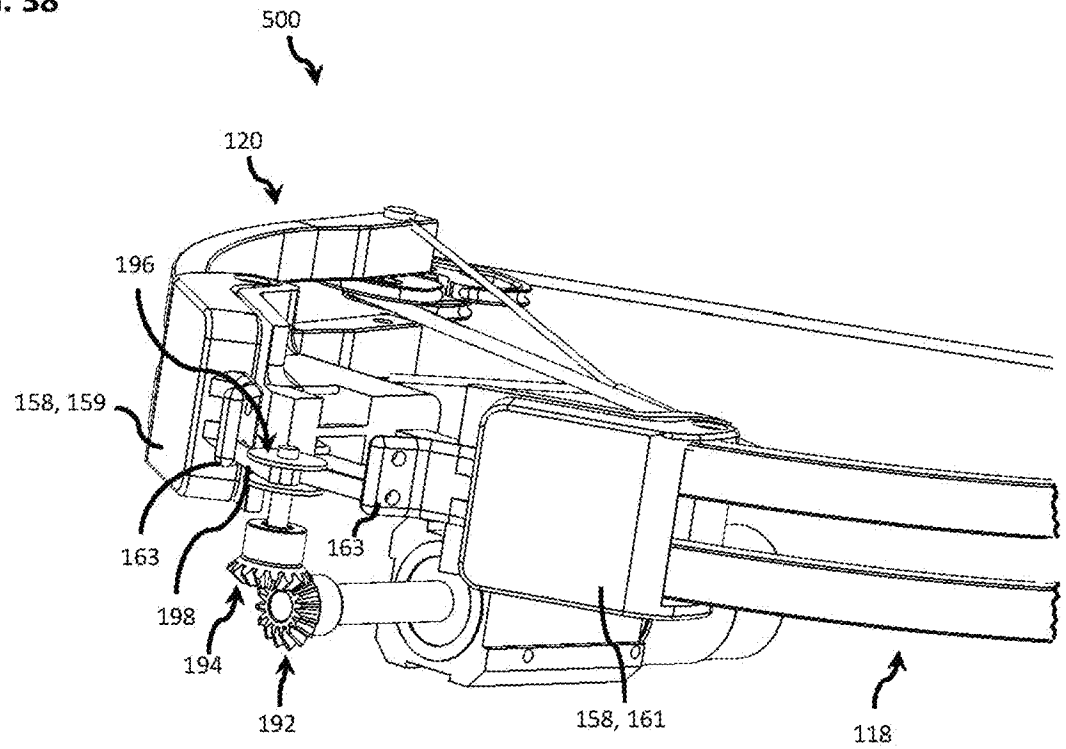
FIG. 38 is a front isometric view of the limbs, motion generator and driver of the crossbow of FIG. 33.
Figure 39:
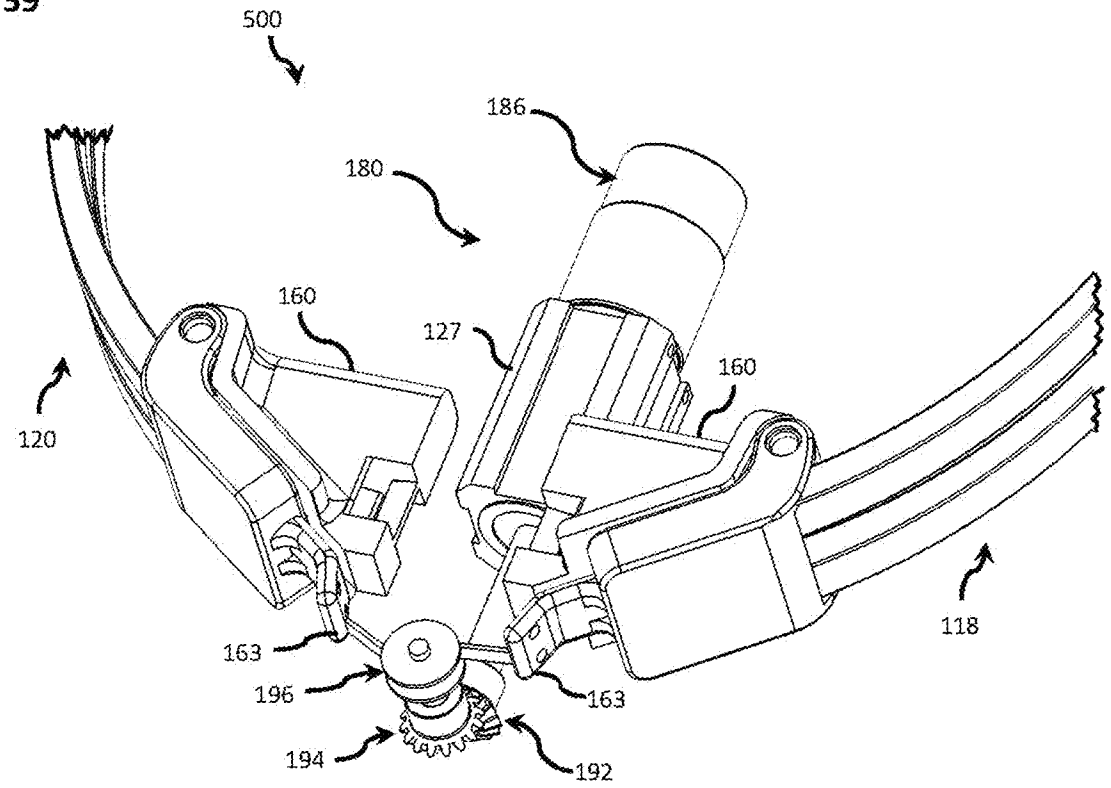
FIG. 39 is a fragmentary, top isometric view of the limbs, motion generator and driver of the crossbow of FIG. 33.

The limb mount portion 502 is positioned forward of the foregrip 127, at or adjacent to the body forward end 218. By rotating, pressing or otherwise manipulating the input device 184, the archer can activate the energize mode of the motion generator 180 or activate the de-energize mode of the motion generator 180. As illustrated in FIG. 36, in the energize mode, the motion generator 180 rotates the spool 196 so as to spool the first and second drive cords 198, 200 around the spool 196. This causes the arms 163 associated with the limbs 118, 120 to move toward the body 110. In turn, this causes the limb retainers 158 associated with limbs 118, 120 to pivot. For example, the limb retainer 159 pivots clockwise 167, and the limb retainer 161 pivots counterclockwise 165, as shown in FIG. 36. As a result, the limbs 118, 120 pivot so that the uncoupled limb ends 148 of the limbs 118, 120 move away from each other and away from the vertical plane 174 (FIG. 8). As described below, eventually the limbs 118, 120 flex and bend, which increases the spring forces in the limbs 118, 120.

In the de-energize mode, the motion generator 180 rotates the spool 196 in the opposite direction to unspool the first and second drive cords 198, 200 from the spool 196. This causes the arms 163 associated with the limbs 118, 120 to move away from the body 110. In turn, this causes the limb retainers 158 associated with limbs 118, 120 to pivot. For example, the limb retainer 159 pivots counterclockwise 165, and the limb retainer 161 pivots clockwise 167, as shown in FIG. 36. As a result, the limbs 118, 120 pivot so that the uncoupled limb ends 148 of the limbs 118, 120 move toward each other and toward the vertical plane 174 (FIG. 8). As described below, eventually the limbs 118, 120 bend back to their original shapes or substantially to their original shapes.

Figure 40:
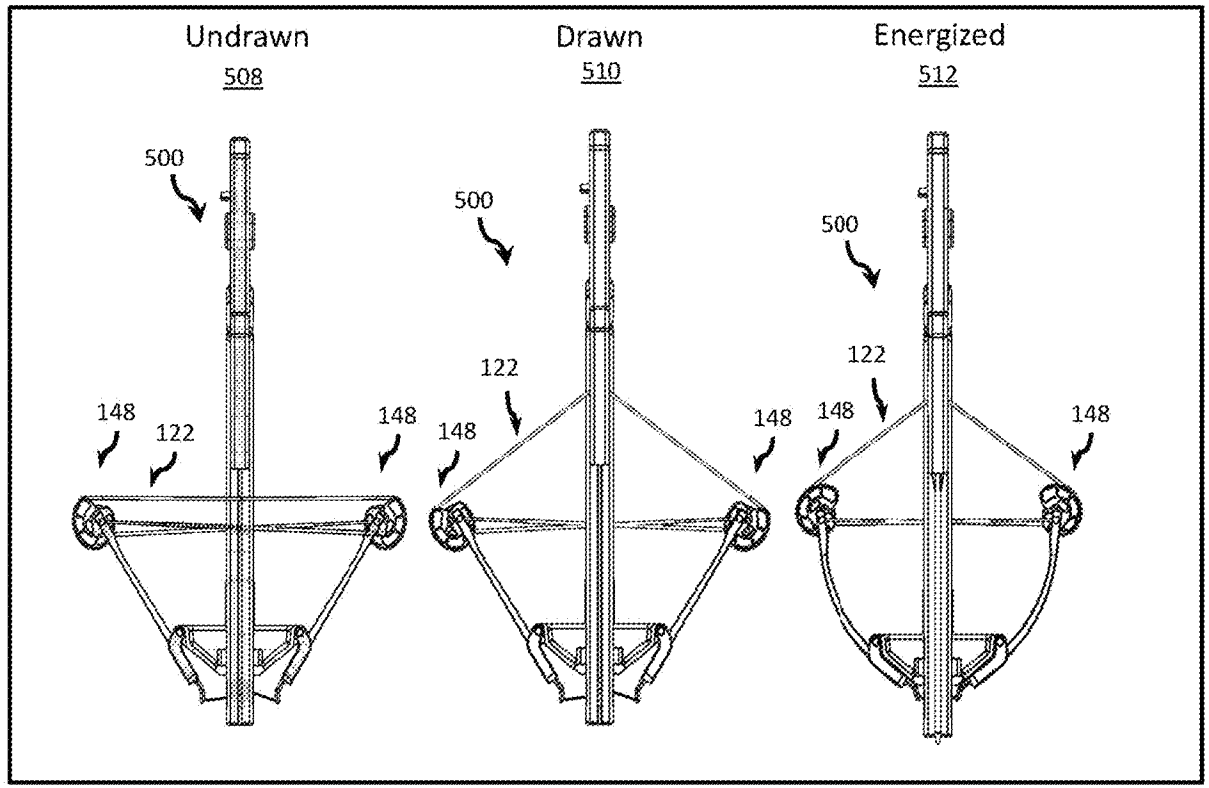
FIG. 40 is a diagram showing top plan views of the crossbow of FIG. 33, illustrating examples of the drawn and the energized conditions in which the limb end separation distance is the same in such conditions.

Referring to FIG. 40, in an embodiment, the crossbow 500 is changeable from an undrawn condition 508, then to a drawn condition 510 and then to an energized condition 512. Likewise, the crossbow 500 is changeable from the energized condition 512, then to the drawn condition 510, and then to the undrawn condition 508.

In the undrawn condition 508, the draw cord 122 extends in a substantially straight line between the uncoupled limb ends 148 of the limbs 118, 120. In the undrawn condition 508, the draw cord 122 is under relatively little, if any, tension. As a result, the limbs 118, 120 are subject to little, if any, bending or deformation.

To advance to the drawn condition 510, the archer can grasp the draw cord 122 with the archer's hand and, with relative ease, can pull the draw cord 122 rearward and hook the draw cord 122 onto the cord holder 116 (FIG. 9). At this point, the draw cord 122 has a V-shape, as shown. In the drawn condition 510, the draw cord 122 is under relatively little, if any, tension, similar to the undrawn condition 508. As a result, the limbs 118, 120 are subject to little, if any, bending or deformation. Depending upon the embodiment, the archer can accomplish the drawn condition 510 with ease by exerting a force corresponding to a draw weight of less than twenty pounds, less than ten pounds, less than five pounds, less than one pound, or less than one-half of a pound. Also, with little or no resistance from the limbs 118, 120, the archer can quickly accomplish the drawn condition 510, for example, in less than five seconds, in less than two seconds or in less than one second.

To advance to the energized condition 512, the archer manipulates the input device 184. In response, the motion generator 180 automatically transforms the crossbow 500 to the energized condition 512. At this point, the draw cord 122 maintains a V-shape, as shown. In the energized condition 512, the draw cord 122 is under substantial tension. For example, the draw cord 122 can be under a fire-ready draw weight of over one hundred fifty pounds, over two hundred pounds or over three hundred pounds. As a result, the limbs 118, 120 are bent and deformed. In the energized condition 512, each of the limbs 118, 120 can have an arc shape, a wavy shape, a plurality of arc-shaped sections having different radii, or any other suitable shape. Once the energized condition 512 is achieved, the archer can aim and pull the trigger 114. In response, the draw cord 122 will propel the projectile 102 to the target 106.

The limbs 118, 120 in the energized condition 512 have a cumulative spring force that is sufficient in magnitude to propel the projectile 102 to the target 106. In an embodiment, projectile 102 travels to the target 106 at a high speed without depending upon an increase in the distance between the uncoupled limb ends 148 of the limbs 118, 120 during the transition from the drawn condition 510 to the energized condition 512. For example, in the drawn condition 510, there is a distance between the uncoupled limb ends 148 of the limbs 118, 120. In the energized condition 510, there is the same (or substantially the same) distance between the uncoupled limb ends 148 of the limbs 118, 120. This provides the advantage and improvement of achieving fire-ready draw weight without expanding the size and wingspan of the crossbow 500. As described above with respect to the crossbow 100, the crossbow 500 can have various embodiments in which the distance between the uncoupled limb ends 148 of the limbs 118, 120: (a) is constant during the transition from the drawn condition 510 to the energized condition 512; (b) decreases (substantially or unsubstantially) during the transition from the drawn condition 510 to the energized condition 512; or (c) increases (substantially or unsubstantially) during the transition from the drawn condition 510 to the energized condition 512.

Figure 41:
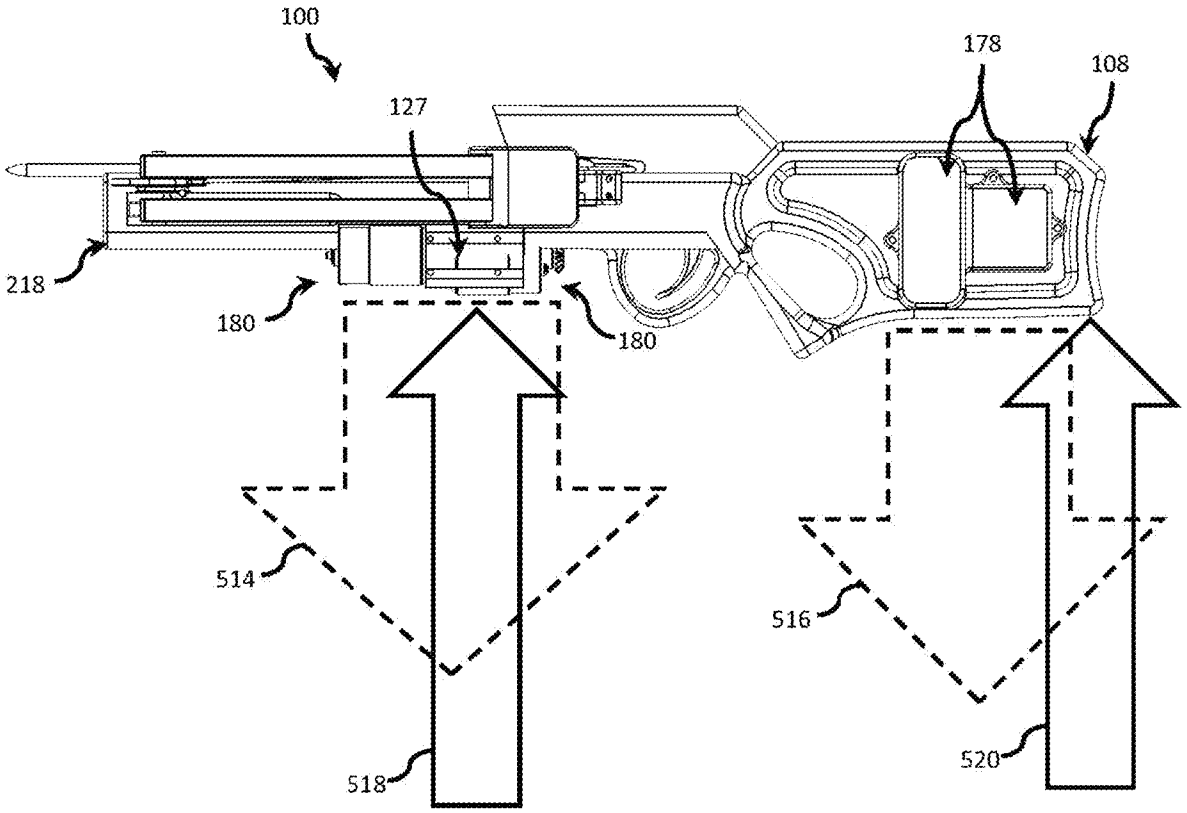
FIG. 41 is a force diagram showing a side elevation view of the crossbow of FIG. 1, illustrating a crossbow weight distribution and upward-acting forces applied by the archer.

Referring to FIGS. 41-44, the crossbows 100, 300, 400 and 500 are each configured with a weight distribution that facilitates handling and aiming. As illustrated in FIG. 41, the crossbow 100 has: (a) a downward motion generator weight 514 caused, in part, by the weight of the motion generator 180; and (b) a downward power source weight 516 caused, in part, by the electrical power source 178. The archer applies an upward, forward hand force 518 to the foregrip 127, and the archer's shoulder-chest region applies an upward shoulder force 520 to the stock 108. As shown, the motion generator 180 is positioned at least partially rearward of the foregrip 127. The center of the forward hand force 518 is forward of the center of the motion generator weight 514. Also, the electrical power source 178, located in or at the stock 108, is counteracted by the upward shoulder force 520 applied to the stock 108. Consequently, the body forward end 218 of crossbow 100 is less prone to tip downward during use of the crossbow 100. These alleviates or decreases the torque acting downward on the body forward end 218, which reduces arm fatigue during aiming and shooting of the crossbow 100. The reduction in arm fatigue facilitates enhanced shooting performance and improves the shooting experience.

Figure 42:
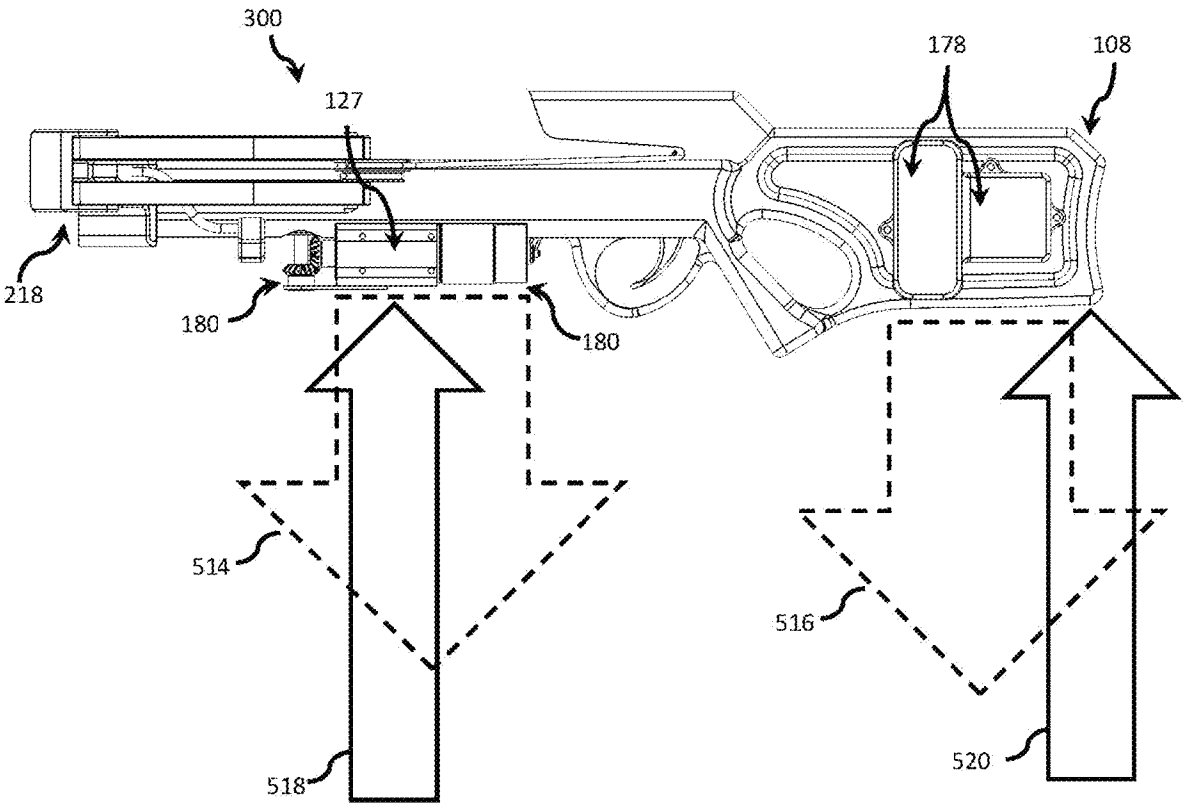
FIG. 42 is a force diagram showing a side elevation view of the crossbow of FIG. 21, illustrating a crossbow weight distribution and upward-acting forces applied by the archer.

As illustrated in FIG. 42, the crossbow 300 has: (a) a downward motion generator weight 514 caused, in part, by the weight of the motion generator 180; and (b) a downward power source weight 516 caused, in part, by the electrical power source 178. The archer applies an upward, forward hand force 518 to the foregrip 127, and the archer's shoulder-chest region applies an upward shoulder force 520 to the stock 108. As shown, the motion generator 180 is positioned at least partially rearward of the foregrip 127. The center of the forward hand force 518 is forward of the center of the motion generator weight 514. Also, the electrical power source 178, located in or at the stock 108, is counteracted by the upward shoulder force 520 applied to the stock 108. Consequently, the body forward end 218 of crossbow 300 is less prone to tip downward during use of the crossbow 300. These alleviates or decreases the torque acting downward on the body forward end 218, which reduces arm fatigue during aiming and shooting of the crossbow 300. The reduction in arm fatigue facilitates enhanced shooting performance and improves the shooting experience.

Figure 43:
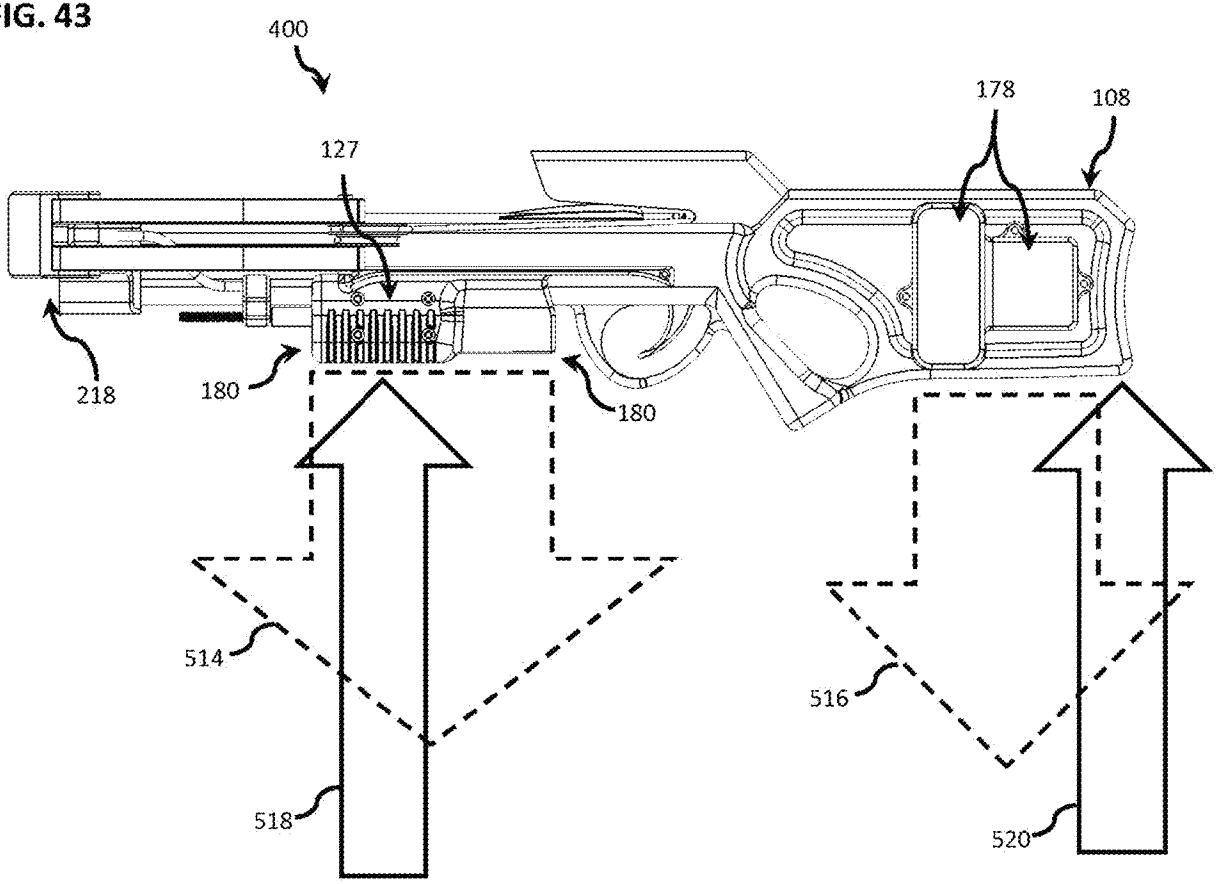
FIG. 43 is a force diagram showing a side elevation view of the crossbow of FIG. 26, illustrating a crossbow weight distribution and upward-acting forces applied by the archer.

As illustrated in FIG. 43, the crossbow 400 has: (a) a downward motion generator weight 514 caused, in part, by the weight of the motion generator 180; and (b) a downward power source weight 516 caused, in part, by the electrical power source 178. The archer applies an upward, forward hand force 518 to the foregrip 127, and the archer's shoulder-chest region applies an upward shoulder force 520 to the stock 108. As shown, the motion generator 180 is positioned at least partially rearward of the foregrip 127. The center of the forward hand force 518 is forward of the center of the motion generator weight 514. Also, the electrical power source 178, located in or at the stock 108, is counteracted by the upward shoulder force 520 applied to the stock 108. Consequently, the body forward end 218 of crossbow 400 is less prone to tip downward during use of the crossbow 400. These alleviates or decreases the torque acting downward on the body forward end 218, which reduces arm fatigue during aiming and shooting of the crossbow 400. The reduction in arm fatigue facilitates enhanced shooting performance and improves the shooting experience.

Figure 44:
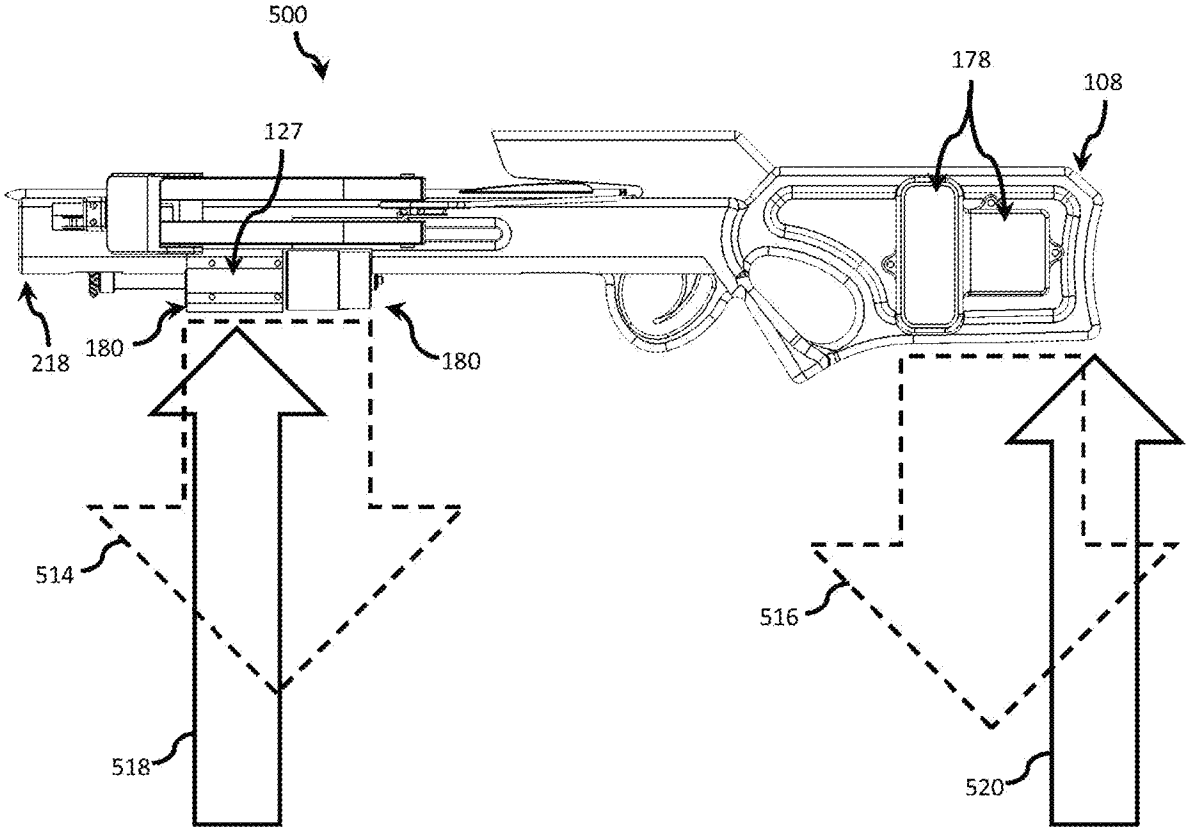
FIG. 44 is a force diagram showing a side elevation view of the crossbow of FIG. 33, illustrating a crossbow weight distribution and upward-acting forces applied by the archer.

As illustrated in FIG. 44, the crossbow 500 has: (a) a downward motion generator weight 514 caused, in part, by the weight of the motion generator 180; and (b) a downward power source weight 516 caused, in part, by the electrical power source 178. The archer applies an upward, forward hand force 518 to the foregrip 127, and the archer's shoulder-chest region applies an upward shoulder force 520 to the stock 108. As shown, the motion generator 180 is positioned at least partially rearward of the foregrip 127. The center of the forward hand force 516 is forward of the center of the motion generator weight 514. Also, the electrical power source 178, located in or at the stock 108, is counteracted by the upward shoulder force 520 applied to the stock 108. Consequently, the body forward end 218 of crossbow 500 is less prone to tip downward during use of the crossbow 500. These alleviates or decreases the torque acting downward on the body forward end 218, which reduces arm fatigue during aiming and shooting of the crossbow 500. The reduction in arm fatigue facilitates enhanced shooting performance and improves the shooting experience.

It should be appreciated that the cord passageways 157, 199, as shown in FIG. 8, reduce the weight of each of the crossbows 100, 300, 400, 500. In the embodiment shown in FIG. 8, the cord passageway 157 is positioned forward of the foregrip 127. Accordingly, the cord passageway 157 reduces the weight of the body forward end 218. This reduction in weight further reduces the tendency of downward tipping of the forward end 218, which aids in the reduction of arm fatigue and also enhances shooting control and performance.

In an embodiment, the energizer 126 of each of the crossbows 100, 300, 400 or 500 is an after-market kit or accessory for crossbows, compound bows, recurve bows, other archery bows or other weapons that launch projectiles based, at least in part, on spring force. Such kit is configured to be attached to or otherwise connected to the bow through the use of fasteners (e.g., screws, bolts, pins and nuts), snap-fit or press-fit connections, or solder or weld joints. Accordingly, such kit enables the conversion of bows and spring-based weapons to energizable bows and weapons, respectively.

Each of the crossbows 100, 300, 400 and 500 can be constructed of metallic materials, polymeric materials, a combination thereof, or any other suitable materials. For example, the body 110 can be constructed of aluminum, magnesium alloy or carbon fiber, and the limbs 118, 120 can be constructed of fiberglass-based, composite materials capable of receiving high tensile and compressive forces.

The parts, components, and structural elements of each of the crossbows 100, 300, 400 or 500 can be combined into an integral or unitary, one-piece object. Alternatively, such parts, components and structural elements can be distinct, removable items that are attachable to each other through screws, bolts, pins, joints and other suitable fasteners. For example, depending upon the embodiment: (a) the track 112 can be part of a barrel that is coupled to the body 110 through fasteners or other attachment methods; (b) the foregrip 127 can be integral and unitary with the body 110; (c) the limb supports 160 can be integral and unitary with the body 110; and (d) the limb support 304 can be integral and unitary with the body 110.

In the descriptions of embodiments that involve an element with automatic functionality, the element is configured to, and operable to, perform a function (or sequence of events) in response to an input that originates with a user, such as the manipulation of an input device or the user's provision of an audio input or other input.

Additional embodiments include any one of the embodiments described above (including the embodiments of the crossbows 100, 300, 400 and 500), where one or more of its components, functionalities or structures is interchanged with, replaced by or augmented by one or more of the components, functionalities or structures of a different embodiment described above.

Figure 45:
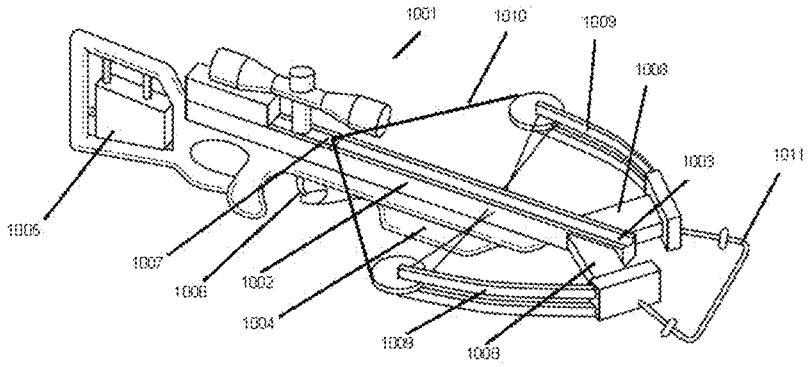
FIG. 45 is an isometric view of an example of a prior art compound crossbow construction.

Referring to FIGS. 45-67C, additional embodiments are described. In an embodiment, a crossbow 1001, as shown in FIG. 45, comprises a barrel 1002 comprising a flight groove 1003 which defines the bolt flight path and rest, a foregrip 1004, stock 1005 and trigger 1006. The groove 1003, in an embodiment, is configured to at least partially hold or support an arrow, projectile or bolt (not shown) intended to be launched in the air toward a target. In the embodiment shown, the crossbow 1001 is a compound crossbow. Two risers 1008 may be arranged at the front of the barrel, and constitute support for the limbs 1009 protruding out to each side of the barrelectric. The attachment member attaching each limb 1009 to corresponding riser may comprise a pivot member or pivot point 1021 and a limb coupler 1022 (e.g., a bolt, screw or other suitable fastener). A bowstring, drawstring or string 1010 is attached between the outer ends of the limbs 1009, and is used for shooting the bolt. A latch 1007 is arranged on the back end of the barrel 1002 to hold the string 1010 when drawn.

A drawn string 1010 provides a high tension in the limbs 1009, and when a bolt is placed in the flight groove 1003 in front of the tensioned string 1010, and a trigger 1006 is pulled with the effect that the latch 1007 releases the string 1010, the tension in the limbs 1009 and the string 1010 is released and pushes the bolt along the flight groove 1003 and out of the crossbow 1001 between the risers 1008 and the limbs 1009. Crossbow 1001 can comprise a cocking stirrup 1011 arranged in the front of the risers 1008 being located below the flight path 1003 of the bolt. The cocking stirrup 1011 provides a foot grip for the shooter to aid the drawing operation of the string 1010 when loading the crossbow 1001, when the shooter points the crossbow 1001 towards the ground, and puts his/hers foot inside the cocking stirrup 1011, and grips the string 1010 and pulls the string back to the latch 1007. Crossbow 1001 can include or be operable with other devices for aiding the loading, such as hooks and belt, cranked rack-and-pinion devices and multiple cord-and-pulley cranked devices such as windlasses.

Figure 52:
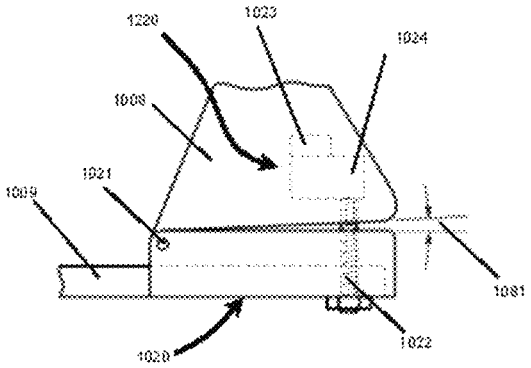
FIG. 52 is a side, diagrammatic view of an embodiment of a limb pocket and motor/gear in riser, un-tensioned.
Figure 53:
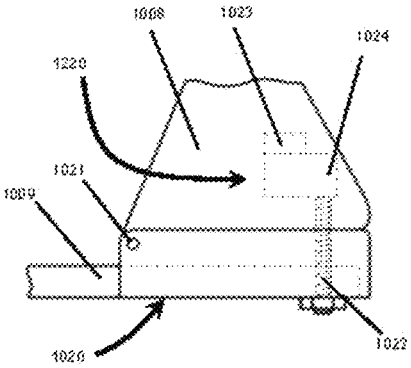
FIG. 53 is a side, diagrammatic view of an embodiment of a limb pocket and motor/gear in riser, tensioned.

There are several design variations to the mounting practice of the limbs/limb arms to the risers in crossbow designs. A limb arm 1009 may, for example, be composed of a single limb arm or two parallel limb arms. The limb arm(s) 1009 may be enclosed in a limb pocket 1020 at a first end, and the first end being connected to a corresponding riser 1008. A second end of the limb arm(s) provides a connector or coupling for the string 1010. The first end of the limb arm 1009 may be connected to the riser in at least a pivot point 1021 arranged at a distance from the first end of the limb(s) 1009, and the limb arm 1009 may be pivotable around the pivot point 1021. Closer, yet, to the first end of the limb(s) a fastener 1022, such as a limb coupler 1022, may be provided. If a limb pocket 1020 is used, both pivot point 1021 and limb coupler 1022 may be comprised as integrated features of the limb pocket 1020 as shown in, for example, FIGS. 46 and 51-53. Other designs may be facilitated for the pivot point 1021 and limb coupler 1022 fastening mechanisms. In an embodiment, a certain adjustability 1081 of the limb coupler 1022 and first end of the limb arm(s) 1009 relative the corresponding riser 1008 is necessary for the power-assisting draw weight amplifier or amplifier assembly to work as shown in FIG. 52 (un-tensioned), and as shown in FIG. 53 (tensioned).

Figure 46:
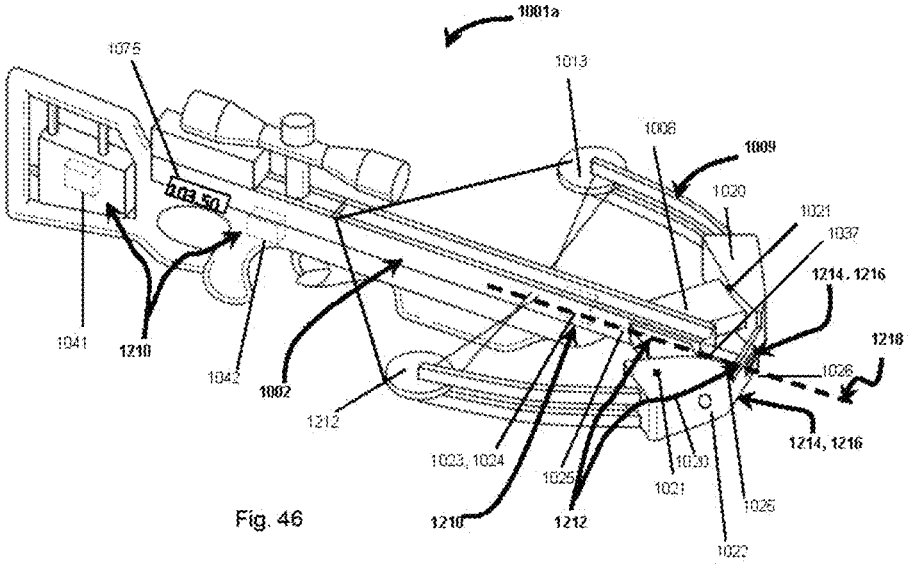
FIG. 46 is an isometric view of an embodiment of a compound crossbow construction including single power-assisting draw weight amplifier system.

In a first embodiment, illustrated in FIG. 46, the crossbow 1001*a* includes some or all of the elements, structures, components and functionality of crossbow 1001. In addition, crossbow 1001*a* includes a single power-assisting draw weight amplifier system 1210. The amplifier system 1210 is operatively coupled to the limbs 1009 which, in turn, is operatively coupled to the string 1010. The amplifier system 1210 is configured and operable to generate a force acting along axis 1218 (FIG. 46). In response to the force, the limbs 1009 move relative to the barrel 1002. As described below, this movement of the limbs 1009 facilitates the loading and unloading of the crossbow 1001*a*. In an embodiment, this movement of each limb 1009 includes a pivot movement relative the associated limb pocket 1020. During the pivot movement, the limbs 1009 are operable to slightly pivot outward (away from axis 1218) or inward (toward axis 1218) similar to the opening and closing wings of a bird. In another embodiment (not illustrated), this movement of limbs 1009 includes an axial movement along axis 1218.

In the embodiment shown in FIG. 46, the amplifier system 1210 includes a single motor 1023 integrated into the crossbow 1001*a*, for example an electrical motor 1023, which is arranged in or on the underside of the barrel 1002 close to the risers 1008. The electrical motor 1023 may be any suitable motor type, for example a DC geared motor, electrical linear actuator, AC motor, stepper motor or other suitable motor. The amplifier system 1210 also includes: (a) a drive member or gear 1024 operatively coupled to the motor 1023; (b) an energy resource 1041 (described below) operatively coupled to the motor 1023; and (c) a switch device 1042 (described below) operatively coupled to the motor 1023. In other embodiments, as described below, the motor 1023 can be replaced with a pump system, a hydraulic or pneumatic device, an electromagnetic actuator or any other suitable type of motion mechanism or driver operable to drive or cause motion based on electrical, chemical, fuel, gas pressure or other types of energy.

The output of the electrical motor 1023 is optionally connected to the gear 1024, which, depending upon the embodiment, can include a worm gear 1024. In the illustrated embodiment, the amplifier system 1210 also includes a motion translator 1212. The rotational output of the motor 1023 is connected to the motion translator 1212 that translates the rotational force of the motor/gear 1023, 1024 to a pull/push force. The motion translator 1212 outputs the pull/push force to connector assembly 1214, including a connector 1216 coupled to each one of the limb pockets 1020. The fore-aft movement of the connector assembly 1214 causes each limb pocket 1020 to pivot relative to the associated riser 1008, in turn, causes pivot movement of the limbs 1009 (relative to barrel 1002) in the region of the limb couplers 1022.

Figure 47:
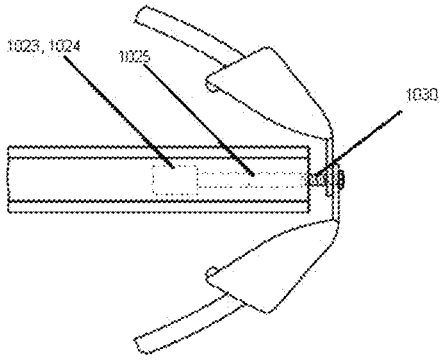
FIG. 47 is a top plan view of an embodiment of an example of combined connection point in limb pockets to single cardan axle.
Figure 55:
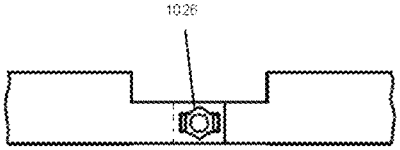
FIG. 55 is an elevation view of an embodiment of limb pockets/covers extended connected.

In an embodiment, the motion translator 1212 may be constituted of one or two actuator rods/cardan shaft 1025 and a nut 1026 for receiving the actuator rod/cardan shaft 1025 of the motor/gear 1023, 1024, the actuator rod/cardan shaft 1025 being provided in the outer end with threads 1030 corresponding to threads inside the nut. In this embodiment, the outer end of the actuator rod/cardan shaft 1025 protrudes through opening 1101, in the limb pocket 1020, and connects with the nut 1026 on the far side of the limb pocket opening 1101 as shown in FIGS. 46, 47, and 55. The turning of the motor/gear 1023, 1024 generates an output that will then rotate the actuator rod/cardan shaft 1025 in the nut 1026 and thereby move the nut 1026 along axis 1218 outwards or inwards on the actuator rod/cardan shaft 1025 based on the motor/gear 1023, 1024 rotation direction and speed. The connector assembly 1214 then moves arm assembly 1215 relative to axis 1218, which causes the moving of the limb arms/limb pocket 1020 correspondingly. The pulling/pushing gain ratio, in an embodiment, is defined by the one or more gears 1024 between the electrical motor 1023 and the connector 1025, for example worm gear 1024, and also cardan shaft 1025 and nut 1026 winding ratio 1030 as shown in FIG. 47, the gain ration would be inversely proportional to the winding speed reduction ratio from motor 1023 to cardan shaft 1025, and then the thread translation of rotational speed to longitudinal speed in the actuator rod/cardan shaft 1025 and nut 1030 threads.

To move the nut 20 mm in longitudinal direction along axis 1218 will, if the thread in nut is 0.5 threads/mm, require the cardan shaft to rotate 10 times. If a worm gear 1024 is connected to the cardan shaft 1025 between cardan shaft 1025 and electric motor 1023, having a ratio of 200:1, the electric motor has to rotate 2000 times in order to move the nut 20 mm. If the work is expected to be performed in 10 sec, the output speed of the electric motor must be at least 12000 rpm. The pulling force may similarly be calculated. If, for example the motor 1023 has a rotational force of 0.1 Nm, the output of the worm gear is 20 Nm, and the pulling force on the nut, if this has a 20 mm radius (20×5/0.02), would be 5000 N (approx. 500 Kg or 1000 Lb).

In a further embodiment, as exemplified in the FIGS. 63 to 67B, it is shown how the amplifier system 1210 comprises a single actuator and a motion translator 1212 being connected to a limb connector 1219. The limb connector 1219 may further be connected to each of the limb pockets 1020 respectively via a pair of limb pocket connectors 1213, the limb pocket connectors 1213 may be wires, rod, kevlar rope/cable/strap/tape or other durable material providing sufficient strength. The connecting point of the limb pocket connectors 1213 on the limb pockets 1020 may preferably be at the far side opposite the protruding limbs 1009. The single actuator is comprised by one or more motors and a gear/spindle acting on pair of limb pocket connectors 1213 connecting each of the first end of the limb arms/limb pocket 1020 for moving the limbs 1009 in the region of the limb couplers 1022 with the output of the gear/spindle in such a manner that, when driving the motor in a first direction, both of the first ends of the limb arms/limb pockets 1020 for moving the limbs 1009 in the region of the limb couplers 1022 are pulled towards the riser 1198 around the pivot point 1021 of the limb pocket 1020. This brings each limb arm end closer to the corresponding riser 1198 portion and thus increases the tension in a drawn string. When the motor/spindle is reversed, the first end of the limb arms/limb pocket 1020 for moving the limbs 1009 in the region of the limb couplers 1022 is moved/pulled in opposite direction, thus relieving some of the tension in the string. The forces acting on the limb pockets 1020 in the reversed pulling motion will be originating from the tension of the string, and the retaining force of the connector 1213 being connected to the actuator 1023, 1024, 1025.

The gear/spindle 1231/1232 acting on the limb connector 1219, may be directly connected to the limb connector 1219 by a rod 1231, or via a spiral bevel gear 1232 or the like and a gear spindle 1233 for winding up a kevlar tape 1234 or the like being connected in a further end to the limb connector 1219. The limb connector 1219 is further arranged onto the under side of or around the front end of the barrel 1235. A groove 1242 may be provided in the limb connector 1219 to fit around the underside of the front end of the barrel 1235.

Guiding rods 1236 may be arranged for guiding the gliding motion of the limb connector 1219. Such guiding rods 1236 may be arranged on the underside of the front end of the barrel 1235, and may be running from the front of the foregrip 1277 to the backside of the riser 1198.

The limb connector 1219 may further provide through holes 1243 for arranging the guiding rods 1236 through the limb connector 1219.

It may further be provided a support frame 1241 arranged around the spiral bevel gear 1232 providing support for the bottom part of the vertical part of the spiral bevel gear 1232 such that the spiral bevel gear 1232 is held in position even if the forces from the winded up kevlar tape 1234 pulls on the gear with grate force.

The FIGS. 63 to 67B illustrates a cross bow having a front end mounted dual riser 1198 construction. It is however not a requirement for this embodiment, and any cross bow design may utilize this embodiment of the amplifier system 1210, limb pocket connectors 1213 and limb connector 1219.

Figure 54:
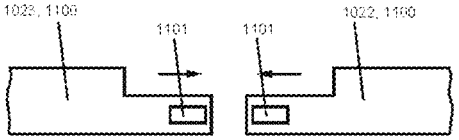
FIG. 54 is a side, diagrammatic view of an embodiment of limb pockets/covers extended separate.
Figure 56:
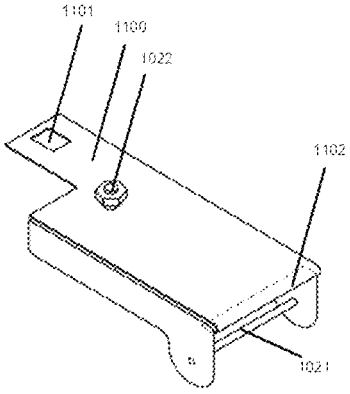
FIG. 56 is an isometric view of an embodiment of a limb pocket cover.
Figure 57:
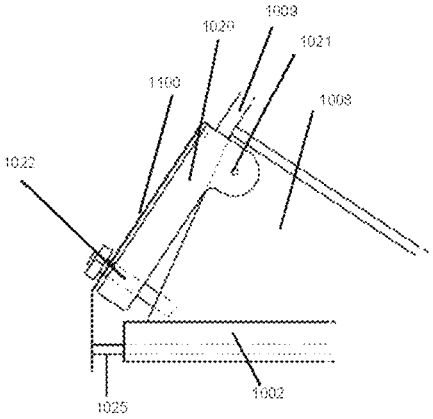
FIG. 57 is an isometric view of an embodiment of a limb pocket cover employed.

In an embodiment illustrated in FIGS. 54-57, a limb cover 1100 may be provided and may be attached around the first end 1102 of the limbs or limb pocket 1020, and provide a contact point 1101 for the actuator rod/cardan shaft 1025 of the motor/gear 1023, 1024. FIG. 56 provides one alternative design for such limb cover 1100. The extended portion providing a connecting point 1101 for the connector may be designed such that connecting points from both limb covers overlap as shown in FIGS. 54 and 55, and only one actuator rod/cardan shaft 1025 may be used to drive the movement of both first ends of the limb arms.

It is also within the scope of the disclosure to custom build a limb pocket 1020 having all the above described combined features and design of limb pocket and limb cover.

When in use, the limb coupler 1022 may be mounted but not tightened, and left to provide guiding for the pivot movement of the limb cover/limb pocket 1020, 1100 as it is drawn along axis 1218 towards the crossbow when motor 1023 is run and cardan shaft 1025 rotates into nut 1026 on the outside of the two meeting protrusions 1101 of the limb cover 1100.

Figure 48:
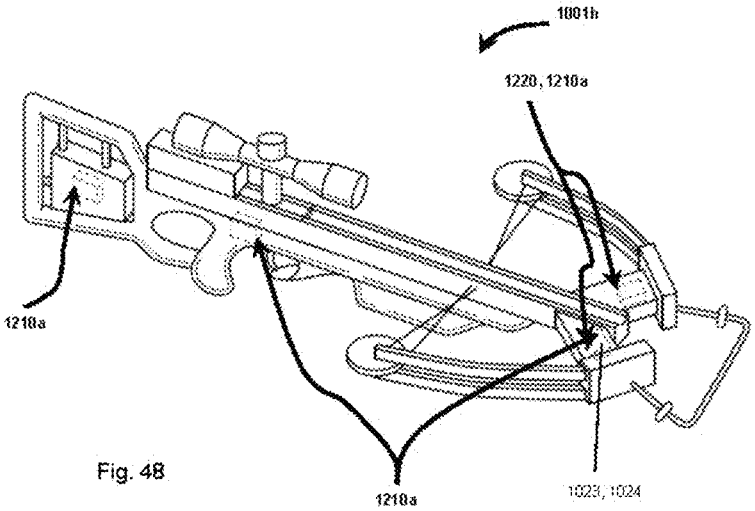
FIG. 48 is an isomeric view of an embodiment of a compound crossbow construction including dual power-assisting draw weight amplifier system.
Figure 62:
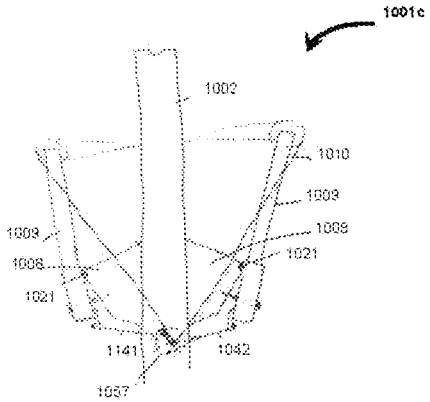
FIG. 62 is a top plan view of an embodiment of a reverse draw technology crossbow including the single power-assisting draw weight amplifier system.
Figure 63:
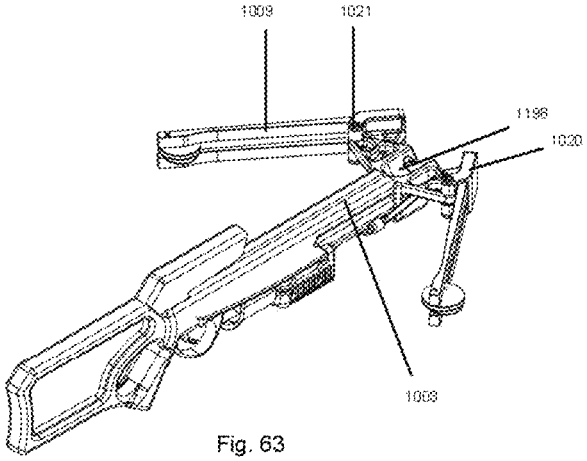
FIG. 63 is a rear isometric view of an embodiment of a single actuator acting on a pair of pulling elements connected to corresponding limb pockets viewed from an oblique backside angle.
Figure 64:
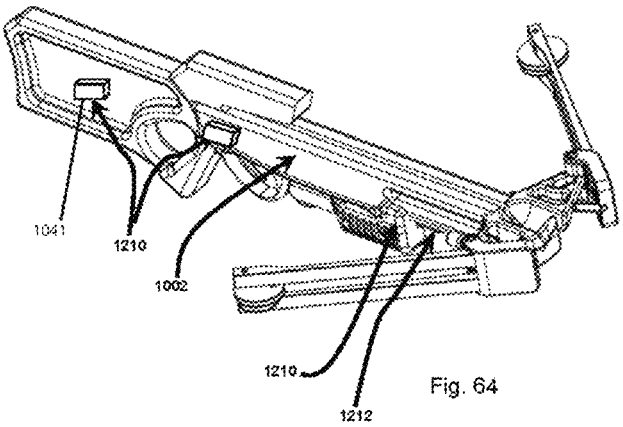
FIG. 64 is a left, side isometric view of the embodiment of FIG. 63 from an oblique forward angle.
Figure 65:
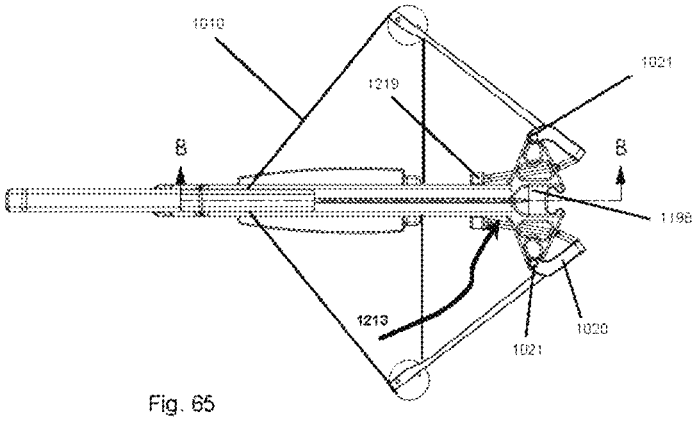
FIG. 65 is a top plan view of the embodiment of FIG. 63 from an above angle.
Figure 66:
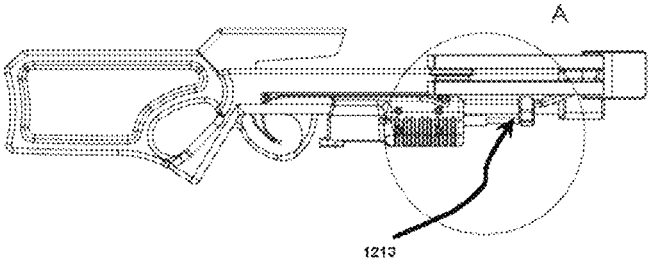
FIG. 66 is a left side elevation view of the embodiment of FIG. 63.
Figure 67A:
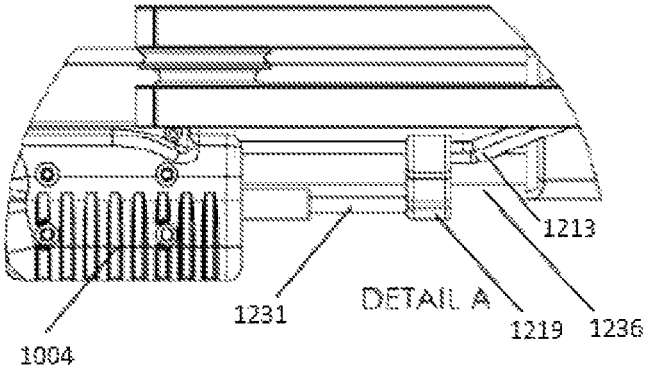
FIG. 67A is an enlarged, side elevation view of a first alternative embodiment of the actuator assembly.
Figure 67B:
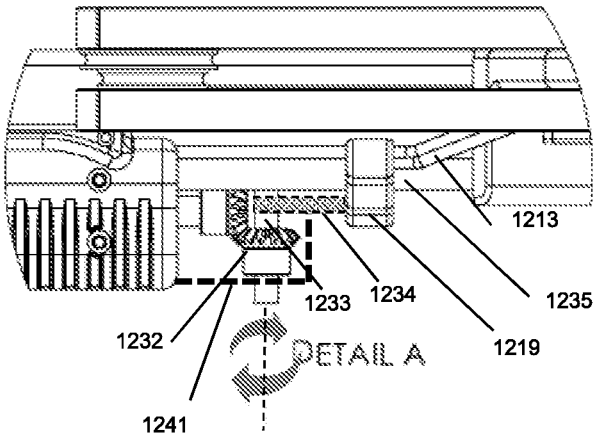
FIG. 67B is an enlarged, side elevation view of a second alternative embodiment of the actuator assembly.
Figure 67C:
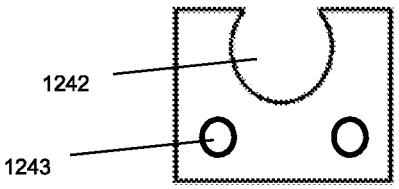
FIG. 67C is an elevation view of a side relief an alternative of the limb connector.

In a further embodiment, as described in FIG. 48, a dual power-assisting draw weight amplifier system 1210*a* is incorporated into or coupled to a crossbow 1001*b*. In this embodiment, amplifier system 1210*a* comprises a power-assisting draw weight amplifier assembly 1220. As illustrated in FIGS. 62-63, the amplifier assembly 1220 includes: (a) a first set of the motor 1023 and gear 1024, which are connected to adjustable first end of limb arms/limb pocket 1020 for altering the tension in the associated limb arms 1009; and (b) a second set of the motor 1023 and gear 1024, which are connected to adjustable first end of the other limb arms/limb pocket 1020 for altering the tension in the other limb arms 1009. Each such set includes an electromotor 1023 and optionally a mechanical gear solution 1024, such as a worm gear 1024. The amplifier system 1210*a* also includes an optional energy resource such as a battery 1041, electrical wiring (not shown) for connecting the power-assisting draw weight amplifier assembly 1220 to the energy resource 1041, and a switch device 1042 for controlling the operation direction and magnitude of which the power-assisting draw weight amplifier system 1210*a* shall operate. The power-assisting draw weight amplifier assembly 1220 can further comprise the connector assembly 1214 between the motor and gear and the limb pocket/limb arms 1020. In the embodiment illustrated in FIGS. 48, 52 and 53, however, the connector assembly 1214 is eliminated, and the limb couplers 1022, alone, couple the pockets 1020 to the risers 1008. Other connectors might be utilized. In an embodiment illustrated in FIG. 59, a switching device 1042 may comprise multiple positions indicating controlling operation effect and current direction of the electromotor 1023. The mechanical gear 1024 solution may be constituted of a worm gear 1024 assembly.

The power-assisting draw weight amplifier assembly 1220 may be arranged in the barrel 1002 construction or (as illustrated in FIG. 48) in both the risers 1008 of crossbow 1001*b*. The power-assisting draw weight amplifier assembly 1220 may be integrated into the barrel 1002 construction/frame. Although it is possible to retrofit the power-assisting draw weight amplifier assembly 1220 to conventional compound crossbows and other types of conventional crossbows and archery bows, such retrofitting may require cutting, custom fitting, mount kits or a combination thereof to achieve a stable and solid solution.

In an embodiment not illustrated, each of the amplifier systems 1210, 1210*a* includes a mount kit. The mount kit is configured to enable a user or assembler to permanently or removeably mount or otherwise attach the amplifier system 1210, 1210*a* (or any component thereof, such as assembly 1220) to a crossbow or other type or archery bow.

In an embodiment, each of the amplifier systems 1210, 1210*a* may be implemented by the manufacturer of the crossbow riser or fitted to half fabricate crossbows which, in the case of system 1210*a*, are prepared specifically for being fitted with the power-assisting draw weight amplifier assembly 1220 according to the disclosure. It is an option for the manufacturer to produce a dummy frame in the portion of the riser intended for the power-assisting draw weight amplifier assembly 1220, in order for the crossbow to be operational and stable even if the power-assisting draw weight amplifier assembly 1220 is not immediately installed. Typically, the limb arms and limb pockets are specifically designed to be used with the power-assisting draw weight amplifier assembly 1220.

Figure 49:
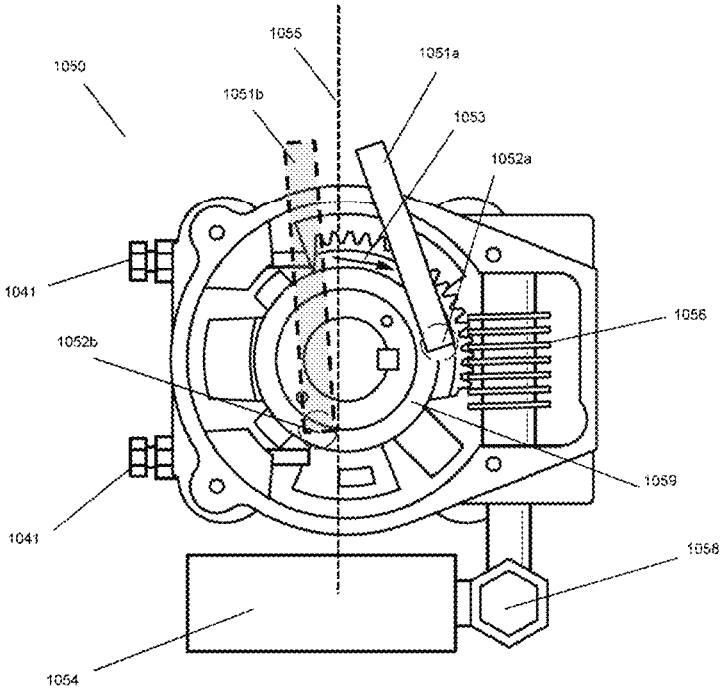
FIG. 49 is a diagram illustrating an embodiment of a worm gear.

In an embodiment, each of the amplifier systems 1210, 1201*a* comprises an electrical powered motor 1054 and gear, for example a worm gear 1050 as illustrated in FIG. 49, which may constitute the power-assisting draw weight amplifier assembly 1220 as shown implemented in FIG. 46 or 48. The gear 1050 comprises an actuator arm 1051*a*, 1051*b* connected to the gear wheel 1059 which in FIG. 49 is illustrated in two alternative positions. The actuator arm 1051*a*, 1051*b* may be connected to the first end of the limb arms/limb pocket 1020 for moving the limbs 1009 in the region of the limb couplers 1022. The solid line actuator arm 1051*a* illustrates the position when the actuator arm is in a non-tension amplifying position, whilst the dotted line actuator arm 1051*b* illustrates the position when the gear wheel 1059 has moved in the forward direction 1053, and the actuator arm is in a tension amplifying position. The motor may be an electromotor, pneumatic motor or pneumatic digital motor, spring based motor or other. By applying a positive power to the motor 1054, the force from the motor 1054 is transferred to the threaded rod 1056 via a gear 1058, and drives the gear wheel 1059, interacting with the sprocket teeth to move the actuator arm 1051*a*, 1051*b* from a first position to a second position. When reaching the second position, the gear rotation may be stopped by a physical stopper (not shown). The second position may be arranged to be at the return side of the center line 1055 of the gear wheel 1059. In this way, when the actuator arm 1051*b* is in the tension amplifying position, the second position, the reverse tension force from the limb arm will ensure that the actuator arm 1051*b* will remain in the tension position on the return side of the center line 1055 of the gear wheel 1059 until the worm gear actively drives the actuator arm 1051*a*, 1051*b* towards the non-tension position by reversing the action of the gear.

Figure 58:
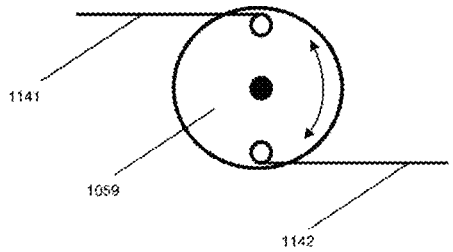
FIG. 58 is a plan view of an embodiment of a gear wheel pulling dual wires.

FIGS. 46-48 show each of the amplifier systems 1210, 1210*a* implemented on a Normal Draw Technology crossbow. Each of the amplifier systems 1210, 1210*a* may, however, also be implemented on crossbows designed according to a Reverse Draw Technology. As shown in FIG. 62, such a crossbow 1001*c* (shown in fragmentary view) has limb arms that rest on risers being arranged on the barrel in the longitudinal direction almost back at the level of the trigger, and the limb arms point forward (fork like). Since the risers in these designs typically offer a support face for the limb arms/pockets on surfaces mostly parallel with the barrels, the power-assisting draw weight amplifier assembly 1220 must exert a pulling force mainly diagonally to the barrelectric. One alternative for providing this may be to use one motor 1023 and one gear 1024 having a gear wheel 1059 comprising a wire/connecting device 1141, 1142 for each limb pocket as illustrated in FIG. 58 (only gear wheel shown), and when turning the gear wheel 1059, the wire connecting points will be moved from a start position to an end position wherein the first position will exert least assisted draw weight, and the second position will exert the most assisted draw weight to the limb pocket. This results in the limb pocket being pivoted around the pivot point 1021 and an increase in the tension in the limbs 1009.

Worm gears 1024, 1050 further provide the feature that they are practically unmovable by alternating forces exerted by the output side, the string and limbs. This means that it is possible to provide a holding force between the two above discussed end points of the worm gear, such as half-way or 90% of max string pull force, or any other level between 0 and 100%.

Figure 50:
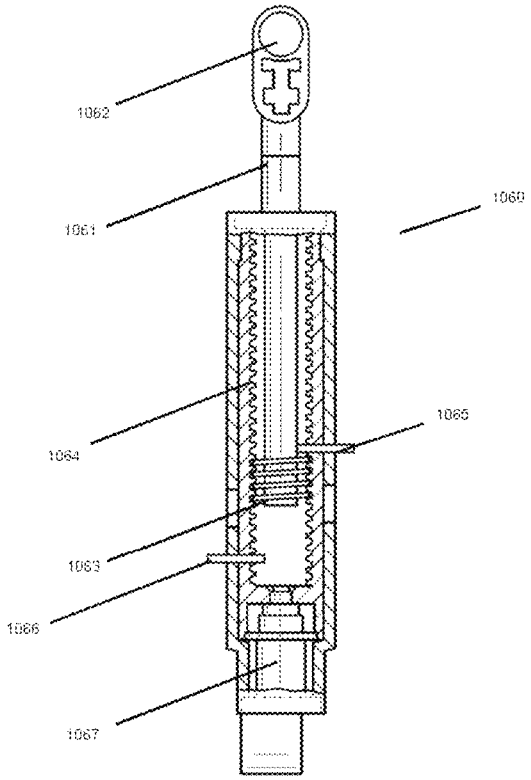
FIG. 50 is a diagram illustrating an embodiment of a linear actuator.
Figure 51:
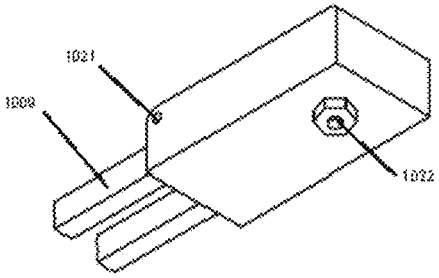
FIG. 51 is an isometric view of an embodiment of a limb pocket.

In a further embodiment illustrated in FIG. 50, each of the amplifier systems 1210, 1210*a* comprises a linear actuator 1060 comprising an electric motor 1067 connected to a spindle 1064 which is rotationally coupled to a nut 1063. The nut is connected to a first end of the actuator arm 1061, and the second actuator arm end 1062 is connected to the first end of the limb arms/limb pocket 1020 for moving the limbs 1009 in the region of the limb couplers 1022, is illustrated in FIG. 50. The electric motor 1067 provides the rotational force and movement to the spindle 1064. When the spindle 1064 rotates, the nut 1063 will translate the rotational movement to linear movement of the actuator arm 1061 and the actuator arm end 1062. The actuator arm end 1062 may be connected to the first end of the limb arms/limb pocket 1020 for moving the limbs 1009 in the region of the limb couplers 1022.

The linear actuator 1060 may also be arranged to have one or two stoppers 1065, 1066 to define a first and second end of the movement range of the piston rod 1061, wherein the first stopper 1065 defines a position for when the nut 1063 reaches the first stopper 1065 the first end of the limb arms/limb pocket 1020 is in a non-tension amplifying position. The second stopper 1066 defines a position for when the nut 1063 reaches the second stopper 1066, and the first end of the limb arms/limb pocket 1020 is in a tension amplifying position.

Linear actuators come in a variety of different designs, and FIG. 50 is only one optional design that may be used in the amplifier system 1210. It is within the scope of the disclosure to use any suitable linear actuator, substituting the one used in the example in FIG. 50.

It is within the scope of the disclosure to use any suitable spindle/screw actuator, substituting the one used in the examples shown in the Figs.

Figure 59:
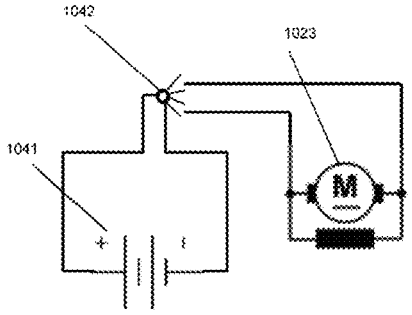
FIG. 59 is a schematic diagram illustrating an embodiment of an electrical configuration.

In the embodiments where an electrical motor and a power controller/switch 1042 as seen in FIG. 59, are operable to drive the motor in one direction when switch 1042 is in a first position, the switch 1042 may offer a plurality of positions. When the switch 1042 is in a second neutral position, there is no power connected to the motor, and when the switch is in a third position, the motor drives in a reverse direction. The switch 1042 may be biased or predisposed to be at rest in the second neutral position. The switch 1042 may further be of a momentary switch type requiring the switch 1042 to be continuously held in the first or third position to be able to feed the motor with power from the battery 1041, and thus providing high flexibility in when to start and stop the power supplied by the power-assisting draw weight amplifier system 1210.

In yet a further embodiment, each of the amplifier systems 1210, 1210*a* may be composed of a single actuator. The single actuator is comprised by one or more motors and a gear/spindle acting on a pair of wires (not shown) connecting each of the first end of the limb arms/limb pocket 1020 for moving the limbs 1009 in the region of the limb couplers 1022 with the output of the gear/spindle in such a manner that, when driving the motor in a first direction, both of the first ends of the limb arms/limb pockets 1020 for moving the limbs 1009 in the region of the limb couplers 1022 are pulled. This brings each limb arm end closer to the corresponding riser and thus increases the tension in a drawn string. When the motor/spindle is reversed, the first end of the limb arms/limb pocket 1020 for moving the limbs 1009 in the region of the limb couplers 1022 is moved in opposite direction, thus relieving some of the tension in the string.

Each of the power-assisting draw weight amplifier systems 1210, 1210*a* may advantageously be applied when the string 1010 can initially be pulled to a tension having approximately 50% of required tension, and let the power-assisting draw weight amplifier system 1210 add the final tension. However, in yet a further embodiment, each of the power-assisting draw weight amplifier systems 1210, 1210*a* may provide a solution for adding tension in a manner requiring little, minimal or no manual work by the shooter. In one example, the shooter may grasp a slideable grip (similar to a pump load grip type of a shot gun) for pulling the string 1010 back until reaching a latch, similar to the action provided by pump action shot guns. In such example, slideable grip is operatively coupled to the barrel 1002 and is also operatively coupled to the string 1010. Using either power-assisting draw weight amplifier system 1210, 1210*a* in such a scenario requires a longer angular movement capability of the limb pocket around the pivot point, as the first tension provided by the manual action will be less. This will typically be usable with a magazine type of loading and shooting multiple bolts in succession.

In an embodiment, each of the amplifier systems 1210, 1210*a* includes a movement sensor. The sensor is incorporated into or coupled to the worm gear, solenoid, or linear actuator. The sensor may be operable to identify their operation modus.

The sensor output may be displayed to the user via a display 1075, and/or they may be stored in a storage device (not shown) which may be comprised in the display unit 1075, for later transfer to a processing device for analysis. For example the output from sensors 1037 may be used for maintenance and adjustment purposes. In one embodiment, a wireless communication device may be connected to the sensors 1037 for communicating the sensor data to a remote device. The communication may be in real time.

Figure 60:
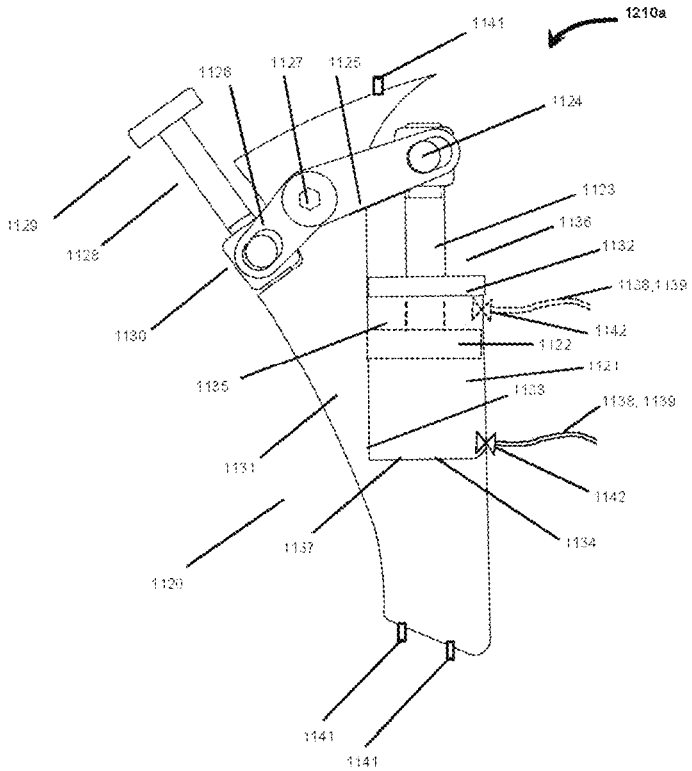
FIG. 60 is an elevation view of an embodiment of a pneumatic piston.

In a further alternative embodiment illustrated in FIG. 60, the amplifier system 1210*a* includes a plurality of power-assisting draw weight amplifier assemblies 1120 connected to the adjustable first end of limb arms 1009/limb pocket 1020 for controlling the tension in at least both the limbs 1009. The power-assisting draw weight amplifier assemblies 1120 are connected to an energy resource/storage 1041, such as a pressurized gas container, via supply lines 1138, 1139 such as air hoses. This connects, gas communication wise, the power-assisting draw weight amplifier assemblies 1120 with the energy resource 1041 via a valve/controller 1180 and switch device 1042. The actuator may be comprised of a pneumatic cylinder 1133/piston 1122 using compressed gas/air (or vacuum) at high pressure, or in further embodiments: a hydraulic actuator comprising a fluid motor using hydraulic power, or magnetic solenoids or the like using permanent magnets or electro magnets, and an energy resource such as a battery 1043. In the latter case, the supply lines 1138, 1139 will be comprised of electrical wiring. All actuators will use an energy reservoir, being one of pressurized gas or fluid stored or created in for example a pressure container 1041, or electrical energy stored in for example a battery 1041.

Figure 61:
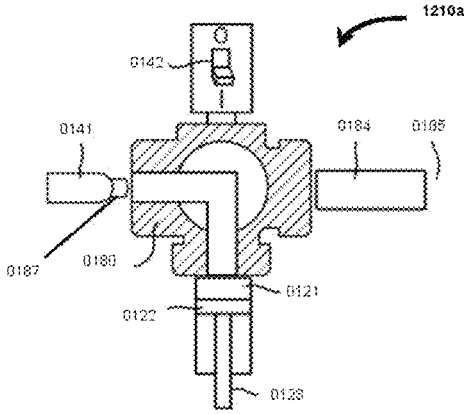
FIG. 61 is a diagrammatic, elevation view of an embodiment of a valve.

The power-assisting draw weight amplifier 1220*a*, shown in FIGS. 60 and 17, includes a pneumatic piston 122-cylinder 1133 assembly. The piston 122-cylinder 1133 assembly 1136 is comprised of a piston 1122 arranged in a cylinder 1133, wherein a pressure chamber 1121 is defined by the piston head 1122 surface and the cylinder side 1133 and bottom wall 1134. The cylinder 1133 may further be enclosed by a cylinder top 1132, wherein the cylinder top 1132 comprises a conduit through which a piston rod 1123 is arranged. The pressure chamber 1121 is in pneumatic gas communication, via a gas/air hose 1138, 1139, through a conduit 1142 in the cylinder bottom wall 1134 or lower part of the cylinder wall 1133, with a pressurized gas reservoir 1041. A valve 1180, as shown in FIG. 61, between the gas reservoir 1041 and the pressure chamber 1121 controls the transfer of gas between the gas reservoir 1041 and the air hose 1138, 1139 connected to the pressure chamber 1121, and between the pressure chamber 1121 via the air hose 1138, 1139 and a pressure relief reservoir 1185. The pressure relief reservoir 1185 may be comprised by the surrounding "free air". The power-assisting draw weight amplifier 1220*a* further comprise a lever/actuator arm 1125, 1126, 1127 wherein the lever arm 1125, 1126, 1127 is arranged to transfer the force generated by the expanding pressure chamber 1121 via a cardan shaft 1128 to the limb arms/limb pocket 1020 for moving the limbs 1009 in the region of the limb couplers 1022 in a way that when the pressure chamber 1121 is expanded, the piston rod 1123 connected to the moving piston 1122 will pivot the lever arm with the effect that the attached first end of the limb arms/limb pocket 1020 for moving the limbs 1009 in the region of the limb couplers 1022, is drawn towards the crossbow risers 1008, and the pulling force on the first end of the limb arms/limb pocket 1020 for moving the limbs 1009 in the region of the limb couplers 1022 is translated to an increase in the tension in the limbs 1009 and the crossbow string 1010, and hence the draw weight is increased. The cardan shaft may be the limb coupler itself, thus the limb coupler may be arranged to be fastened directly to the lever arm 1125, 1126, 1127 via a connection point 1130.

The valve 1180 may be manually or electrically adjustable for adjusting gas pressure output level, and may additionally comprise an adjustable output gas volume regulator for controlling the output gas flow speed and/or the amount of gas volume outputted from the valve each time the switch 1042 is operated to activate a gas feed cycle.

In one embodiment of the amplifier system 1210*a*, the lever arm 1125, 1126, 1127 comprise a resistance arm 1126, an effort arm 1125 and a fulcrum 1127. In a first outer end of the lever arm, the effort arm 1125 is connected to a first end 1124 of a piston rod 1123 which in its opposite second end is connected to the piston 1122. In the other second end of the lever arm, the resistance arm 1126 is connected to the first end of the limb arms/limb pocket 1020 for moving the limbs 1009 in the region of the limb couplers 1022. The lever arm rotates around a fulcrum 1127 (pivot point) such that when the pressure in the pressure chamber 1121 increases, the effort arm 1125 is moved away from the pressure chamber 1121 by the piston 1122 and piston rod 1123, and the resistance arm 1126 will act on and exert a pulling force on the first end of the limb arms/limb pocket 1020 for moving the limbs 1009 in the region of the limb couplers 1022. The ratio between the effort arm and the resistance arm defines the force amplification from the force applied by the cylinder rod effective on the first end of the limb arms/limb pocket 1020 for moving the limbs 1009 in the region of the limb couplers 1022.

$$F\text{limbbolt}=(L\text{effort}/L\text{resistance})*F\text{cylinderrod}$$

In a further embodiment of amplifier system 1210*a*, the cylinder 1133, piston 1122 and piston rod 1123 may be coupled directly to the first end of the limb arms/limb pocket 1020 for moving the limbs 1009 in the region of the limb couplers 1022. The pressure chamber 1135 for the cylinder will then be at the opposite side of the piston 1122, namely on the side of the piston rod 1123. The cylinder side wall 1133 will be similar as the above example, but the cylinder top 1132 comprise an air tight conduit for the piston rod/actuator arm 1123 to be arranged inside, the piston rod 1123 protruding outside the cylinder 1133 and is directly connected to the first end of the limb arms/limb pocket 1020 for moving the limbs 1009 in the region of the limb couplers 1022. In this embodiment, the cylinder will be open on the side 1121 of the piston not being connected to the piston rod, the opening has atmospheric pressure by an opening in- or absence of—the cylinder bottom wall 1134. In this embodiment, there will be no amplification of the force applied to the first end of the limb arms/limb pocket 1020 for moving the limbs 1009 in the region of the limb couplers 1022 by the pressure increase in and expansion of the pressure chamber 1135; hence, the gas pressure supplied to the power-assisting draw weight amplifier assembly is higher. Therefore, also a more robust design is provided. The design is further adapted to the reduced piston surface area as a result of the piston rod being mounted on the active piston surface side. The size of the cylinder and piston is adapted correspondingly to be able to execute the required force on the first end of the limb arms/limb pocket 1020 for moving the limbs 1009 in the region of the limb couplers 1022. A corresponding conduit 1142 and pressure gas/air hose 1138, 1139 (drawn in dotted line in FIG. 60) will be arranged in either the cylinder top 1132 or in the cylinder wall 1122 close to the cylinder top 1132.

The two latter described embodiments are both pneumatic pressure chamber devices, and the energy storage 1041 is comprised of a pneumatic accumulator. A pressure pipe/air hose connects the pneumatic accumulator 1041 to the power-assisting draw weight amplifier assemblies via a pipe/air hose 1138, 1139. The connection further comprises a valve 1180 for controlling the gas flow through the pressure pipe/air hose 1138, 1139 such that the pressure chamber 1121, 1135 of the power-assisting draw weight amplifier assemblies 1120 is in pneumatic communication with the pneumatic accumulator 1041. The valve 1180 may further be functioning as a pressure reduction valve (not shown), since the pressure in the accumulator 1041 normally is much higher than what is required by the power-assisting draw weight amplifier assemblies 1120 to work. This is the case at least when the pneumatic accumulator is fully charged. The pneumatic accumulators 1041 may be replaceable and/or rechargeable. Although the accumulator may be arranged in any place on the crossbow assembly, it is advantageously to arrange it in a location where it will influence as little as possible on weight balance and resonance of the crossbow operation.

In a further embodiment of amplifier system 1210*a*, the valve 1180, reduction valve and for example a silencer 1184 may all be comprised in an attachable, pneumatic accumulator assembly. In such an embodiment, the elements of the disclosure comprised in the crossbow may be fewer, hence cheaper and faster to produce, and easier to maintain. The pneumatic accumulator assembly may be comprised of individual parts assembled before being mounted to the crossbow. A pneumatic accumulator assembly consisting of individual mountable/exchangeable parts such as pneumatic accumulator 1041, reduction valve 1187 and silencer/muffler 1184 may be advantageous since there is a difference in lifespan of the different parts, which means they require replacement at different intervals. The valve 1180 has a much longer lifetime then the silencer/muffler 1184, which again has a longer lifetime than the pneumatic accumulator 1041.

The switch 1182 may be operated between two or more positions, where each position uniquely defines a valve 1180 and/or pressure mode. Another switch type offers only one operation mode (such as a push button) which may toggle the different modes of the valve.

It is within the scope of the disclosure to use a digital switch and an electrically powered valve. The switch may offer a display to identify the current state of the switch, and identify selectable switch modes.

When a bolt is released in a shooting cycle or the shooting cycle is aborted, the cylinder 1022 may be moved back to its initial position biased by the setup tension in the crossbow string and the limb arms in next loading session.

Each of the amplifier systems 1210, 1210*a* may comprise a display 1075, such as for example an identification light, digital screen or electrical/non-electrical gauge/meter coupled to one or more sensors 1037 to identify the tension status of the actuators, limbs and/or string. For example can a green light be configured to identify that the string tension has reached the required tension, and a red to identify that the string tension returned to a lower thresholds value. It would be advantageous to use a low intensity light in order to minimize the risk that a game could be disturbed or warned by the light. In case the display 1075 requires electrical power, at least a power source is incorporated in the display 1075 or is attachable to external power source. The external power source may be the power accumulator 1041.

In an embodiment, each of the amplifier systems 1210, 1210*a* includes optional sensors 1037 for detecting one or more of tension level, battery power level, gas pressure, movement, temperature, and other parameters throughout the applicable power-assisting draw weight amplifier system 1210 or 1210*a*.

In one embodiment, the implementation of the switch/valve 1180 of amplifier system 1210*a* may be for operation in a manual operation mode, meaning it has to be actively switched between operation modes. The intention is that, under operation of the crossbow, it is desirable to be able to activate the power-assisting draw weight amplifier 1210*a* after the crossbow string 1010 is fully drawn and when a bolt release is imminent. If bolt release is aborted or delayed, it is possible to switch the power-assisting draw weight amplifier system 1210*a* to a relieve state which results in the extra tension to be reversed, and return the power-assisting draw weight amplifier 1210*a* back to initial state. If the power-assisting draw weight amplifier assemblies 1120 include a worm gear, solenoid or linear actuator, the piston rod/axle of the worm gear or linear actuator is movable between at least two positions defining a crossbow string tension amplifying position, and a crossbow string non-tension amplifying position.

The valve may, in the a worm gear or solenoid version, provide a stepwise movement of the first end of the limb arms/limb pocket 1020 for moving the limbs 1009 in the region of the limb couplers 1022, or in the case of using pneumatic version of the tension amplifier, be implemented to offer a stepwise reduction valve feature, such that it can be operated to "give" pressurized gas at different pressure, for example two states where the gas can be supplied, for example, at either 3 or 5.0 atm. Such steps may be adjustable by an indicator on the valve, or by a selection mode on the switch. Another option is to design the switch such that the valve allows a portion of pressurized gas to flow from the accumulator 1041 each time the switch is operated, such that it is possible to stepwise increase the pressure in the pressure chamber.

In one embodiment, the switch 1042 may be operated in a semi-automatic or automatic manner. One example is that the switch/valve may be automatically switched to a relieve state when the crossbow string is released. This may be achieved by connecting the switch/valve control to a sensor on the crossbow riser/latch or other.

In a further embodiment, each of the amplifier systems 1210, 1210*a* includes a switch for setting the operation of the draw weight amplifier in a fully automatic operation mode. The fully automatic operation mode will automatically switch the draw weight amplifier to the load state once the crossbow string is drawn, and to the relieve state once the bolt is released. The switch may in this case be connected to sensors detecting string position. In this operation mode, the switch/valve operation may be controlled in various manners. One is to let a tension sensor identify when the crossbow string is drawn, and then activate the load state of the draw weight amplifier. Such sensors may be arranged in the latch, or on one or both limbs 1009 of crossbow 1001*a* or 1001*b*. Other arrangements for detecting the bolt draw and release phase may be facilitated by the skilled person.

The semi-automatic and/or automatic operation modes may be fully mechanical or part/full electrical powered.

The limbs/limb pockets pivot angle controls the tension in the limb arms 1009 of compound crossbows 1001*a*, 1001*b*, 1001*c*. The limb arms 1009 of the crossbow typically are mounted to the crossbow riser 1008 in one end, the connector can include a pivot member or pivot point 1021 and a limb coupler point 1022. The pivot point 1021 is a connection point between the limb 1009 and the riser 1008 at which the limb 1009 can pivot as far as the adjustment of the limb coupler 1022 allows. In the other end of the limb, a cam 1012 or idler 1013 wheel may be arranged. The adjustment range of the limb pocket relative the riser when the string is drawn may be described in the max tension required to draw the crossbow, e.g., 60-80 lbs. or more. The effect of the force transferred to the first end of the limb arms/limb pocket 1020 for moving the limbs 1009 in the region of the limb couplers 1022 when the gear is activated, when initial draw weight is set to require 140 lbs. for drawing, is the result of the additional force generated by the motor and transferred by the worm gear to increase the crossbow string tension to, for example, 200 lbs.

When the power-assisting draw weight amplifier system 1210*a* comprises a worm gear or linear actuator 1023 or 1060, as shown in FIGS. 49 and 50, the worm gear or linear actuator 1023 or 1060 may be driven by an electrical motor. In the case of electrical motor, wiring 1138, 1139 (FIG. 60) transfers electrical power from the electric power accumulator 1041, such as a battery 1041. A directional switch provides forward and reverse function of the worm gear or linear actuator such that, for example, when the worm gear or linear actuator assembly is used when the power-assisting draw weight amplifier assembly is in the load state pulling at the limb arms/limb pocket 1020 for moving the limbs 1009 in the region of the limb couplers 1022, the cardan axle is retracted, and when in the relieve state, the axle is moved to its extended position.

When an electrical motor is used, as in the case of the power-assisting draw weight amplifier system 1210*a* comprising the worm gears or linear actuators, the power source may be fed by an electrical accumulator, wherein the electrical accumulator, such as a battery 1041, is connected to the crossbow 1001*a* or 1001*b* in the same manner as described above, or the electrical accumulator is remote and, for example, carried by the user of the crossbow 1001*a*, 1001*b* or 1001*c*. A connecting cable may then in a first end be attached to the accumulator, which may be a battery 1041, and in the other end be connected to a connection point provided in the crossbow assembly. The electrical current provided by the accumulator may then be led by electrical wiring from the connecting point to the worm gears or linear actuators via the directional switch device.

The contact point may be arranged in the grip area of the crossbow 1001*a*, 1001*b* or 1001*c*. The power reservoir, whether it is an electrical power source, a gas accumulator, or fluid accumulator may be provided in different sizes, typically customized for intended use and practical adjustments.

In a further embodiment, each of the amplifier systems 1210, 1210*a* involves utilizing a cam-action for controlling the movement of the limb arms/limb pocket 1020 for moving the limbs 1009 in the region of the limb couplers 1022, and driven by the above described actuators, for example the worm gear or the pneumatic pressure arrangement to rotate the cam. The advantage with using a cam is that it will allow a defined action complete state. The cam can be designed to have a contact orbit which contacts the upper side of the connector to the limb arms/limb pocket 1020 for moving the limbs 1009 in the region of the limb couplers 1022, and be rotating around the fulcrum in the case the actuator is a pneumatic pressure arrangement, and in the case a worm gear, is used as an actuator so that the cam may rotate around the center of the gear wheelectric.

In a further embodiment, each of the amplifier systems 1210, 1210*a* involves using the tension amplifying assembly to increase the distance between the limb arms and the riser in a connection point of the pivot point, pushing the pivot point 1021 rather than pulling the first end of the limb arms/limb pocket 1020 for moving the limbs 1009 in the region of the limb couplers 1022. In practice, this comprises mounting the pivot point to a movable pivot base providing a distance between the riser and the limb pocket in the region of the pivot point, and being able to move the pivot base by the piston rod/axle of the worm gear or linear actuator in a manner that, when the switch is in load position, the pivot point moves closer to the first end of the limbs 1009 increasing the tension in the crossbow string, and when the switch is in the relieve state, the pivot point is moved back away from the first end of the limbs and thus relieve the tension in the crossbow string.

In an embodiment, in the event the power-assisting draw weight amplifier system 1210 or 1210*a* is included in the production phase of a crossbow itself, all parts may be integrated into the barrel or the riser or a combination thereof, and the crossbow construction itself will provide support and mounting arrangements for the different parts of the power-assisting draw weight amplifier system 1210 or 1210*a*, as applicable.

In the case the power-assisting draw weight amplifier assembly 1020 is retrofitted, it can further require that the riser be modified or arranged for mounting pipes/cabling, switch, valve, sensor and the like described above.

In an embodiment, a crossbow (including, but not limited to, crossbow 1001*a*, 1001*b* or 1001*c*) is manufactured, fabricated, formed or structured according to a method. The method of structuring a crossbow, in an embodiment, includes: (a) providing a crossbow body that includes a barrel; (b) structuring or configuring the body to house or receive an energy resource and a switch device; (c) structuring or configuring the barrel to house or receive a motor and a motion translator; and (d) coupling the motion translator to the limbs of the crossbow.

In another embodiment illustrated in FIGS. 68A-71, the present invention relates to crossbows. In particular, the invention relates to a limb arms energizing device. The present invention builds on earlier patent applications which are hereby copied in their whole.

Disclosed herein is a device for altering energizing level in a wire of a crossbow having a cable tension device, and an energizing device, wherein the energizing device is connected to the wire tension device and the energizing device is able to move the position of the wire tension device in two opposite directions.

In an embodiment, a device is operable for altering energizing level in a wire of a crossbow with a stock and two limbs. The device comprises a cable tension device, an energizing device, two cam assemblies arranged on corresponding limb end, and a wire connected via the wire tension device to the cam assembly. The energizing device is connected to the wire tension device, and the energizing device is able to move the position of the wire tension device in two opposite directions. Depending on the embodiment, the wire tension device can be arranged inside a stock of the crossbow, the wire tension device can be movable in a longitudinal direction relative the stock, or the wire tension device can be movable in a transversal direction relative the stock.

In order to facilitate understanding of the invention and explain how it may be worked in practice, non-limiting examples will be described with reference to the accompanying drawings.

In the following description of various embodiments, reference will be made to the drawings, specifically drawing numbered as FIGS. 68-71, in which like reference numerals denote the same or corresponding elements. The drawings are not necessarily to scale. Instead, certain features may be shown exaggerated in scale or in a somewhat simplified or schematic manner, wherein certain conventional elements may have been left out in the interest of exemplifying the principles of the invention rather than cluttering the drawings with details that do not contribute to the understanding of these principles.

It should be noted that, unless otherwise stated, different features or elements may be combined with each other whether or not they have been described together as part of the same embodiment below. The combination of features or elements in the exemplary embodiments are done in order to facilitate understanding of the invention rather than limit its scope to a limited set of embodiments, and to the extent that alternative elements with substantially the same functionality are shown in respective embodiments, they are intended to be interchangeable. For the sake of brevity, no attempt has been made to disclose a complete description of all possible permutations of features.

Furthermore, those with skill in the art will understand that the invention may be practiced without many of the details included in this detailed description. Conversely, some well-known structures or functions may not be shown or described in detail, in order to avoid unnecessarily obscuring the relevant description of the various implementations. The terminology used in the description presented below is intended to be interpreted in its broadest reasonable manner, even though it is being used in conjunction with a detailed description of certain specific implementations of the invention.

The present invention provides several aspects that can be combined into a system for improved energizing of the activated limb arms by introducing mechanical motion to a cable tension device.

The cable tension device provide movement of one or two brackets 211, 221, 231 depending on the cable concept chosen.

Figure 68A:
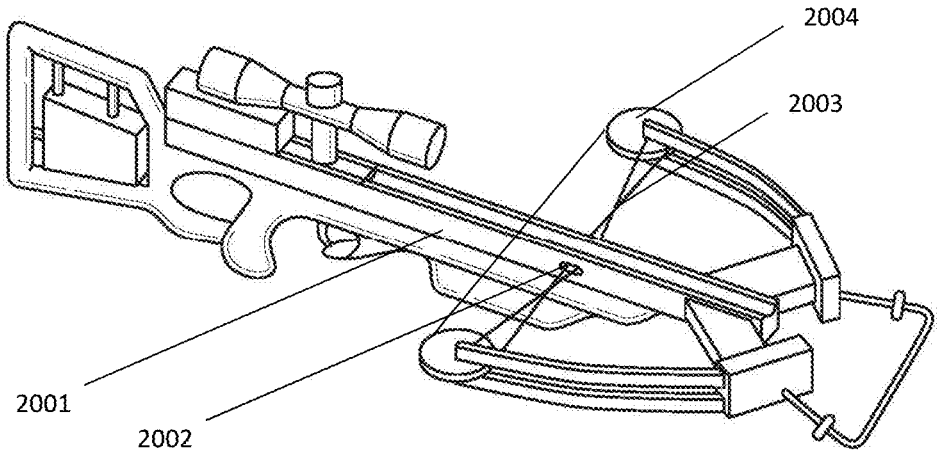
FIG. 68A is an isometric view illustrating a crossbow with a cable through barrel.
Figure 68B:
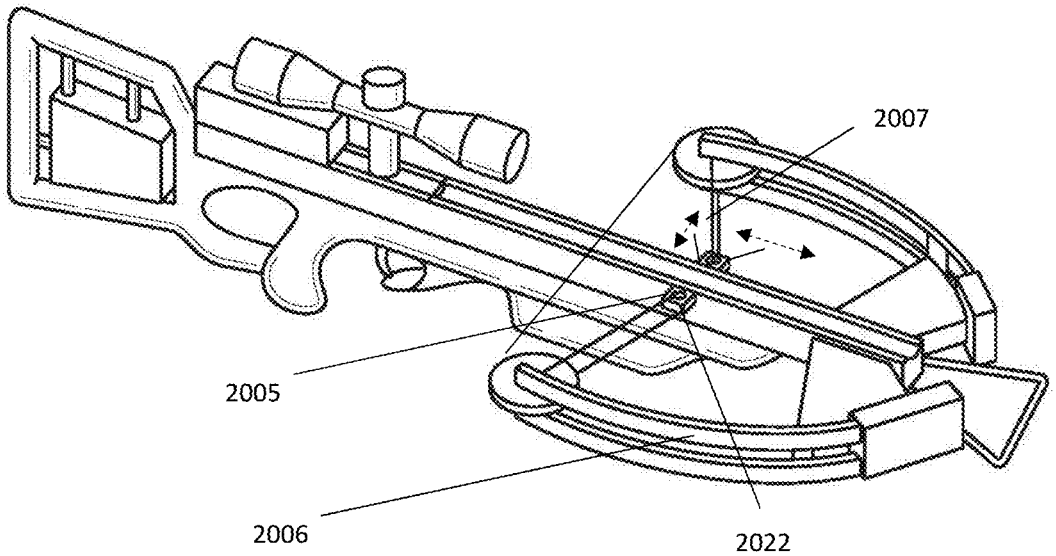
FIG. 68B is an isometric view illustrating a crossbow with four cables in two pair, each pair connected to corresponding side of barrel.
Figure 68C:
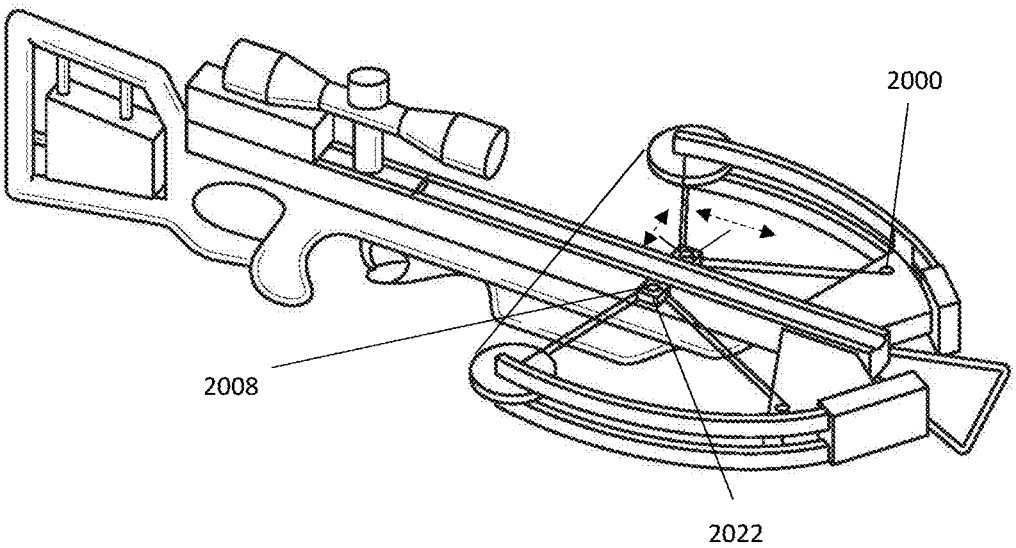
FIG. 68C is an isometric view illustrating a crossbow with four cables in two pair, each pair connected via bearing/wheel to corresponding side riser portion.
Figure 69A:
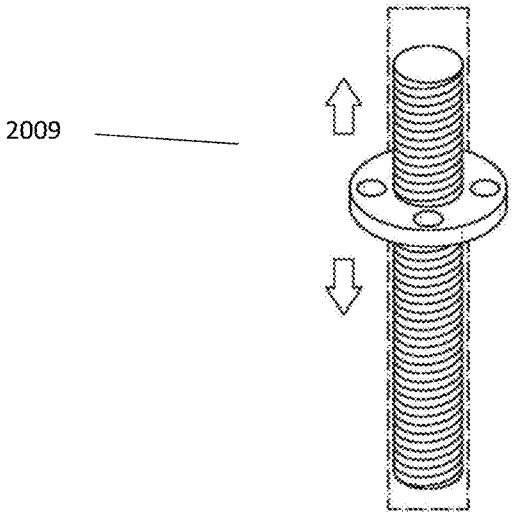
FIG. 69A is an isometric view illustrating an example of actuator shaft.
Figure 69B:
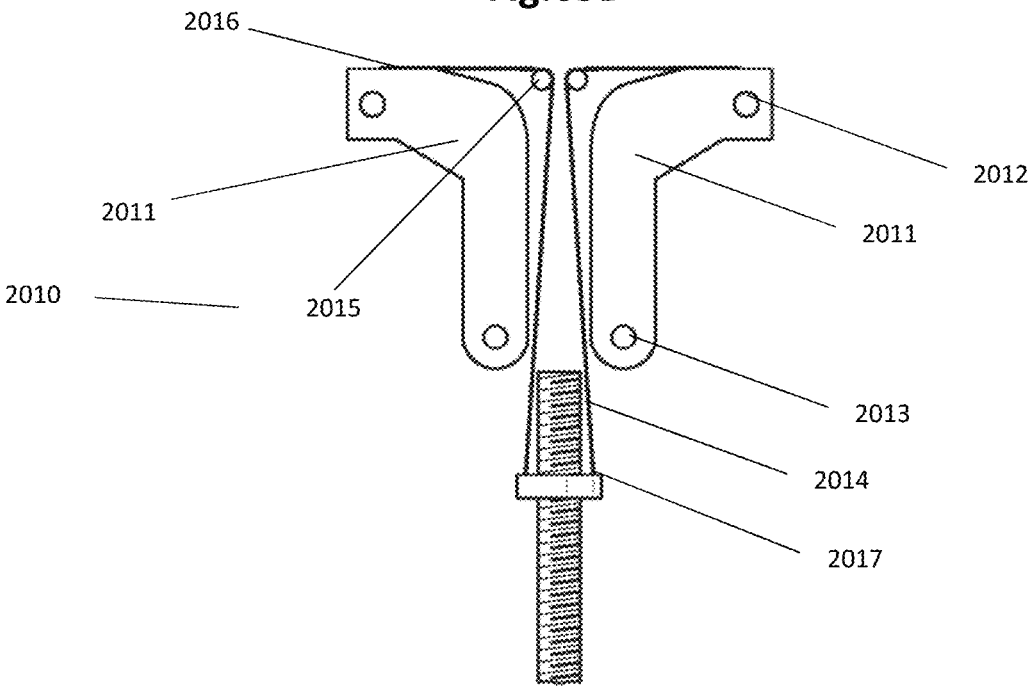
FIG. 69B is a top view illustrating moving brackets in energized position.
Figure 69C:
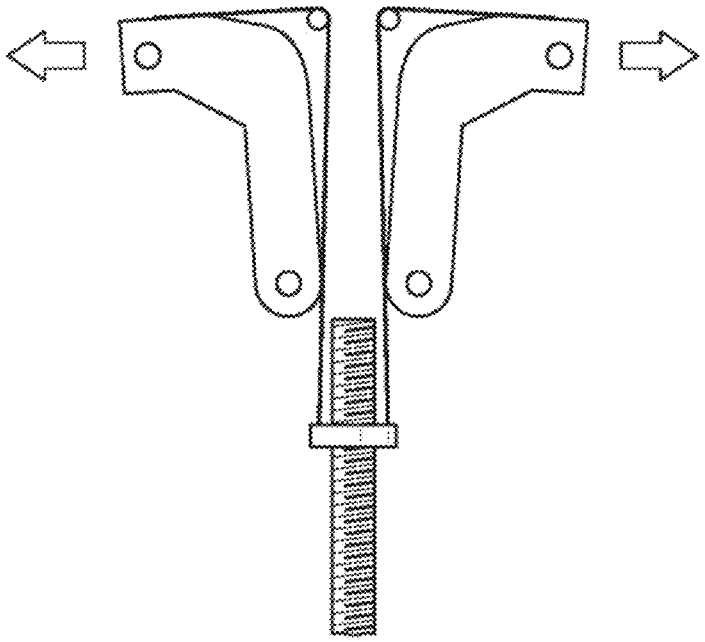
FIG. 69C is a top view illustrating moving brackets in non-energized position.

For a traditional crossbow design as shown in FIG. 68A, the cables runs through 2002 the barrel 2001 between the cam assemblies 2004. The cable tension device of present invention, exemplified in FIG. 71 may be arranged inside the barrel 2001 and comprise an actuator 2009 shaft with a moving bracket which will be energized by an electric motor/actuator, pneumatic actuator or the like, such as for example is exemplified in the attached earlier application. The cable 2003 path when passing the barrel 2001 is constructed to loop around a cable barrel bracket 2031 of the actuator 2009 via a pair of cable barrel bearings 2032.

Operation of the invention is such that when the crossbow string is pulled to the latch for firing a bolt, the cable tension device 2030 moves the cable barrel bracket 2031 forward or aft relative the latch, to increase the path of the cable 2003 and thus increase the tension in the cable further, resulting in an even more energized cable 2003. Operating the cable tension device 2030 in reverse will shorten the path of the cable 2003 and thus decrease tension in cable.

New development in crossbow design has resulted in slimmer design arranging the limbs more parallel to the barrel 2001. Two orientations of the limbs are possible. One is the so-called reverse draw having the limb arms 145 connection to the barrel 2001 towards the latch and the limb arms point forward having the cams 2004 arranged in the forward pointing limb arm end, as exemplified in FIG. 1. The other orientation of the limb arms 2006 is the attachment to the barrel 2001 at a forward location towards the front end of the barrel 2001, and the cams 2004 arranged at the limb arm ends closer to the latch area of the barrel 2001 such as exemplified in FIGS. 68B and 68C.

Common to slimmer design crossbows is that the cable not necessarily connect between the two cam assemblies 2004, but are individually attached to a connection point on a cable connecting point 2000, 2005 on the same side of the barrel 2001 as the cam assembly 2004, either via a direct path from cam assembly 2004 to the cable connection point 2005, or cable is connected to the cam assembly 2004 via a cable bearing 2008 to the cable connection point 2000. In the latter example, the cable bearing 2008 may be arranged on a bracket 2022 being part of or arranged on the barrel 2001.

The cable tension device is, in the slim designs, arranged to move the cable connection point 2005 or the cable bearing 2008.

In a first embodiment, the cable connection point 2000, 2005 is arranged on a movable cable connection point bracket 2011, 2021, wherein the movement is provided to increase the tension in the cable.

In one example embodiment of the brackets 2011 (moving brackets 2011 or pivot brackets 2011) and an actuator 2009 are connected via bracket cable pair 2014 to a cable connecting point 2016 on each of the pivot brackets 2011, where each pivot bracket further is pivotal around a bracket pivot point 2013. The actuator 2009 is arranged in a longitudinal orientation of the crossbow such that an actuator cable connection point 2017 moves in the longitudinal direction as a result of actuator action. In one embodiment, the pivot bracket 2011 is provided with a pivotal movement pattern arranged to pivot around the pivot point 2013 arranged in a first end of the bracket, and the cable connection point 2016 is arranged at a second end of the pivot bracket 2011. The bracket cable pair 2014 is connected in a first end to the actuator cable connection points 2017, and runs from the actuator 2009 where the actuator 2009 is arranged peripheral in longitudinal direction of the pivot bracket 2011 and the first end of the bracket 2011. The bracket cable pair 2014 is, in its second end, connected via a bracket cable bearing 2015 to the second end of the pivot bracket 2011 such that, when the actuator 2009 is in a first status, the bracket cable pair 2014 enables the pivot bracket 2011 to be pivotally moved outwards such that the cables connecting to the cam assemblies are relaxed. The actuator 2009 may, when energized, move the actuator connection point of the bracket cable pair 2014 away from the brackets themselves, and increase the tension in the bracket cable pair 2014. The increased tension in the bracket cable pair 2014 will result in pivoting the pivot brackets 2011 such that the second ends of the pivot brackets 2001 are moved closer to the barrel 2001, and the tension in the cables connected to the cam assemblies 2004 will increase.

Figure 70:
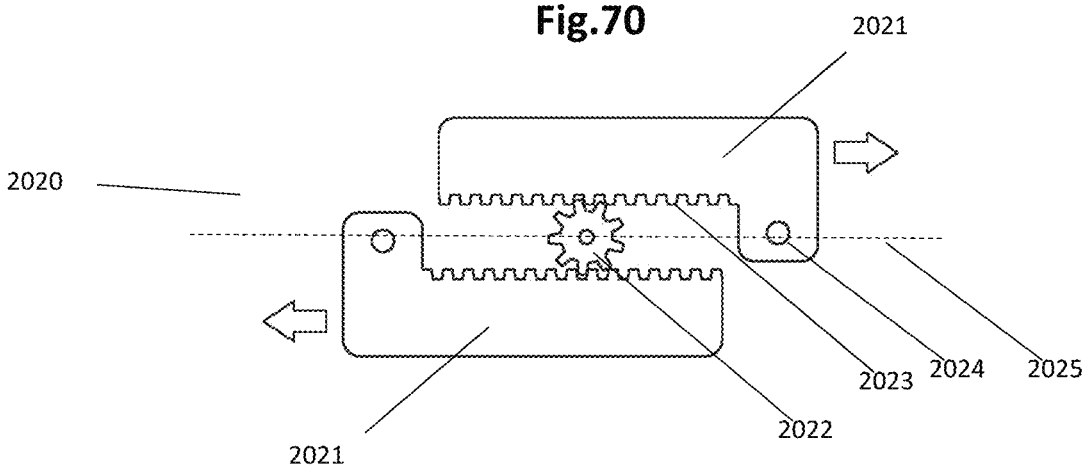
FIG. 70 is a top view illustrating rack and pinion type brackets.
Figure 71:
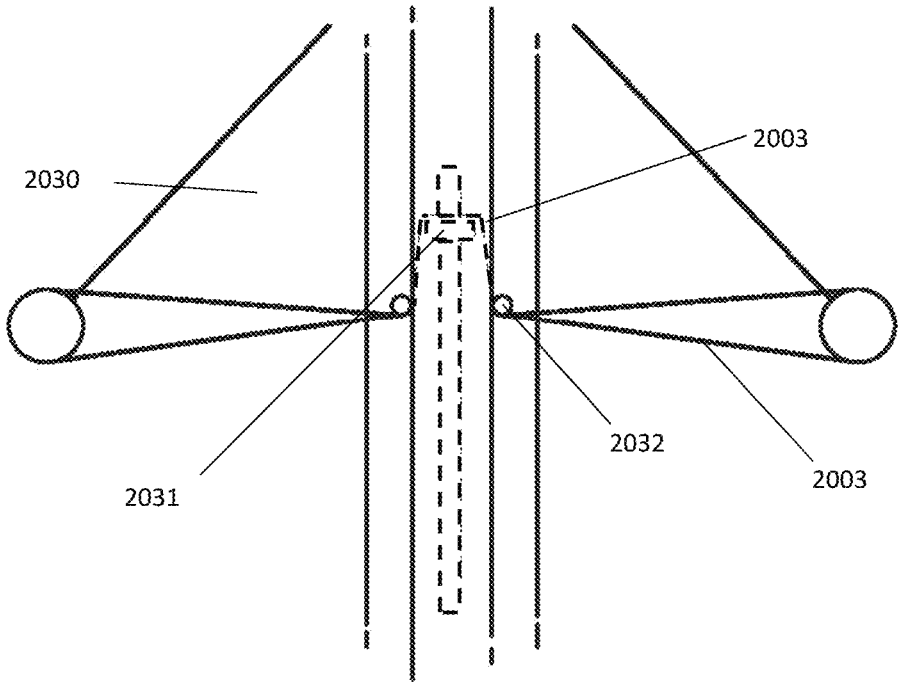
FIG. 71 is a diagram illustrating two cable energizers inside/under barrel.

In an even further embodiment of the moving brackets 2011 shown in FIG. 70, transversal moving brackets 2021 have movement that is accomplished through connecting the actuator spindle via a rack 2023 and pinion 2022 gear (or the like), wherein rack 2023 grooves may be designed on the brackets 2021, and each transversal moving bracket 2021 is transversally moving relative the longitudinal direction of the barrel 2001. The transversal moving brackets 2021 comprise a first end having a "saw tooth" pattern 2023 intended to connect to the pinion gear 2022, and a cable connection point 2024 in a second end, wherein the cable connection points 2024 are arranged to be moved along a transversal axis relative the barrel 2001, such that there are no skew forces involved when cables are energized. The latter is typically accomplished by having a movement pattern of the cable connection points 2024 of each respective transversal moving bracket 2021 moving symmetrically along pull force line 2025 running through the center of the pinion 2022. Each transversal moving bracket 2021 connects to the rack and pinion gear 2022, 2023 such that, when the pinion rotates, each bracket 2021 is connected to the pinion 2022 on opposite sides of pinion 2022, and when pinion 2022 rotates in a first direction the transversal moving brackets 2021 move outwards relative the barrel 2001, and when the pinion gear 2022 rotates in a second direction the transversal moving brackets 2021 move inwards relative the barrel 2001. Outward movement of the transversal moving brackets 2021 releases tension in the cables, and inward movement of the transversal moving brackets 2021 increases the tension in the cables.

In an even further embodiment of the invention for use with a slim limb design embodiment, the cable connection point on the barrel 2001 is provided by a bracket, wherein such bracket is provided a feature where such bracket itself is movable in longitudinal direction. Thus, an actuator output is connected to an actuator connection point of such bracket, and when the actuator is energized, it may move such bracket forward or aft depending on rotation direction of the actuator gear. When the cable is connected between the cam assembly 2004 and the cable connection point, the cable connection point may be arranged on a movable bracket, and hence the energized tension level in the cables may be altered by moving such bracket in longitudinal direction. The same principle may be used by providing a movable bracket for comprising the cable bearing for providing a variable angle of the cable between the cam assembly 2004 and a fixed cable connection point, and thus being able to increase or decrease the tension in the cable.

Common for all these implementations of the cable tension devices is the efficient length between the cam assemblies 2004 and the barrel/bracket—longer for easing up the tension and shorter for increasing the energizing level in the cables.

Additional embodiments include any one of the embodiments described above, where one or more of its components, functionalities or structures is interchanged with, replaced by or augmented by one or more of the components, functionalities or structures of a different embodiment described above. For example, an additional embodiment of a power-assisting draw weight amplifier system includes any suitable combination of any components or elements of power-assisting draw weight amplifier systems 1210 and 1210*a*. Likewise, an additional embodiment of a crossbow or archery bow includes any suitable combination of any components or elements of crossbows 1001*a*, 1001*b* or 1001*c*.

Additional embodiments include any one of the embodiments described above, where one or more of its components, functionalities or structures is interchanged with, replaced by or augmented by one or more of the components, functionalities or structures of a different embodiment described above.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. An archery bow comprising:
a body;
a first limb coupled to the body;
a second limb coupled to the body;
a draw cord coupled to the first and second limbs;
a first cable coupled to the first limb;
a second cable coupled to the second limb; and
an actuator operatively coupled to the first and second cables, wherein:
the actuator comprises an energy source; and
the actuator comprises a portion that is configured to engage the first and second cables, wherein the engaged first and second cables are configured to cause a change in a tension in the draw cord.

2. The archery bow of claim 1, wherein the body comprises a barrel.

3. The archery bow of claim 1, wherein;
the actuator comprises one of a motor, a pneumatic device, an electromagnetic device, and a motion mechanism; and
the portion of the actuator comprises at least part of a driver.

4. The archery bow of claim 1, wherein the energy source comprises one of an electrical source, a chemical source, a fuel source, and a gas pressure source.

5. The archery bow of claim 1, wherein:
the body is configured to at least partially extend along a longitudinal axis;
the archery bow comprises a bracket moveably coupled to the body;
the bracket is configured to be moved along the longitudinal axis;
the bracket is coupled to the first and second cables; and
the actuator is operatively coupled to the bracket.

6. The archery bow of claim 1, wherein the portion of the actuator is configured to apply at least one applied force to the first and second cables, the at least one applied force being at least partially transmitted from the first and second cables to the first and second limbs, respectively, the transmission of the at least one force causing the change in the tension in the draw cord.

7. The archery bow of claim 6, wherein:
in the first position, the first and second limbs comprise a first arrangement associated with a drawn condition of the archery bow; and in the second position, the first and second limbs comprise a second arrangement associated with an energized condition of the archery bow.

8. The archery bow of claim 6, wherein:

in the first position, the first and second limbs comprise a first arrangement associated with an un-cocked condition of the archery bow; and in the second position, the first and second limbs comprise a second arrangement associated with a cocked condition of the archery bow.

9. The archery bow of claim 1, comprising an actuator shaft operatively coupled to the actuator, wherein the actuator shaft is configured to rotate relative to the body to cause the change in the tension.

10. The archery bow of claim 1, comprising:

a first pivot bracket pivotally coupled to the body, wherein the first pivot bracket is operatively coupled to the actuator and to the first cable; and a second pivot bracket pivotally coupled to the body, wherein the second pivot bracket is operatively coupled to the actuator and to the second cable, wherein the first and second pivot brackets are each configured to pivot to cause the change in the tension.

11. The archery bow of claim 1, comprising at least one rotor operatively coupled to the actuator, wherein the at least one rotor is configured to rotate relative to the body to cause the change in the tension.

12. The archery bow of claim 11, wherein:

the at least one rotor comprises a pinion; and the archery bow comprises a rack operatively coupled to the first and second cables, wherein the pinion is configured to rotate relative to the rack to cause the change in the tension.

13. The archery bow of claim 1, comprising:

a first rotor coupled to the first limb, the first rotor defining a first groove configured to engage the draw cord; and a second rotor coupled to the second limb, the second rotor defining a second groove configured to engage the draw cord, wherein the first cable is coupled to the first rotor, wherein the second cable is coupled to the second rotor.

14. The archery bow of claim 1, wherein:

each of the first and second cables comprises one of a flexible band, a belt, a wire, a string, and a flexible line;

the draw cord comprises a bowstring; and the archery bow comprises a crossbow.

15. An archery bow comprising:

a first limb;

a second limb;

a draw cord coupled to the first and second limbs;

a first cord coupled to the first limb;

a second cord coupled to the second limb; and a driver operatively coupled to an energy source, wherein the driver is configured to apply at least one force to the first and second cords, wherein the first and second cords are configured to at least partially transmit the at least one applied force to the first and second limbs, respectively, to cause a change in a tension in the draw cord.

16. The archery bow of claim 15, wherein each of the first and second cords comprises:

a loop shape;

a plurality of cord ends; and an intermediate portion between the cord ends, wherein the cord ends are operatively coupled to the driver, wherein the intermediate portion is coupled to one of the first and second limbs.

17. The archery bow of claim 15, comprising:

a first rotor coupled to the first limb, the first rotor defining a first groove configured to engage the draw cord; and a second rotor coupled to the second limb, the second rotor defining a second groove configured to engage the draw cord, wherein the first cord is coupled to the first rotor, wherein the second cord is coupled to the second rotor.

18. The archery bow of claim 15, comprising a barrel that supports the first and second limbs, wherein:

the driver comprises one of a motor, a pneumatic device, an electromagnetic device, a motion mechanism, and an actuator; and the energy source comprises one of an electrical source, a chemical source, a fuel source, and a gas pressure source.

19. The archery bow of claim 15, comprising a body that supports the first and second limbs wherein:

the body is configured to at least partially extend along a longitudinal axis;

the archery bow comprises a bracket moveably coupled to the body;

the bracket is configured to be moved along the longitudinal axis;

the bracket is coupled to the first and second cords; and the driver is operatively coupled to the bracket.

20. The archery bow of claim 19, wherein:

the driver is configured to cause the bracket to move along the longitudinal axis from a first position to a second position;

in the first position, the first and second limbs comprise a first arrangement associated with a drawn condition of the archery bow; and in the second position, the first and second limbs comprise a second arrangement associated with an energized condition of the archery bow.

21. The archery bow of claim 15, wherein the archery bow comprises:

a body that supports the first and second limbs; and a shaft operatively coupled to the driver, wherein the shaft is configured to rotate relative to the body to cause the change in the tension.

22. The archery bow of claim 15, wherein:

each of the first and second cords comprises one of a cable, a flexible band, a belt, a wire, a string, and a flexible line;

the draw cord comprises a bowstring; and the archery bow comprises a crossbow.

23. A method for manufacturing an archery bow, the method comprising:

obtaining a first limb;

obtaining a second limb;

coupling a draw cord to the first and second limbs;

coupling a first cord to the first limb;

coupling a second cord to the second limb;

operatively coupling a driver to an energy source; and configuring at least part of the driver to engage the first and second cords so that the engaged first and second cords cause a change in a tension in the draw cord.

* * * * *